US005513703A

United States Patent [19]

Mills et al.

[11] Patent Number: 5,513,703

[45] Date of Patent: May 7, 1996

[54] METHODS AND APPARATUS FOR PERFORATING AND TREATING PRODUCTION ZONES AND OTHERWISE PERFORMING RELATED ACTIVITIES WITHIN A WELL

[75] Inventors: Aubrey C. Mills; Billy R. Newman, both of Houston; John A. Barton, Arlington; Neil H. Akkerman, Houston, all of Tex.

[73] Assignee: AVA International Corporation, Houston, Tex.

[21] Appl. No.: 222,734

[22] Filed: Apr. 4, 1994

Related U.S. Application Data

[63] Continuation-in-part of Ser. No. 163,824, Dec. 8, 1993.

[51] Int. Cl.[6] ..... E21B 29/00

[52] U.S. Cl. ..... 166/55.1; 166/316

[58] Field of Search ..... 166/51, 297, 237, 166/55.1, 55, 316; 175/4.51; 102/313

[56] References Cited

U.S. PATENT DOCUMENTS

| | | | |
|---|---|---|---|
| 2,873,676 | 2/1959 | Caldwell . | |
| 3,051,244 | 8/1962 | Litchfield . | |
| 3,335,802 | 8/1967 | Seyffert, III . | |
| 3,355,142 | 11/1967 | Kammerer, Jr. et al. . | |
| 3,768,562 | 10/1973 | Baker . | |
| 3,811,500 | 5/1974 | Morrisett et al. . | |
| 3,948,322 | 4/1976 | Baker . | |
| 4,269,278 | 5/1981 | Vann . | |
| 4,541,486 | 9/1985 | Wetzel et al. | 166/297 |
| 4,574,892 | 3/1986 | Griger et al. | 175/4.51 |
| 4,606,409 | 8/1986 | Peterson et al. | 166/297 |
| 4,629,001 | 12/1986 | Miller et al. | 166/297 |
| 4,678,044 | 7/1987 | Luke et al. . | |
| 4,762,067 | 8/1988 | Barker et al. | 102/313 |
| 4,880,059 | 11/1989 | Brandell et al. . | |
| 4,928,772 | 5/1990 | Hopmann . | |
| 5,070,943 | 12/1991 | Walker et al. . | |
| 5,287,924 | 2/1994 | Burleson et al. . | |
| 5,329,998 | 7/1994 | King et al. | 166/51 |
| 5,361,843 | 11/1994 | Shy et al. | 166/297 |

OTHER PUBLICATIONS

Conoco, Casing Conveyed Perforating Technology, date unknown.

*Primary Examiner*—Frank S. Tsay

*Attorney, Agent, or Firm*—Vaden, Eickenroht, Thompson & Feather

[57] ABSTRACT

There are disclosed methods and apparatus for perforating and treating zones of a well, as by hydraulic fracturing, stimulating and acidizing, and otherwise performing related activities within a well, wherein a plurality of perforating assemblies containing shaped charges are connected as part of a casing liner which is lowered into a well bore and then anchored therein by a column of cement in the annulus between the liner and bore to locate the assemblies opposite zones in a horizontal section of the well. Work strings are lowered into selected assemblies to cause tools carried thereby to sequentially detonate the shaped charges to perforate the zone opposite thereto and to selectively open or close the perforated zones by shifting a sleeve within a housing of the assembly as well as treating the perforated zones.

33 Claims, 46 Drawing Sheets

343A
370
340
371
351
352
14
14
BDST'
346
343
342
363

343A
370
371
353
350
15
15
354
347
BDST'
346
372
342
363

343A
345
371
353
350
347
BDST'
346
343
342
363

362
361
16
16
376
375
361A
BDST'
342

362
361
376
375
361A
BDST'
342

362
361
376
375
361A
BDST'
342

FIG. 14
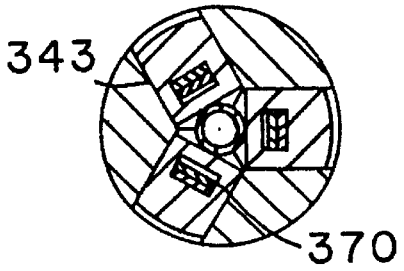
FIG. 15
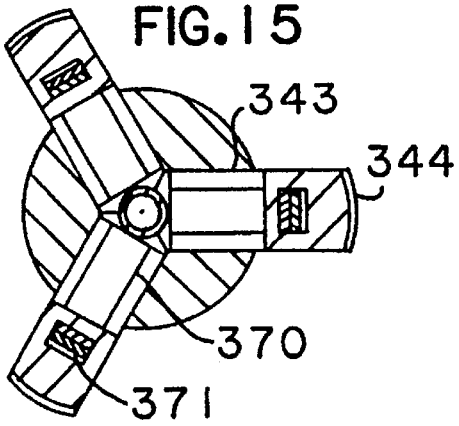
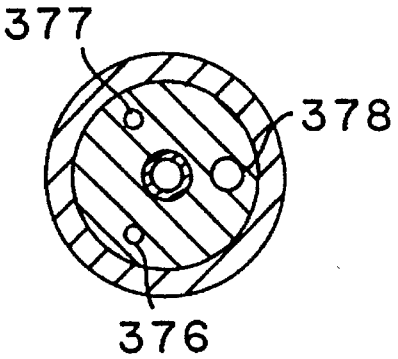
FIG. 16
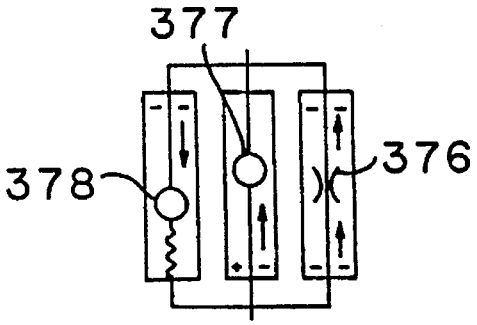
FIG. 17

320B
345
370
371
353
351
329A
352
350
329
354
329B
347
324
346
321
325
372
343A
320A
322
320
BDST'
342

320B
345
370
371
353
351
329A
350
352
329
354
329B
347
324
346
321
325
372
343A
320A
322
320
BDST'
342

FIG. 50
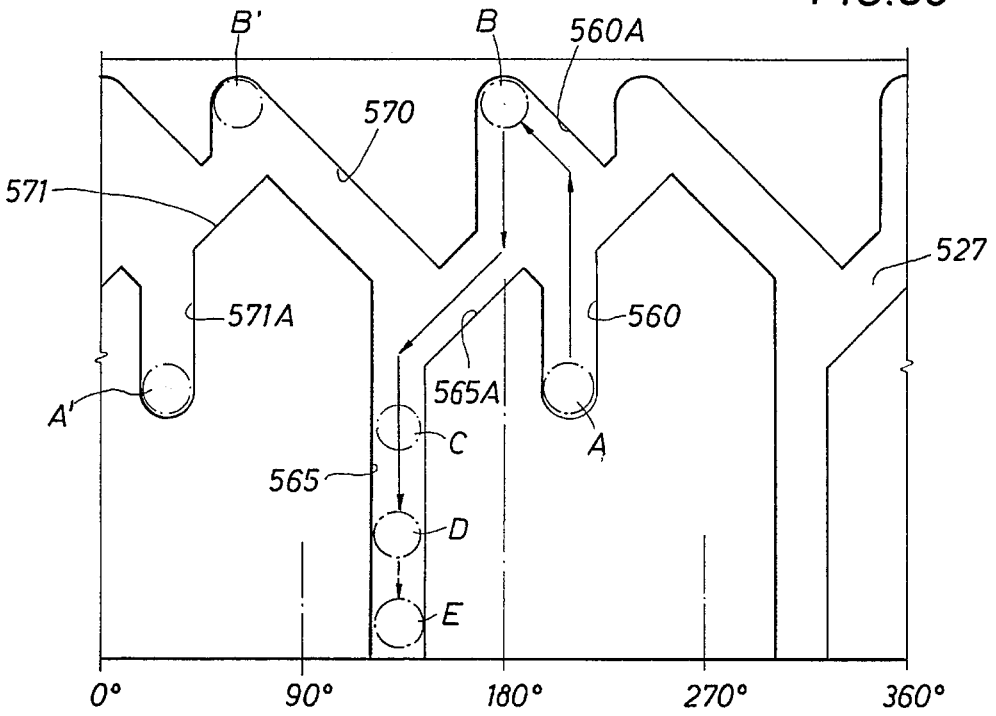
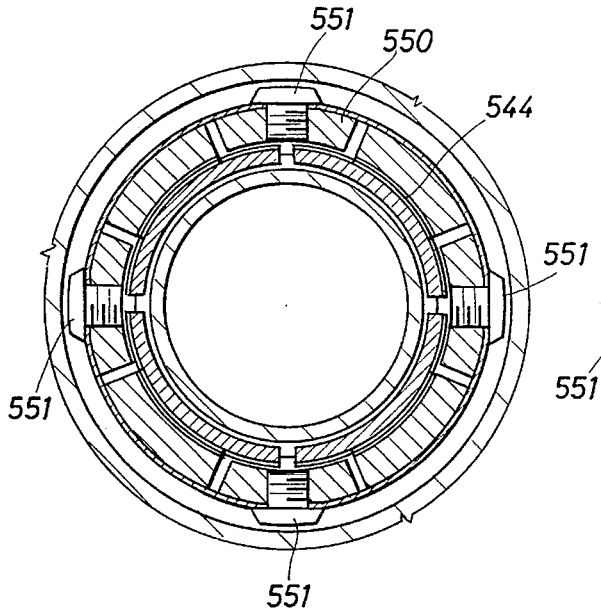
FIG. 48
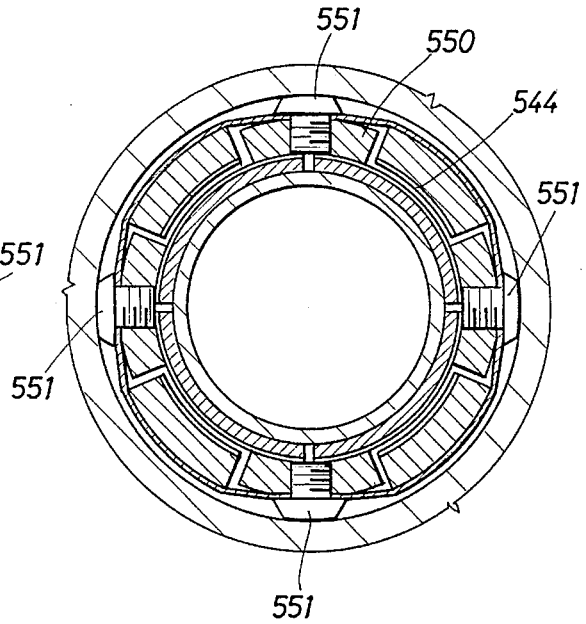
FIG. 49

METHODS AND APPARATUS FOR PERFORATING AND TREATING PRODUCTION ZONES AND OTHERWISE PERFORMING RELATED ACTIVITIES WITHIN A WELL

This application is a continuation-in-part of our copending application Ser. No. 08/163,824, filed Dec. 8, 1993, and entitled "Well Apparatus."

In one of its aspects, this invention relates generally to methods and apparatus for perforating and treating production zones, as by way of hydraulic fracturing, stimulating, and acidizing, and otherwise performing related activities within a well. More particularly, it relates to improvements in such methods and apparatus wherein shaped charges or other means for perforating a well conduit, such as a casing string which is anchored within the well bore by a column of cement in the annulus between the casing string and well bore are carried into and installed in the well with a well string, and, in the latter case, with the casing string—i.e., a procedure known as "casing conveyed perforating." In another of its aspects, this invention relates to improved tools for use in such methods and apparatus, as well as other methods and apparatus, wherein one or more sleeves are to be shifted within the casing string or other well conduit in an essentially horizontal section of the well bore.

It has long since been the practice, in the drilling and completion of oil and gas wells, to form perforations in the outer casing string and the column of cement which anchors it in the well bore in order to open the production zones at selected intervals in the well, which, for the purposes of this application, and especially in a horizontal section of the well, normally contemplate individual zones or areas of a single formation, although one or more of them could be a separate formation. For this purpose, perforating guns having shaped charges have been lowered into the casing on an electrical line to locate them at the desired interval and the charges then detonated through firing mechanisms connected in the electrical line and actuated from the surface.

This has required that drilling mud be circulated into the well to keep each zone under control as each interval is separately perforated. Thus, the electrical line had to be retrieved and the drilling mud circulated out of the well so as to permit the zone to be acidized or otherwise stimulated to promote production. In any event, some damage to the formation was inevitable.

More recently, it has been proposed to lower the guns with and install them in the well on a string of tubing carrying packers adapted to be expanded into engagement with the casing to enable the zones to be isolated. This made it possible to perforate the casing in an "underbalanced condition" so as to induce flow from the perforated zone with the well under control.

Even so, in this latter procedure, known as "tubing conveyed perforating," it is necessary to drop mechanisms into the tubing to fire the guns. This is especially difficult to do when the intervals to be perforated are in a horizontal leg in the well. As a result, it was proposed to run the firing mechanisms into the well on coiled tubing which is capable of making the bend from the vertical to the horizontal section of the well.

But there are special problems which are encountered in completing horizontal wells, which may be thousands of feet below the surface. Hence, it may be necessary to isolate the zones due to pressure differentials between the zones even though below the packer in the vertical section of the well. Consequently, it may be necessary, in some such procedures, to run the tubing string each time a zone is to be perforated.

More recently, it has been proposed to perforate multiple zones in one trip by forming ports in the casing string at spaced locations opposite different zones which are closed by shiftable sleeves as they are cemented in the well bore along with the casing. When the casing has been anchored in the well, the sleeves are shifted by a tool run into the casing so as to open the ports to permit the cement to be washed away and the zones treated by injection of appropriate fluids through the ports. The sleeves may then, of course, be shifted back to close the ports until it is desired to produce from the zone. Even in this procedure, there is no control of the surrounding environment. Also, of course, difficulty may be encountered in shifting the sleeves to open positions since they are anchored in cement, particularly in a remote horizontal section of the well.

U.S. Pat. No. 3,468,386 discloses a casing liner on which perforating guns having shaped charges are run. When at total depth, the casing is cemented in the well bore and the shaped charges are detonated to perforate the casing opposite zones to be produced. The so-formed perforations may then be opened and closed by sleeves in the casing adapted to be shifted by a tool lowered into the liner. The shifting tool, however, would be incapable of operating in a horizontal well. Also, the guns are fired only by individual electrical lines run into the liner, and the guns, and, hence, the zones to be perforated, are not isolated from one another. To our knowledge, this system has not been used on a commercial basis.

If such sleeves in the horizontal section of the well must be shifted by tools run on coiled tubing, the operator is unable to do so with rotary movement as is common in the activation of similar tools run on rigid tubing in a vertical well. Hence, the tools must be capable of performing their desired task without the transmission of torque, and, of course, at substantial depths below the surface. These procedures are further complicated when it is necessary for the tool to shift the sleeve in both directions and/or "select" or discriminate between certain sleeves or other parts to be activated opposite different zones in the well.

As shown, for example, in U.S. Pat. No. 4,928,772, a sleeve may be mounted for shifting within the bore of a housing which is connected as part of the well conduit and has one or more preformed ports adapted to be closed in one alternate position of the sleeve or opened in the other alternate position thereof. As shown, the sleeve has vertically spaced grooves about its inner diameter each for receiving a key carried by a tool suspended from coil tubing and having a profile matching that of each groove. More particularly, each groove has a "square" or abrupt shoulder one of which faces up and the other down, and adapted, depending on the orientation of the key, to be engaged by a similarly shaped shoulder on the key as the key is spring-pressed into the groove when opposite thereto. Thus, with the key arranged with its shoulder up to engage the down shoulder on one of the grooves, the sleeve may be shifted to its upper position upon raising of the tool with the pipe string, and, with it arranged with its shoulder down to engage the up shoulder on the other of the grooves, the sleeve may be shifted to its lower portion upon lowering of the tool.

As will be appreciated, however, the key must be oriented in the desired vertical direction to shift the sleeve to in a desired direction, and, in order to shift the sleeve in the opposite direction, or, alternatively to shift a plurality of vertically spaced sleeves in the well conduit to opposite positions—i.e., one up and one down—it is necessary to either pull the pipe string in order to reverse the position of the key or to install a pair of vertically spaced oppositely oriented keys in the pipe string.

As also shown in such patent, the keys are of such construction as to cooperate only with a groove of matching profile, hence limiting its use to shifting only certain sleeves. Furthermore, the keys must be "selective" in the sense that they match only one sleeve in the conduit, and hence will not become unintentionally engaged in another sleeve at another vertical level.

An object of this invention is to provide a method and apparatus for perforating, and, where required, treating production zones, particularly within a horizontal section of the well bore, in which the aforementioned problems are overcome.

More particularly, this invention relates to a method and apparatus wherein perforating assemblies are installed as part of a well conduit, such as a casing string as it is run into the well bore, so that, for example, when the casing string is lowered to the desired depth, and the string anchored in the well bore by a column of cement in the annulus between the string and bore, the assemblies are disposed opposite the production zones to be perforated, and in some cases treated, and wherein the assemblies are of such construction that, as compared with prior procedures, the various zones may be isolated from one another as each is perforated.

Another object is to provide such a method and apparatus which includes, in addition to such improved perforating assemblies, a series of tools which may be lowered into and raised from the casing string or other well conduit on one or more work strings for the purpose of activating the shaped charges of selected assemblies and then opening the perforations for enabling the perforated zones to be treated, if required, without commingling with other perforated zones, and then closing the perforations until the zone is to be produced.

Still another object is to provide such a method and apparatus in which, following formation of the perforations, the sealing integrity of the perforating assembly may be tested, in response to manipulation of another tool carried by the work string, and, more particularly, in those cases in which leakage is detected, remedial steps may be taken again in response to manipulation of the same work string, and thus without the necessity of pulling the string.

Yet a further object of this invention is to provide such a method and apparatus having a perforating assembly of such construction as to enable the perforations to be opened to the casing string, and if desired the perforated zones treated and then closed until the operator is ready to produce them, in response to manipulation of parts of the assembly by tools adapted to be lowered into and out of the casing string on another work string, thus again without the need of pulling the string to rerun the tools on another string each time a zone is to be treated and then closed.

Yet another object is to provide such apparatus in which the perforating assembly and associated tools are so arranged and of such construction as to permit these operations to be performed in the desired sequence and order, with a minimum risk of operator error, and, more particularly, in which such tools are caused to perform the required tasks solely in response to reciprocation of the work strings and/or the control of fluid pressure within the work strings.

A yet further object is to provide apparatus having sleeves shiftable within a well conduit, whether forming parts of the aforementioned perforating assembly or for other purposes, by means of a shifting tool capable of shifting one or more of the sleeves in either or both directions, shifting one or more selected sleeves of vertically spaced sleeves, and/or shifting sleeves having grooves of various configurations.

In conventional perforating guns, the firing mechanism is often precompressed by means which must be released to permit the firing to occur. This, of course, increases the risk of premature firing, which could be especially dangerous when handling the perforating guns at surface level, and it is therefore a still further object of this invention to provide a perforating assembly having a firing mechanism in which this risk is minimized.

These and other objects are accomplished, in accordance with the illustrated embodiment of the invention, by apparatus which includes a perforating assembly having a tubular housing connectable as part of a well conduit, which, in accordance with the preferred and illustrated embodiment of the invention, comprises a casing string to be lowered into and anchored within the well bore by a column of cement between it and the well bore, a perforating sleeve mounted within the housing and carrying shaped charges within a sealed chamber facing the side of the housing to be perforated, and thus the outer side thereof opposite the cement column, and means by which the charges may be detonated to perforate the housing and thus the cement column thereabout. Upon testing the sealing integrity of each assembly, following detonation, subsequent zones may be perforated without commingling with others.

In preparation for treating the perforated zone, the perforating sleeve is vertically shiftable to a second position in the housing to uncover the perforations therein. Preferably, the perforating sleeve is releasably retained in its first position and then locked in its second position automatically in response to shifting into its second position.

The means by which the charges may be detonated includes a trigger extending from the chamber in the perforating assembly into the casing string in position to activate the charges when shifted with respect to the sleeve, and a perforating work string lowerable through the casing string and into the housing and having a tool thereon for manipulating the outer end of the trigger to shift it to activating position, preferably in response to vertical movement of the work string. The perforating sleeve contains a detonator wired to the shaped charges, a firing pin positioned to strike the detonator in order to detonate the charges when engaged by the trigger, and detent means releasably holding the inner end of the trigger in a first inactive position. More particularly, a means is disposed intermediate the detent means and the outer end of the trigger which is responsive to activation by the trigger manipulator to accumulate energy which, at a predetermined level, causes the detent means to be released so that the accumulated energy causes the inner end of the trigger to strike the firing pin.

The perforating work string also has a tension set packer installed thereon below the trigger manipulator for engaging the bore of the housing of the assembly above the perforating sleeve, so that, following activation of the charges, the string may be raised to a position in which the sealing integrity of the perforating assembly may be tested by the pressure fluid circulated downwardly through the work string.

More particularly, for use in the event the perforating assembly does not hold pressure, the assembly includes a seal sleeve which is mounted in the housing at one end of the perforating sleeve, and a bidirectional shifting tool which is installed in the work string to engage and shift the perforating sleeve to a second position to uncover the ports, and then engage and shift the seal sleeve into a second position covering and enclosing the perforations in the housing. The shifting tool is then released from the seal sleeve and the perforating work string moved back to a position in which the packer is sealed off in the upper bore of the housing to test the sealing integrity of the perforating assembly. More particularly, the sleeves and shifting tool are of such construction that, in accordance with the novel aspects of this invention, the perforating sleeve can be shifted only if the trigger has been activated to detonate the charges and the seal sleeve may be shifted only upon shifting of the perforation sleeve.

Following a successful test, the perforating work string and its tools are retrieved and replaced by a treatment work string having a downshifting tool engagable with the perforating sleeve to shift it to its second position and then, upon release from the perforating sleeve, engagable with the seal sleeve to shift it to its second position, as would have been done by the bidirectional shifting tool of the perforating work string in the above described remedial procedure. The treatment work string also includes an upshifting tool which is caused to engage and move the seal sleeve to another position uncovering the ports, and then, upon further manipulation of the work string, to pack off within the seal sleeve to permit treatment fluid to be circulated downwardly through the string and into the perforated zone.

Following treatment, and with the last mentioned tool still engaged with the seal sleeve, the work string is lowered to shift the seal sleeve back to its position covering the ports. Preferably, lowering is assisted by a downward force due to fluid pressure introduced into the annulus above the pack-off between the tool and seal sleeve.

Thus, in using such apparatus for completing a well having a plurality of longitudinally spaced production zones, a plurality of assemblies are installed in longitudinally spaced locations along the length of a casing string so that, upon lowering and anchoring of the string into a well bore, the shaped charges are disposed opposite selected production zones, and the shaped charges of selected assemblies are sequentially detonated by appropriate manipulation of the trigger manipulator in the perforating work string in order to perforate the zones opposite thereto while maintaining the chamber of each assembly isolated from the chambers of the other assemblies. In treating the perforated zones, the lowermost perforations are first uncovered to open the lowermost zone to the casing string, and the opened zone is then treated, following which successively upward perforated zones may be sequentially treated and then closed until the zone is ready to be produced.

Each of perforating and seal sleeves is mounted in a recess within the bore of the housing intermediate its upper and lower ends and has a groove about its inner diameter to receive latch means in the form of latch dogs carried by the bidirectional shifting tool. The sleeves are so constructed that the latch dogs pass through the latching groove in the seal sleeve above the perforation sleeve and then snap into the latching groove in the perforating sleeve to permit the perforating sleeve to be lowered with the work string in order to uncover the perforations, and then, upon raising of the tool, following lowering of the perforating sleeve, without raising the perforating sleeve, snap into the latching groove in the seal sleeve, whereby the seal sleeve may be lowered with the work string to a position over the perforationg uncovered by lowering of the perforating sleeve.

More particularly, a means on the bore of the housing beneath the recess therein engages and forces the latch dogs inwardly out of the groove in the perforating sleeve, upon continued lowering of the tool with the perforating work string following lowering of the perforating sleeve, and a means on the perforating sleeve engages and forces the latch dogs inwardly out of the groove in the seal sleeve, upon continued lowering of the tool with the perforating work string following lowering of the seal sleeve. In this way, the operator is able to sense at the surface that each of the sleeves has in fact been lowered.

In accordance with another novel aspect of this invention, each of the perforating and seal sleeves, or, in accordance with another embodiment of the invention, a single sleeve similar to that of U.S. Pat. No. 4,928,772 is shiftable between positions opening and closing preformed ports in a well conduit by a tool whose latch dogs are moved to their outer positions to engage in a groove in the sleeve in response to a predetermined increase in the pressure of fluid within the tool body, and are yieldably urged to their inner positions, upon a predetermined reduction in such pressure, so that they may be retracted from the groove to permit the tool to move vertically out of the sleeve. More particularly, the tool for manipulating the trigger of the perforating assembly which is also installed in the perforating work string, has latch dogs adapted to be similarly expanded and contracted between positions for engaging and disengaging the trigger.

Thus, in their illustrated embodiments, each such shifting and trigger manipulating tool includes a tubular body connectible to the perforating work string for lowering into the well conduit and having windows spaced about its circumference, a beam received in each window for guided radial movement with respect to the body, a tubular member extending longitudinally within the body to form an annular space between them, and a piston longitudinally slidable within the annular space at each end of the beam. An end of each piston is responsive to fluid within the body, so that, when its pressure is raised to a predetermined level, the pistons deflect the beam outwardly to a position in which, upon movement of the body with the pipe string vertically within the well conduit, latch dogs on the outer sides of the beams will engage the trigger or a shoulder in a groove in a sleeve to be shifted. Bow springs are retained on the inner sides of the beam and arranged to retract the beams and thereby remove the dogs from the trigger or sleeve, following manipulation or shifting and responsive to a predetermined reduction in such pressure.

In one of its embodiments, the latch dogs of the sleeve shifting tool may be released from their expanded position, in the event the pistons do not react to the reduction in pressure, by a means which is responsive to a predetermined vertical force applied to the work string, when the dogs are engaged in a groove, to release at least one end of each beam so that it may return to its retracted position.

In its illustrated embodiment, the tension set packer comprises a tubular body adapted to be installed in the perforating work string beneath the sleeve shifting tool, a ring fixed to and carried about the body, and a tubular member having collet fingers carried about the body intermediate the ring and an upper, downwardly facing shoulder on the tubular body and having latch dogs at their lower ends movable between retracted and expanded positions. An annular packing element is supported by the tubular member to surround the body, a piston is disposed between the tubular body and tubular member to form a pressure chamber between the piston and tubular body having a downwardly facing pressure-responsive surface, and a spring is compressed between the piston and tubular member. More particularly, the tubular body has a port connecting within the chamber so that pressure in the tubular body moves the piston to further compress the spring, and the piston and collet fingers have means thereon which, upon movement of the piston, are cooperable with one another to move the collet fingers outwardly and thus move the latch dogs thereon into the groove in the upper bore of the housing of the perforating assembly, when disposed opposite thereto, and said ring has a shoulder facing the free end of the packing element, whereby, upon movement of the latch dogs into the groove, tension may be applied to the perforating work string to cause the packing element to be squeezed between the shoulder on the tubular body and the collet fingers so as to expand the packing element into sealing engagement with the upper bore in the housing.

Preferably, an expander about the body is adapted to move beneath the latch dogs, upon raising of the body, to hold them within the groove. Also, the ring is connected to the body by parts which are released in response to increased tension applied to the work string to permit the packing element to contract in the event pressure cannot be released from the pressure chamber to permit the packing element to contract.

As previously mentioned, the treatment work string includes a tool for first shifting the perforating sleeve and then the seal sleeve to their lower positions, in the event they have not already previously been shifted downwardly during the above described remedial process by the bidirectional shifting tool installed as part of the perforating work string, and another tool above the downshifting tool for raising the seal sleeve to uncover the perforations and then packing off within it to enable treatment fluid to be circulated down through it and into the perforated zone. Lowering of the seal sleeve, either by the perforating work string during a remedial process, or by the treatment work string following lowering of the perforating sleeve in the event of a successful pressure test, will in any case automatically release a spacer sleeve carried by the perforating assembly housing above the seal sleeve. The upshifting tool is then manipulated to raise the seal sleeve, which was lowered either by the perforating work string or by the treatment work string, into engagement with the spacer sleeve, which, as will be understood from the description to follow, locates the seal sleeve in a position as to not only uncover the perforations so that the perforated zone may be treated, but also ensure that the upshifting tool will engage only with the upper bore of the housing in order to locate its packing element in a position for packing off with respect to the raised seal sleeve prior to treatment.

As previously described, following treatment, the upshifting tool is lowered with the work string to in turn lower the seal sleeve to a position covering the perforations, preferably with the assistance of a force due to fluid pressure in the annulus. As it is lowered, the upshifting tool is released from the seal sleeve so that the work string may be retrieved until the operator is ready to open the perforations to produce the well.

In the illustrated embodiment of the invention, the downshifting tool comprises a tubular body connectable to the treatment work string for raising and lowering into the housing of the perforating assembly, an outwardly urged latch having latch dogs carried about the body, and an inwardly urged retainer releasably connected to the body in a first outer position in which it holds the latch dogs in an inner position to permit it to move freely through the sleeves. A means on the retainer automatically engages with the upper bore of the housing, upon raising of the body, to permit the retainer to be released from connection to the body, so that upon continued raising of the work string, the retainer may move to a lower position with respect to the body in which it releases the latch dogs for movement to outer positions and in which the retainer moves to its inner position to withdraw the means on the retainer thereon from engagement with the upper bore in the housing.

The downshifting tool also comprises means on the retainer and body for holding the retainer against movement back to its first position as the retainer is moved to its second position, and means on the latch dogs which, when the latch is released to its outer position, is automatically engagable with the perforating sleeve, as the body is lowered with the work string, to permit the perforating sleeve to be shifted by the latch dogs to its second position as the body continues to be lowered. More particularly, a means on the latch is engagable with means in the lower bore of the housing, as the sleeve is shifted to its second position, in order to move the latch dogs out of engagement with the perforating sleeve and thus indicate to the operator that it has been shifted. The latch is so constructed as to move the latch dogs past the perforating sleeve in order to automatically engage with the seal sleeve, upon raising of the tool with the treatment string, to enable the seal sleeve to be lowered as the string is again lowered. More particularly, the latch moving means is engagable with means on the perforating sleeve as the seal sleeve is lowered to move the latch dogs out of engagement with the seal sleeve, again indicating to the operator that it has been shifted.

As shown, the latch has a sleeve at one end supported by the body and collet fingers extending from the sleeve and having the latch dogs on their outer sides, and the retainer has a sleeve at one end releasably connected to the body and collet fingers extending from the sleeve and having groove-engaging profiles on their outer sides. The retainer fingers are in surrounding relation to the collet fingers to hold the latch in its inner position and are movable out of surrounding relation when the retainer moves to its second vertical position, and a means is engagable with the body to hold the fingers in their outer positions when the retainer is in its first vertical position to release the fingers to move to their inner positions as the retainer moves to its second vertical position.

In its illustrated embodiment, the upshifting tool also comprises a tubular body connectable to the work string beneath the downshifting tool for lowering therewith and having latch dogs carried by the body for radial movement between normally retracted positions and expanded positions for engaging in the groove of the seal sleeve. The tool further comprises means on the body for expanding the latch dogs into the groove, when the sleeve is in its lower position and the latch dogs are disposed opposite to the groove and in response to initial upward movement of the body, whereby the sleeve may be shifted with the body to its upper position. More particularly, a packer disposed about the body is normally retracted for disposal opposite the bore of the seal sleeve, when the latch dogs engage the groove, and a means is provided for expanding the packer into sealing engagement between the body and sleeve, following shifting of the sleeve and in response to further raising of the body. As shown, the means for expanding the latch dogs includes means on the body for holding them in expanded position within the groove so the sleeve may be shifted back to its lower position in response to movement of the body with the work string in the opposite vertical direction. More particularly, in the raised position of the sleeve, the packer forms a piston with the sleeve which is responsive to pressure fluid in the annulus between the casing and work string to urge the seal sleeve back to its first position.

The latch dogs and packer are carried by the body for vertical reciprocation with respect to it, and the tool further includes means which automatically locks the body against vertical movement in the opposite direction with respect to the latch dogs in response to further movement of the body to expand the packer, and means automatically responsive to movement of the body in the one direction to shift the sleeve back to its first position for releasing the locking means, so that the body may be moved further in said one vertical direction to release the expanding means and packer for return to their collapsed positions. As shown, the packer is carried on the end of a tubular member vertically reciprocable with respect to the body, and a nut is connected the to body in position to engage and compress the packer between the nut and end of the tubular member as the body is moved in said one direction. More particularly, the latch is carried on another tubular member vertically reciprocable with respect to the body and the first tubular member, the connection of the nut to the body is releasable to permit the packer to collapse in response to increased force to move the body in said one direction, and the tubular member has cam means to engage and collapse the latch as it is moved in said one direction with the body.

In the drawings, wherein like reference characters are used throughout to designate like parts:

FIGS. 1A–1P are diagrammatic views of a well installation including a casing string or liner in which perforating assemblies constructed in accordance with the present invention are installed and lowered within a horizontal section of a well bore for anchoring therein by means of a column of cement between it and the well bore, and work strings carrying the above described tools are lowered into the casing string for cooperation with the assemblies to perform various operations in response to manipulation of the work string, including perforating the casing and well bore, treating the zone which has been perforated, and then preparing the zones for producing therefrom, wherein FIG. 1A shows a perforating assembly conveyed into the well bore on the casing string and during the pumping of cement downwardly through a cement string installed in the casing string and out the lower end of the casing string and into the annulus between the casing string and well bore;

FIG. 1B shows the casing string and perforating assembly fully cemented in the well bore, with the cement string removed and replaced by the perforating work string carrying the trigger manipulating tool at its upper end, the tension set packer at its lower end, and the bidirectional sleeve shifting tool intermediate the trigger manipulator and the tension set packer, and showing the work string raised to a position within the assembly in which the trigger manipulator has engaged and activated the trigger of the perforating sleeve to detonate the shaped charges thereof and thus perforate the casing and well bore at a location opposite the perforating sleeve;

Figure 1A:
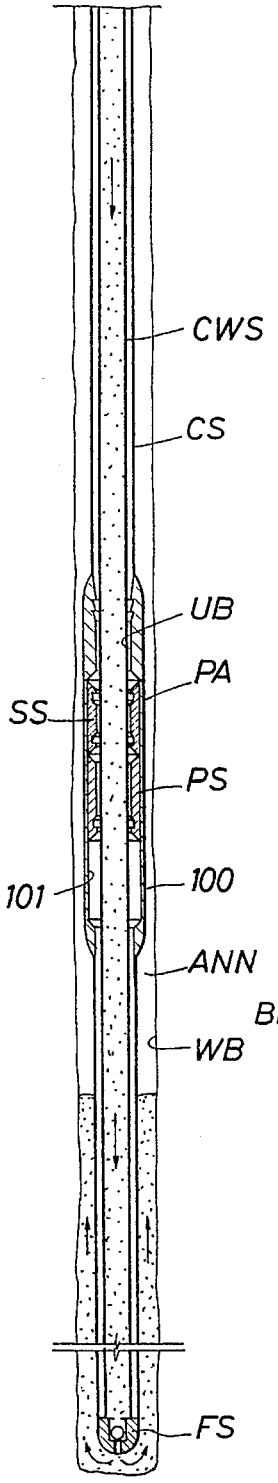
FIG. 1C shows the perforating work string raised further to dispose the tension set packer on its lower end in sealing engagement with the upper bore of the housing of the perforating assembly so as to permit the sealing integrity of the perforating assembly to be tested.
FIG. 1D shows the perforating string lowered to engage the bidirectional shifting tool with the perforating sleeve preparatory to shifting it to its lower position in which the assembly may be tested in the event it did not hold pressure during the initial test shown in FIG. 1C.
FIG. 1E is a view similar to FIG. 1D, but upon lowering of the perforating sleeve to its lower position beneath the perforations.
FIG. 1F is a view similar to FIG. 1E, but upon release of the bidirectional shifting tool from the perforating sleeve and raising thereof with the work string to engage the seal sleeve preparatory to lowering it.
FIG. 1G is a view similar to FIG. 1F, but following lowering of the seal sleeve to its lower position just above the perforating sleeve to close the perforations, and subsequent raising of the perforating string to dispose the tension set packer within the upper bore of the housing of the perforating assembly to permit the sealing integrity of the assembly to be tested.
FIG. 1H shows the well installation following removal of the perforating work string from the position of FIG. 1C, following a successful test of the sealing integrity of the perforating assembly, and lowering of the treatment work string into the casing string to engage the downshifting tool thereof with the perforating sleeve preparatory to lowering it from the position of FIG. 1C.
FIG. 1I is a view similar to FIG. 1H, but upon lowering of the perforation sleeve and release of the downshifting tool therefrom upon continued lowering of the work string.
FIG. 1J is a view similar to FIG. 1I, but upon raising of the perforating work string to raise the downshifting tool as well as the upshifting tool installed in the work string below it above the perforating assembly.
FIG. 1K is a view similar to FIG. 1J, but upon lowering the work string to engage the downshifting tool with the seal sleeve preparatory to lowering it from its upper position of FIG. 1J.
FIG. 1L is a view similar to FIG. 1K, but upon continued lowering of the seal sleeve to its position just above the lowered perforating sleeve, and further lowering of the treatment work string to lower both the downshifting and upshifting tools below the perforating assembly.
FIG. 1M is a view similar to FIG. 1L, but upon raising of the work string to engage the upshifting tool with the seal sleeve so as to raise the seal sleeve back to its upper position and then sealably engage the bore of the seal sleeve so that treatment fluid may be circulated down through the string and into the perforations opened by raising of the seal sleeve.
FIG. 1N is a view similar to FIG. 1M, but upon lowering of the work string as pressure is applied in the annulus above the pack-off to force the seal sleeve downwardly from its upper position to a position covering the perforations.
Figure 1B:
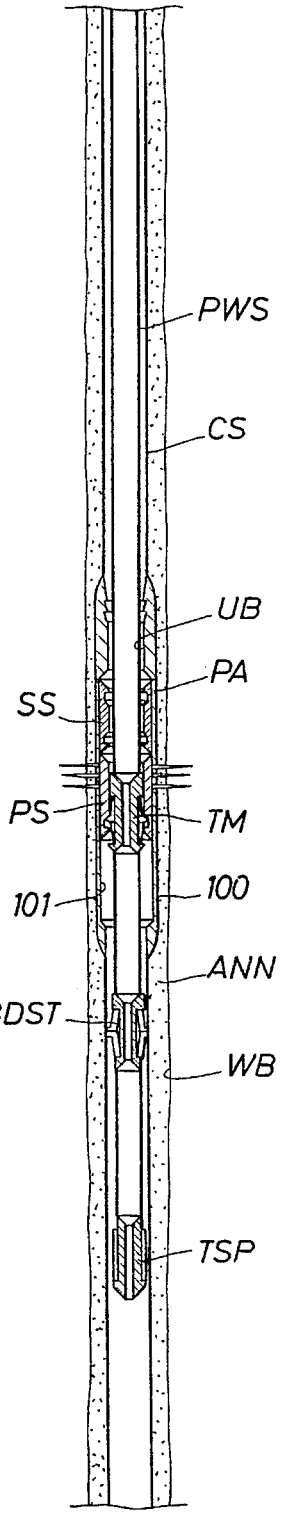
Figure 1C:
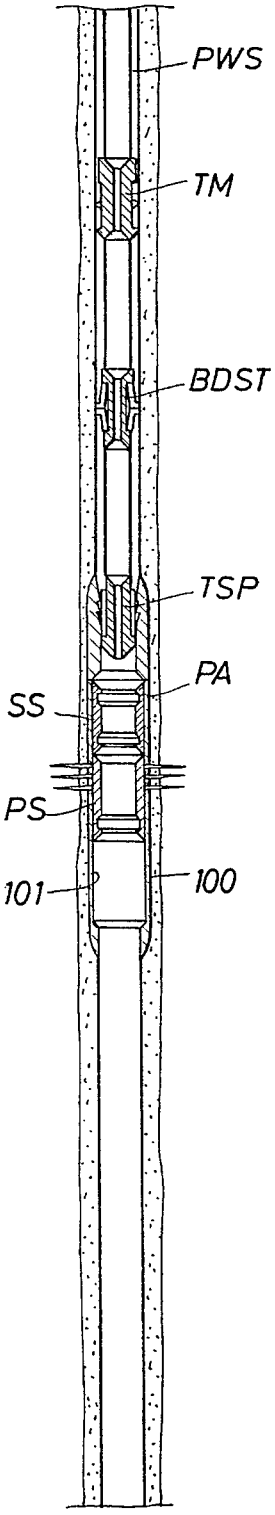
Figure 1D:
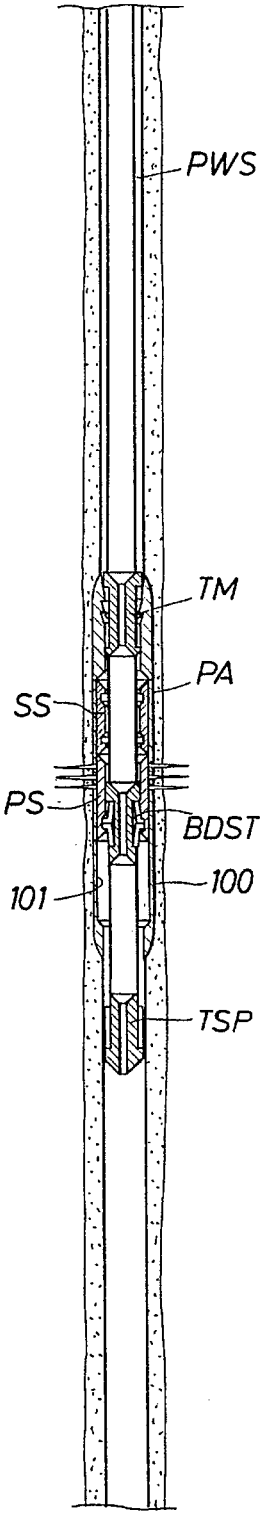
Figure 1E:
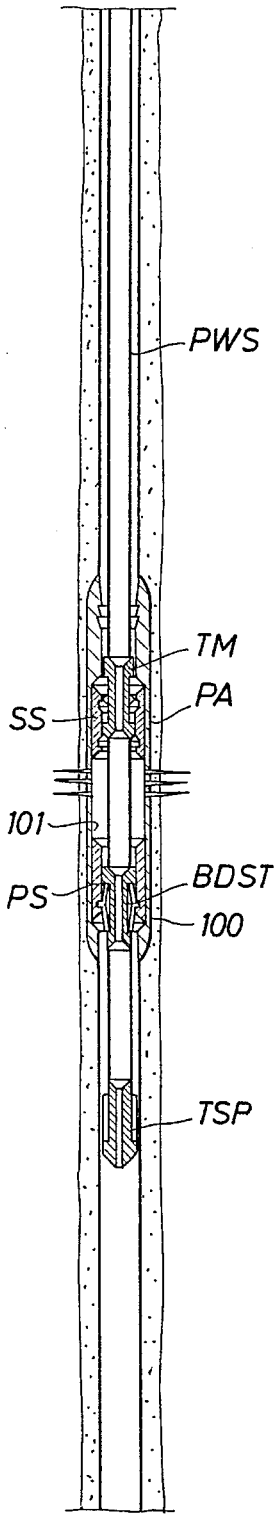
Figure 1F:
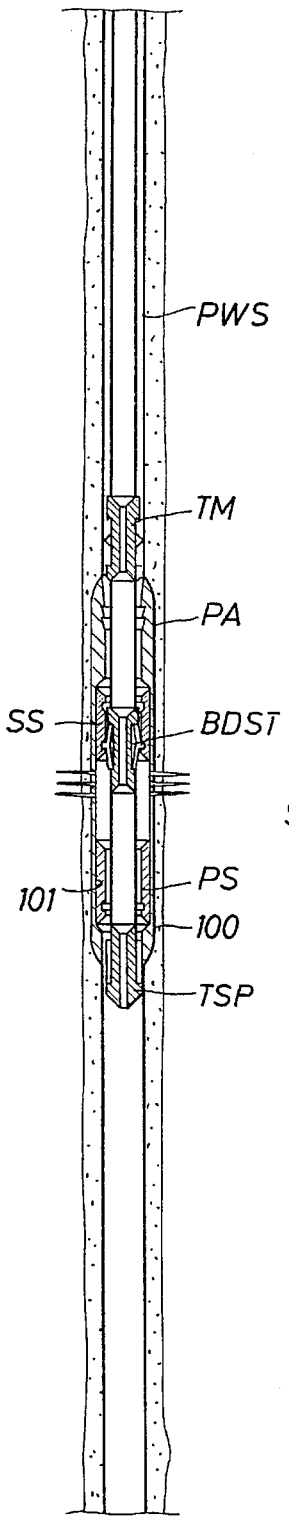
Figure 1G:
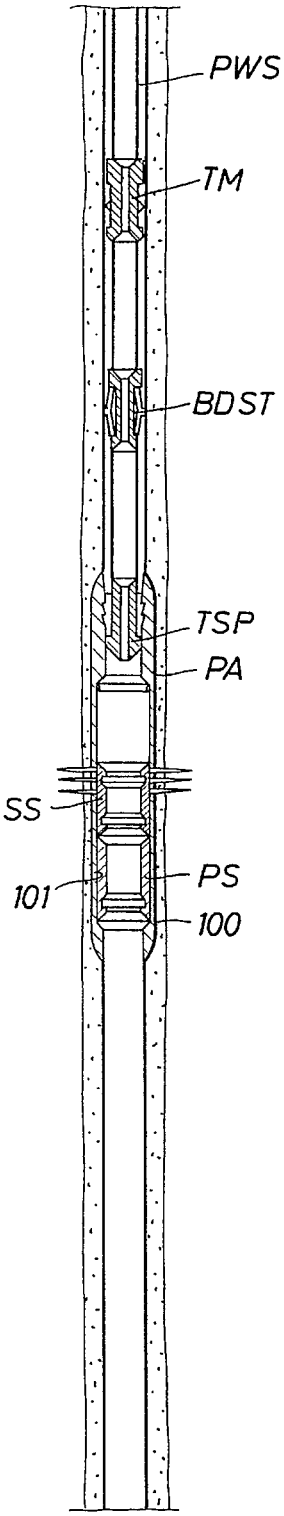
Figure 1H:
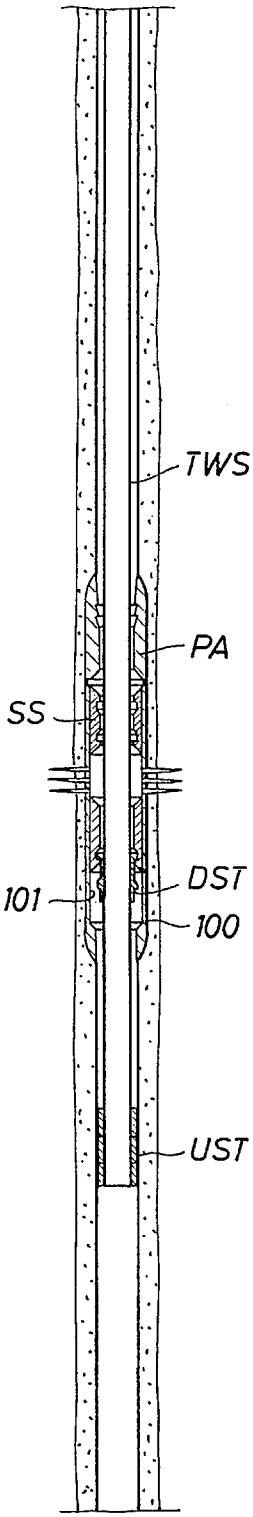
Figure 1I:
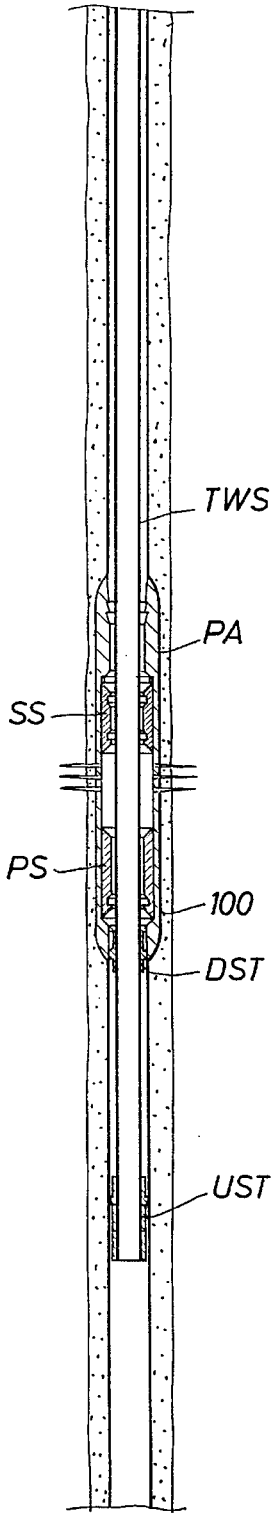
Figure 1J:
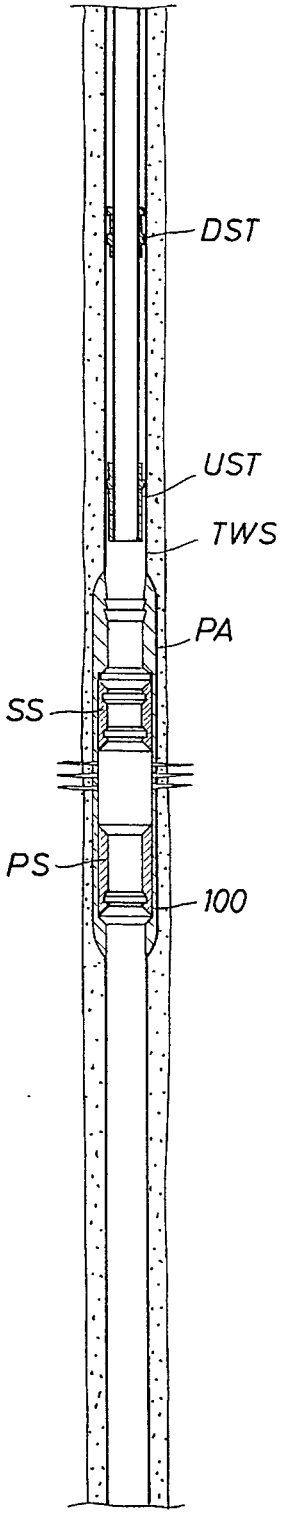
Figure 1K:
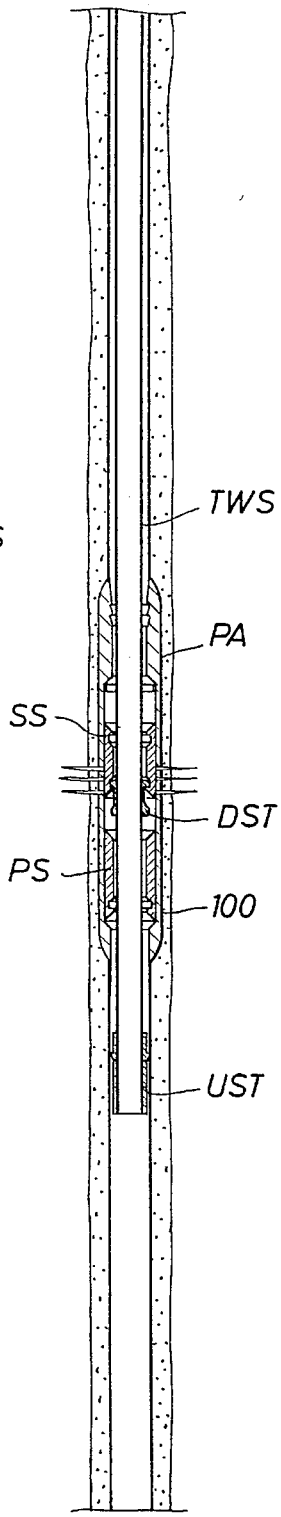
Figure 1L:
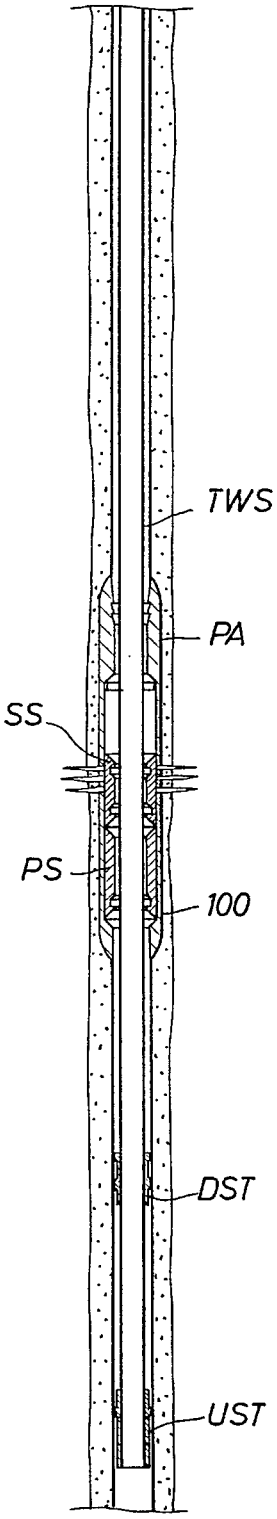
Figure 1M:
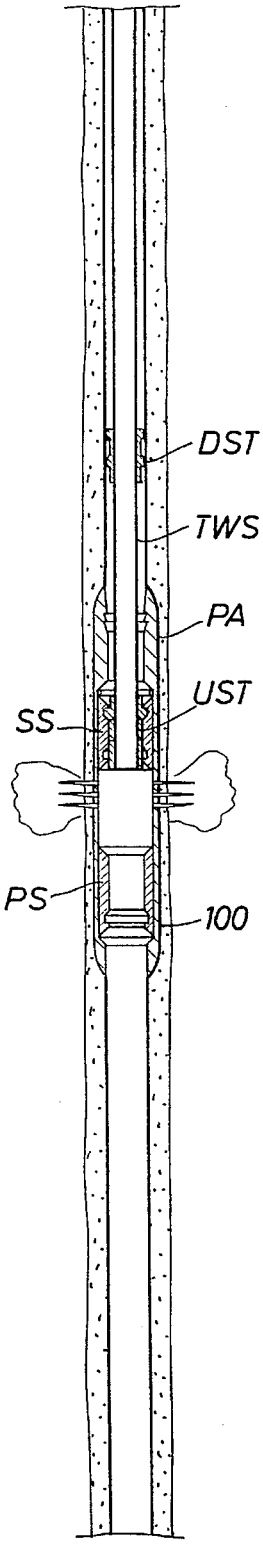
Figure 1N:
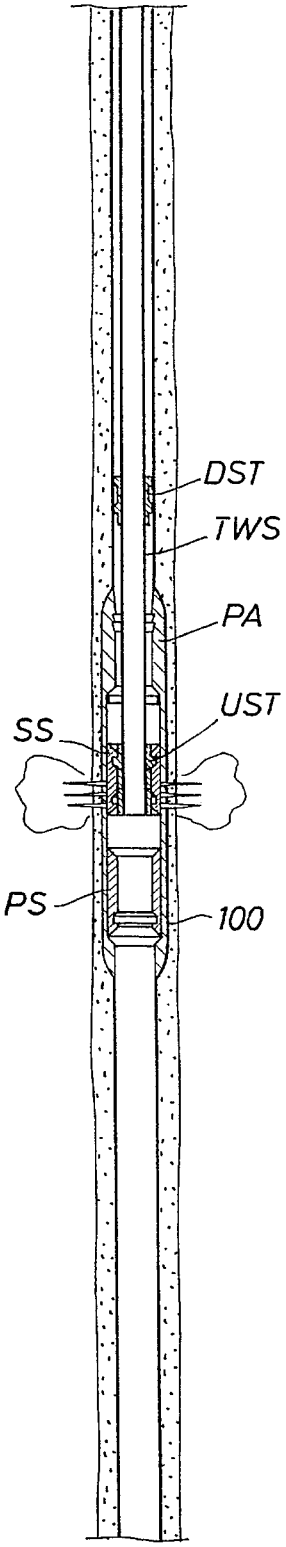
Figure 1O:
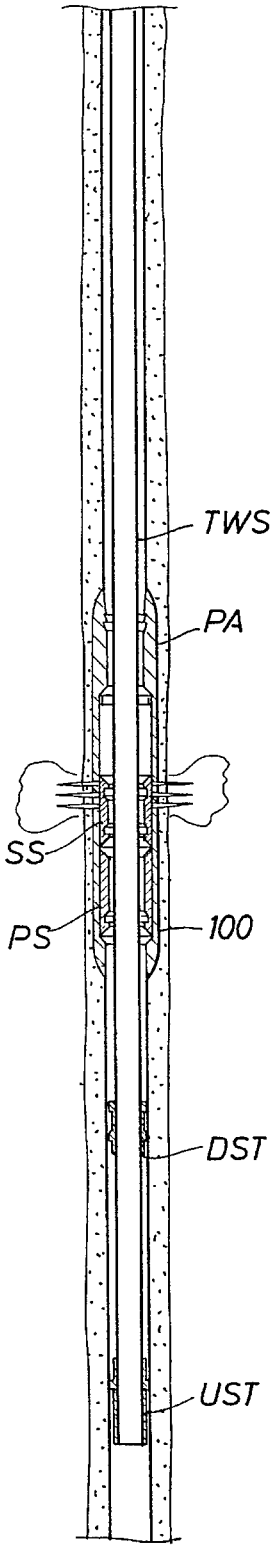
Figure 1P:
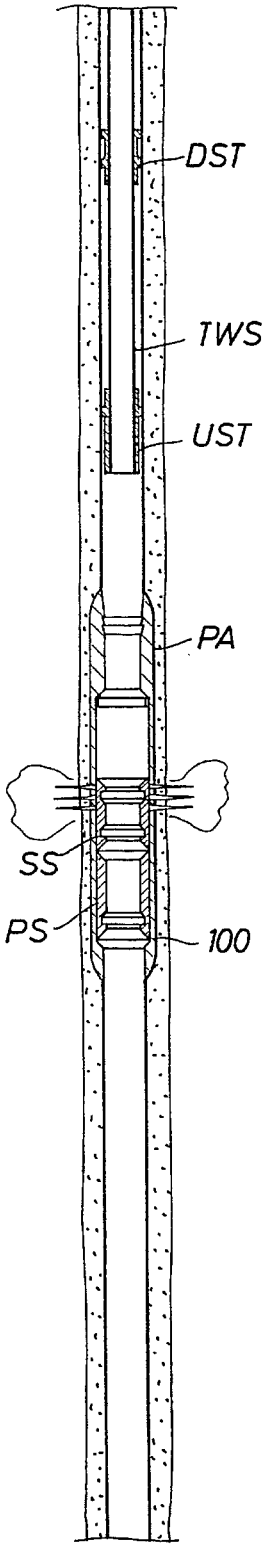
Figure 2A:
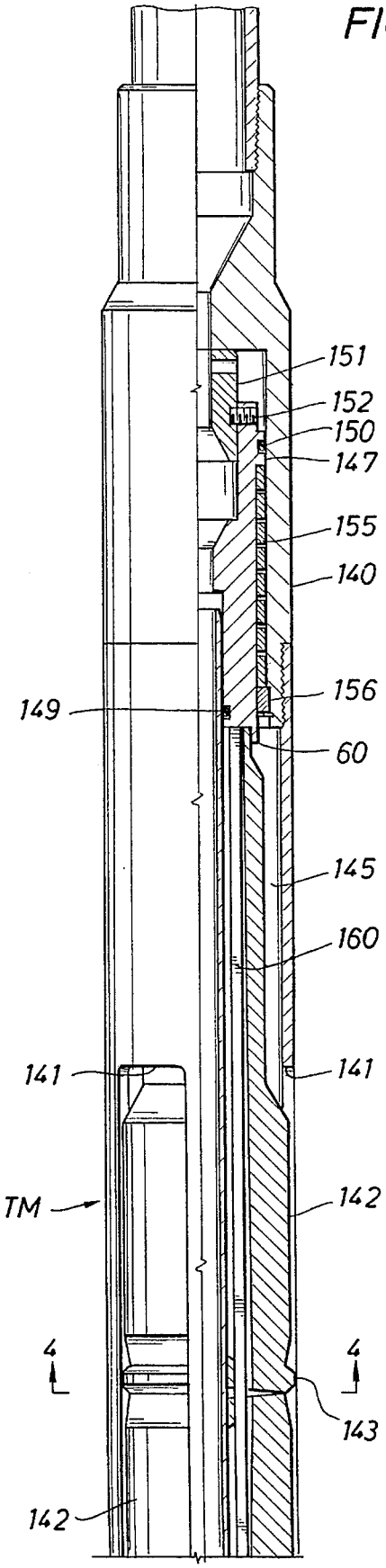
Figure 2B:
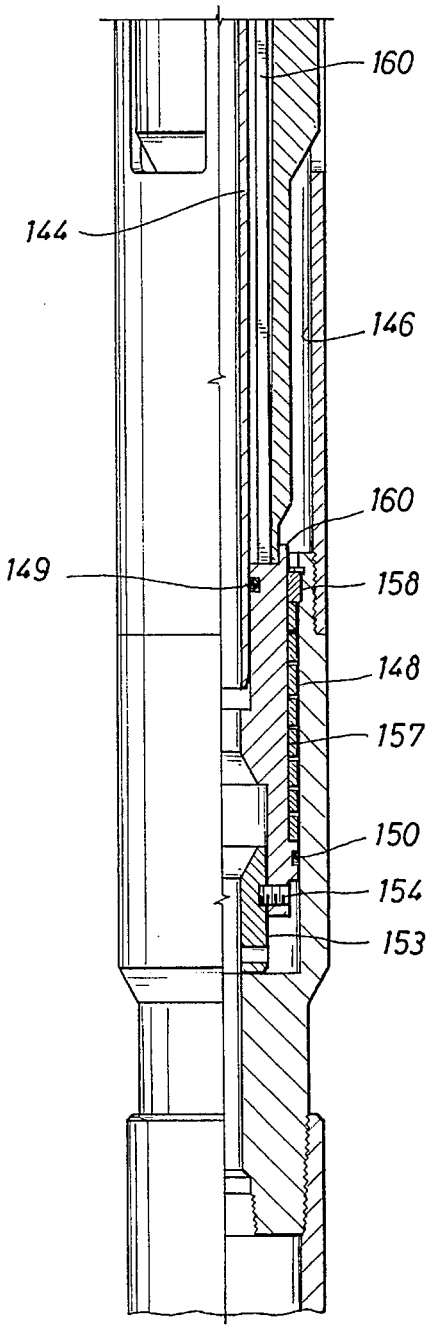
Figure 3:
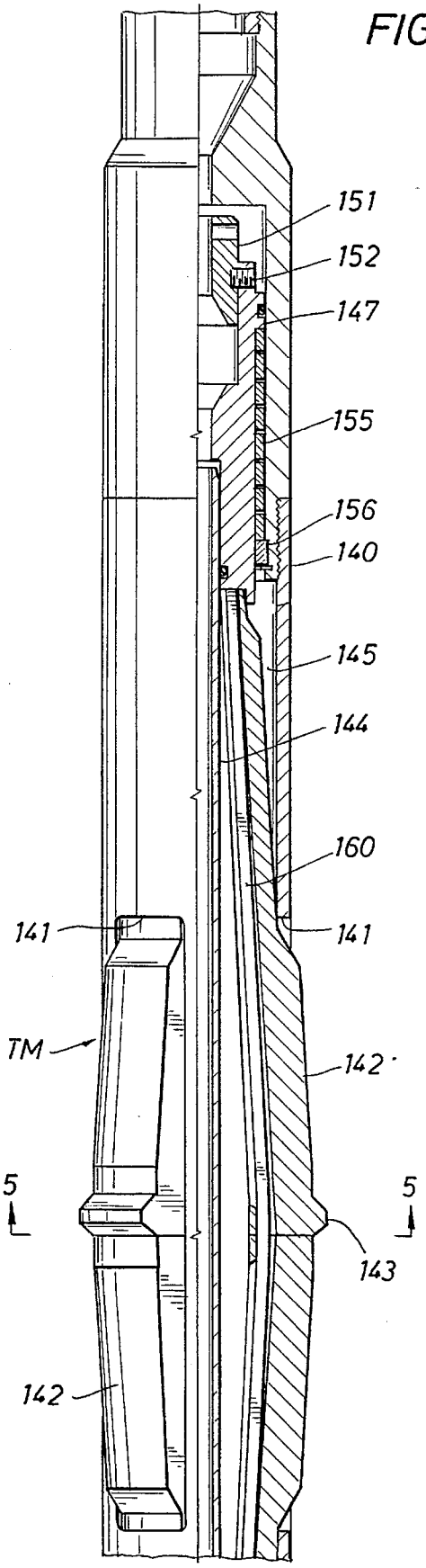
Figure 4:
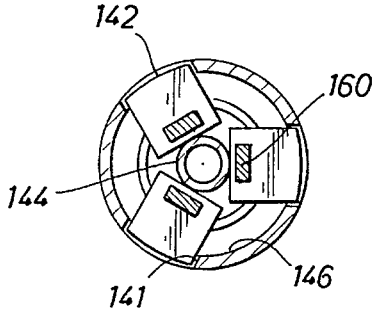
Figure 5:
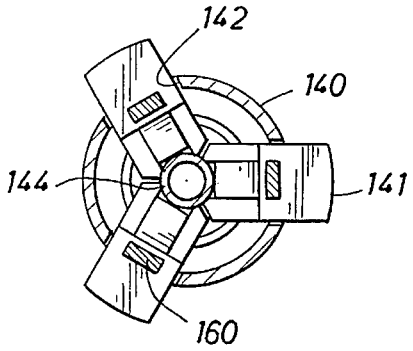
Figure 6A:
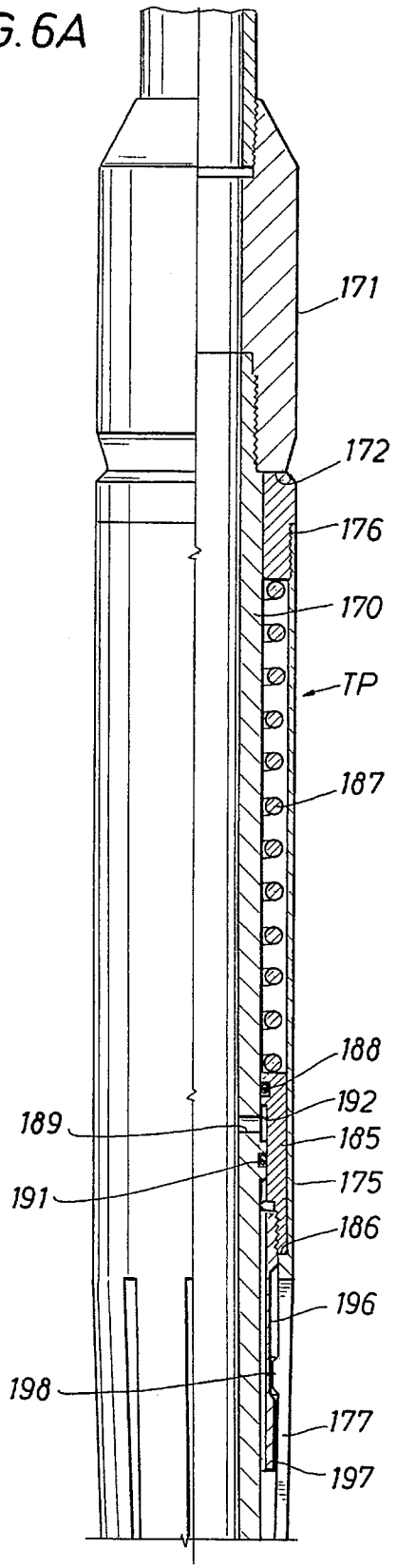
Figure 6B:
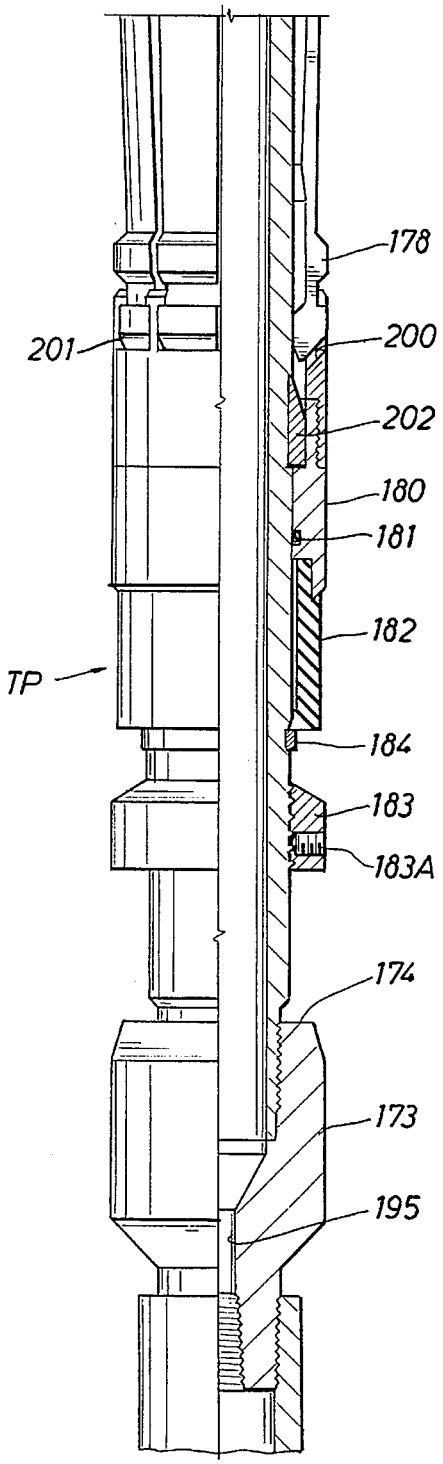
Figure 7:
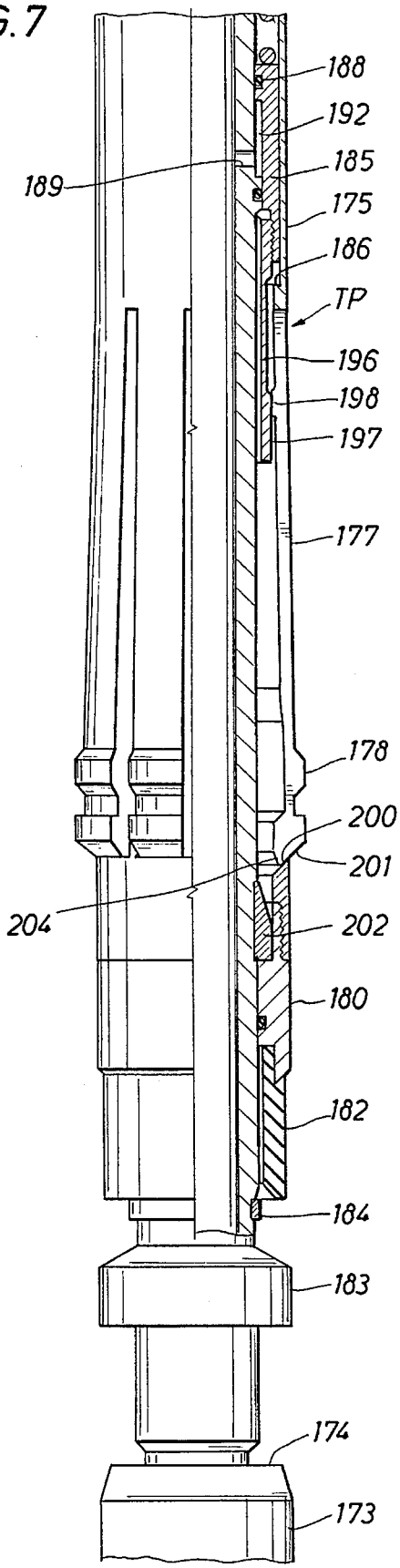
Figure 8:
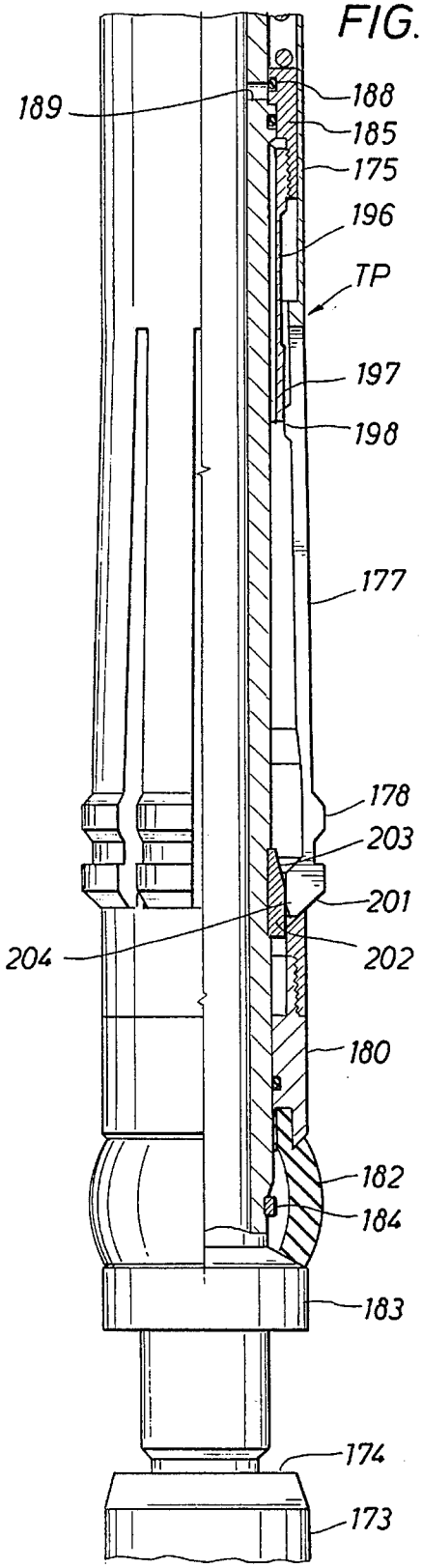
Figure 9:
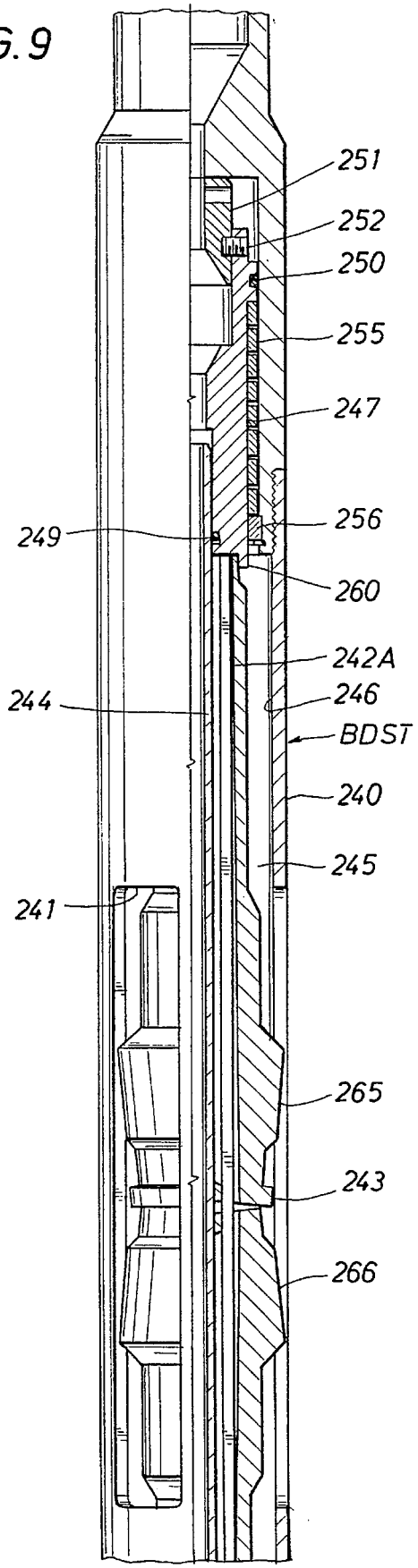
Figure 10:
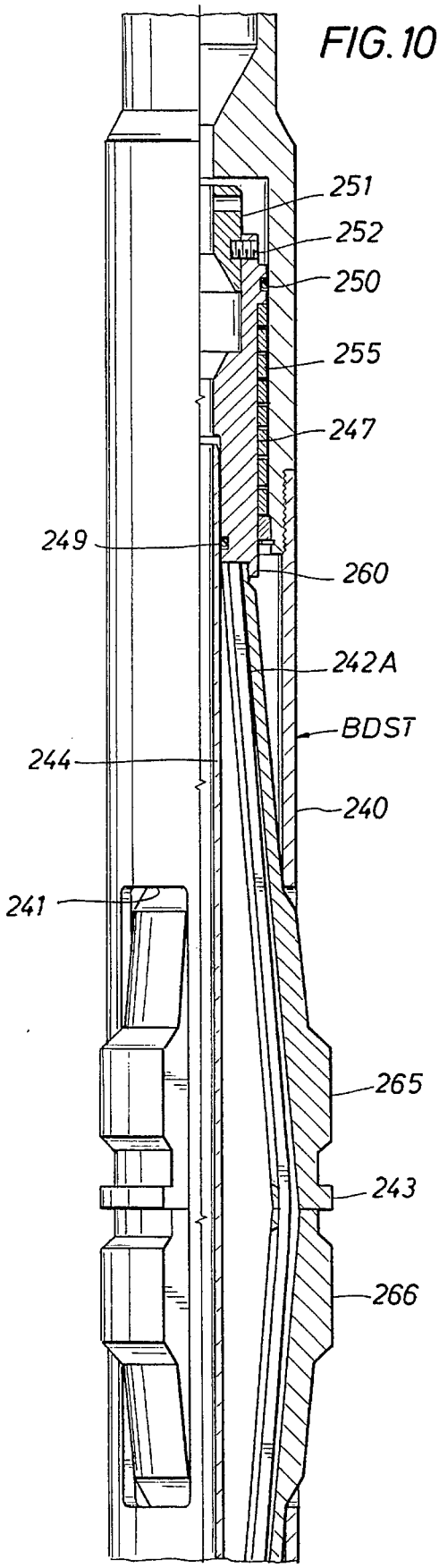
Figure 11A:
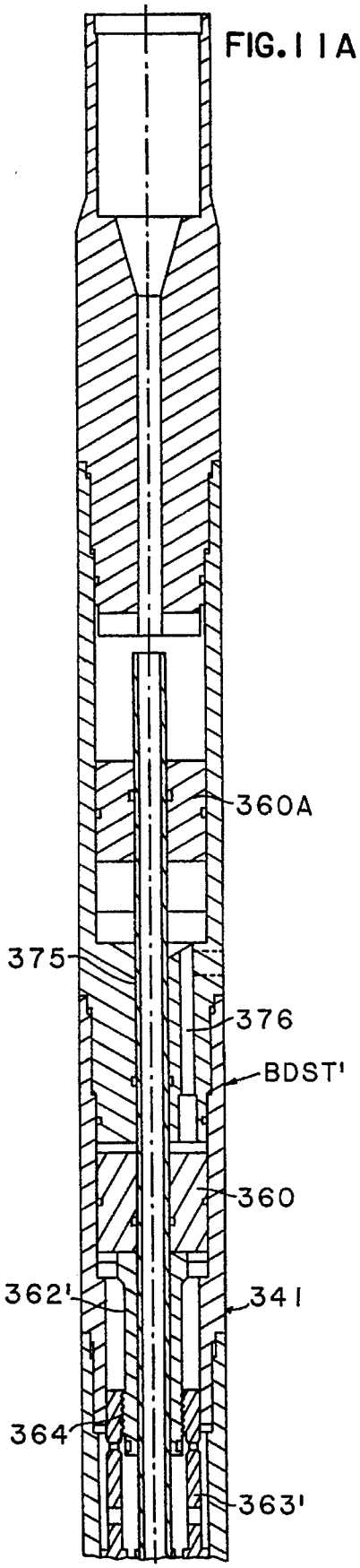
Figure 12A:
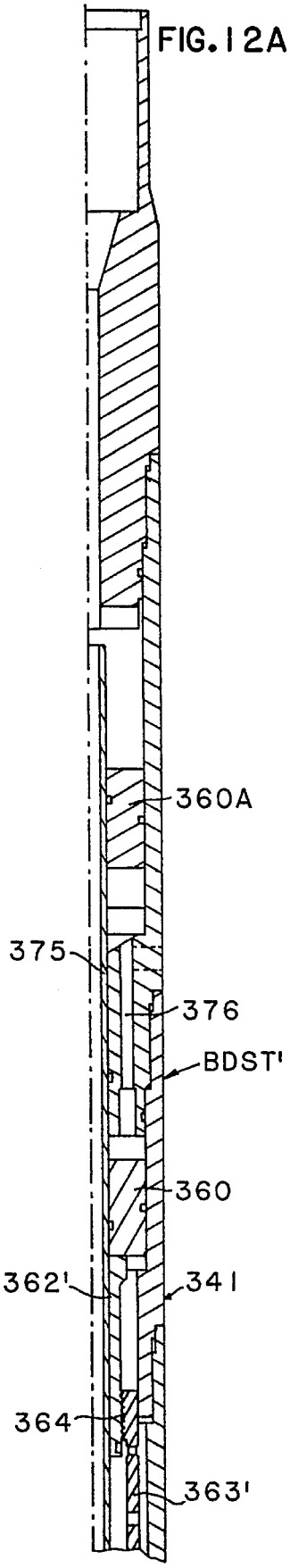
Figure 13A:
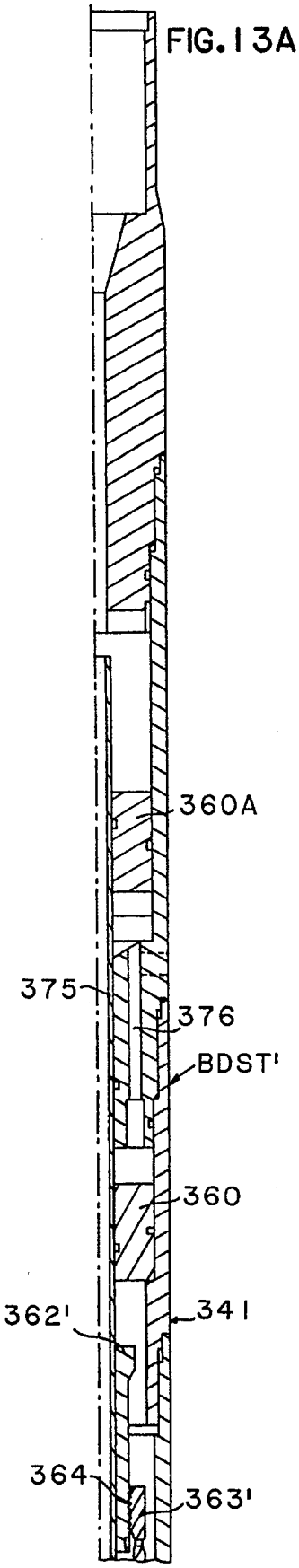
Figure 11B:
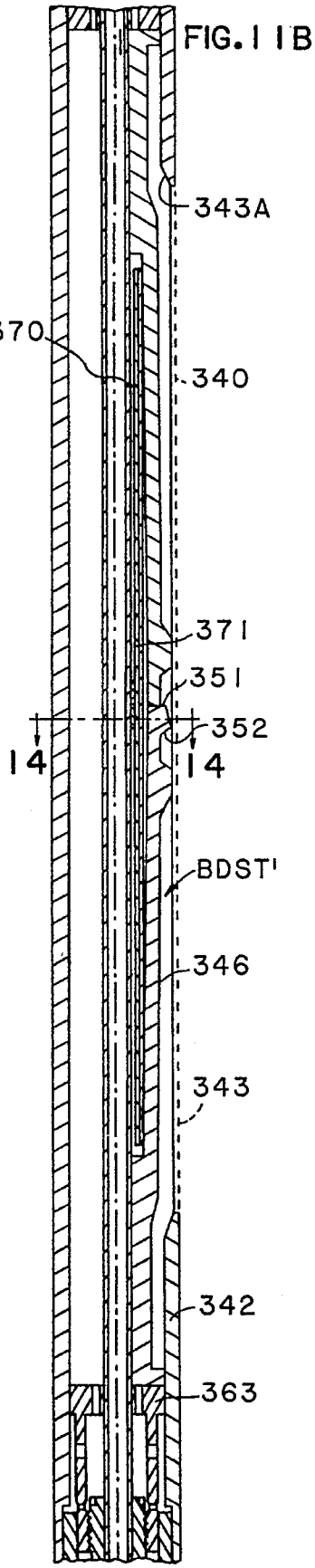
Figure 12B:
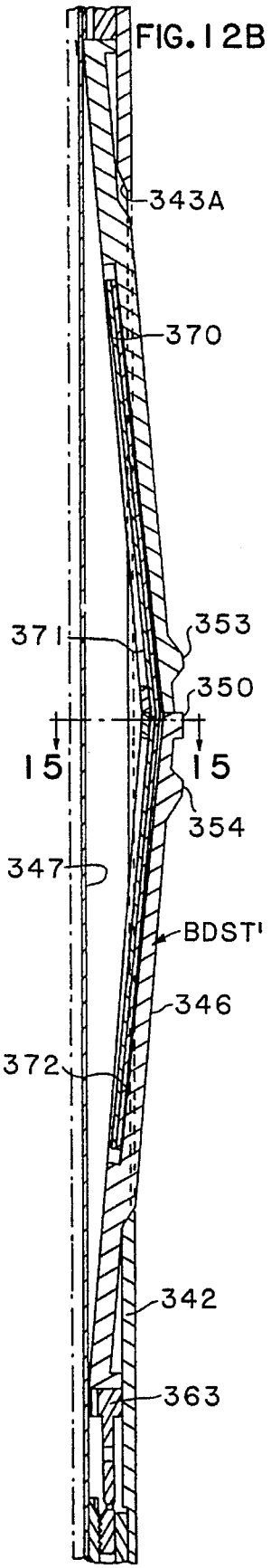
Figure 13B:
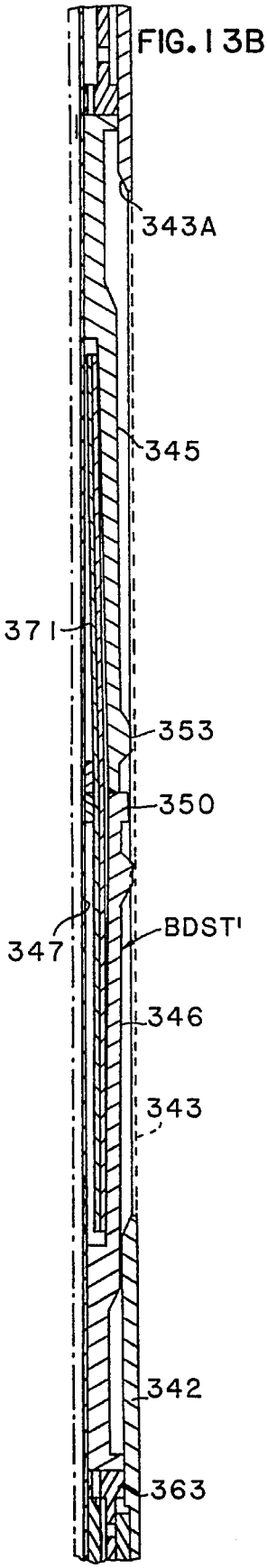
Figure 11C:
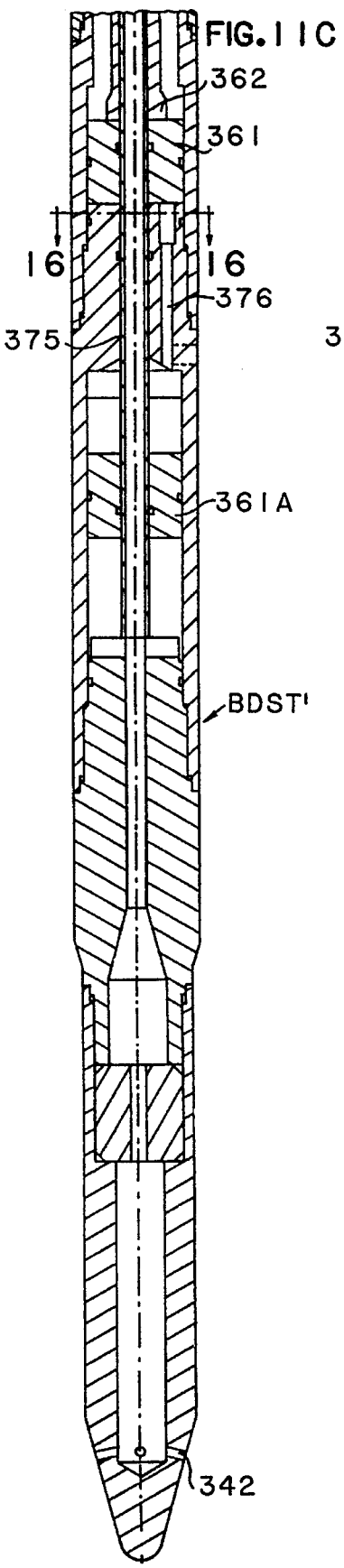
Figure 12C:
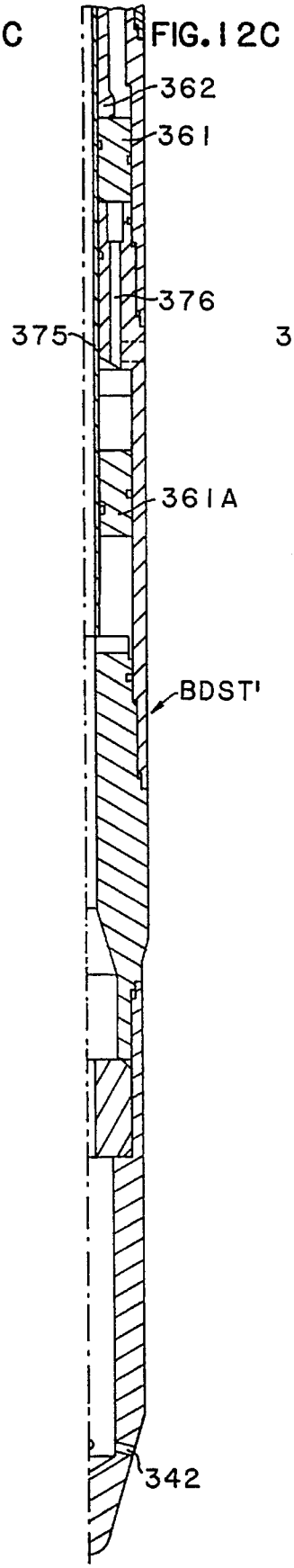
Figure 13C:
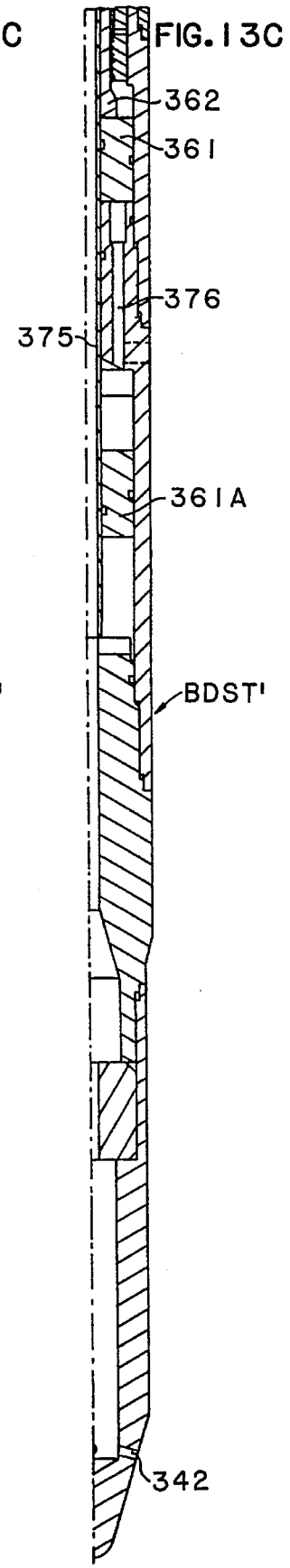
Figure 18A:
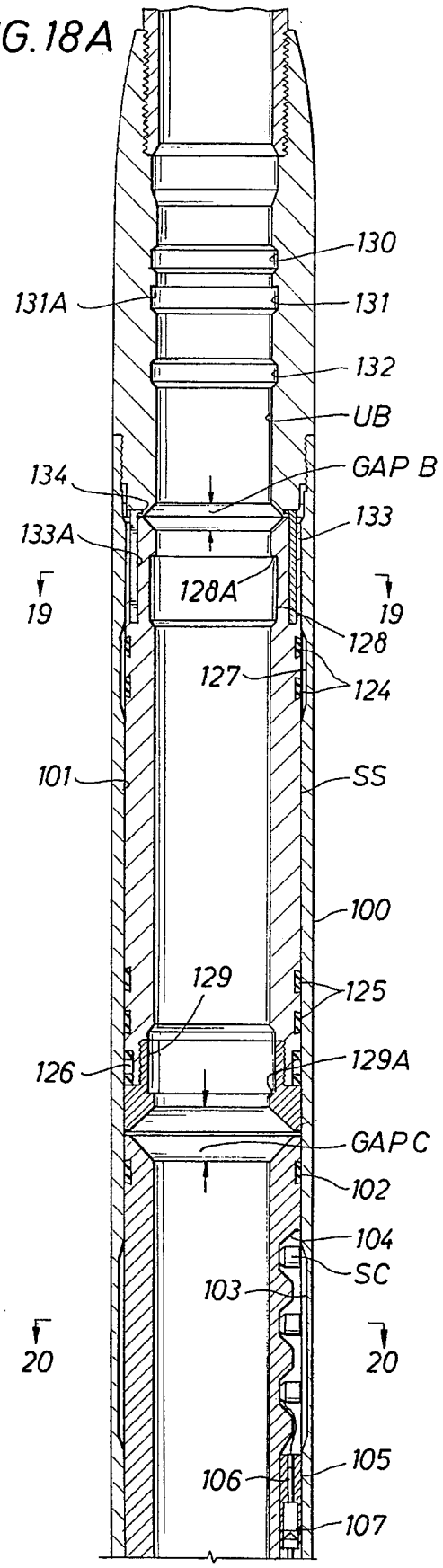
Figure 18B:
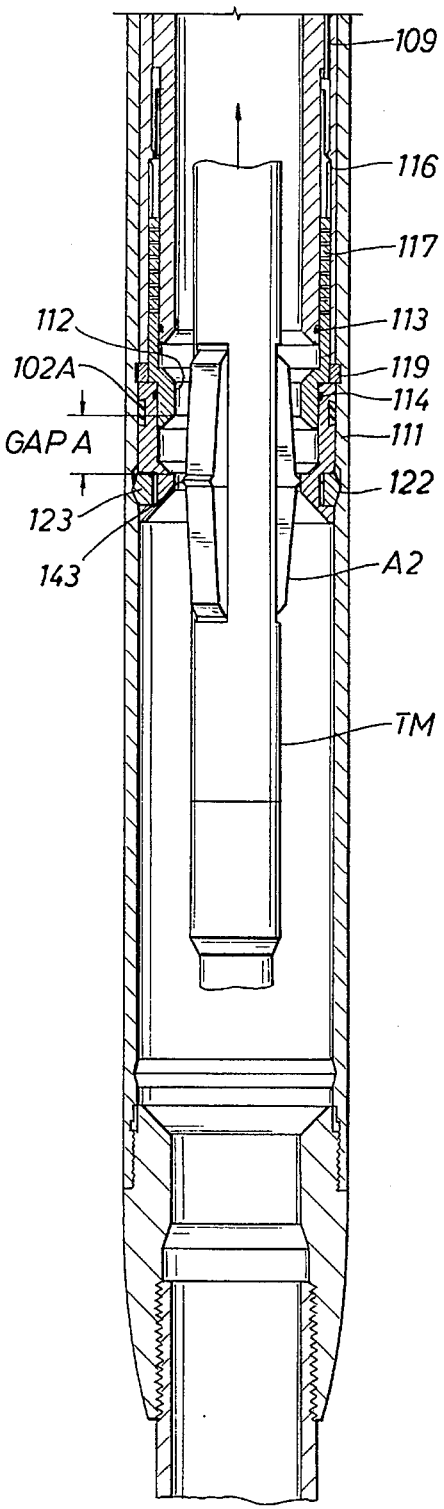
Figure 21:
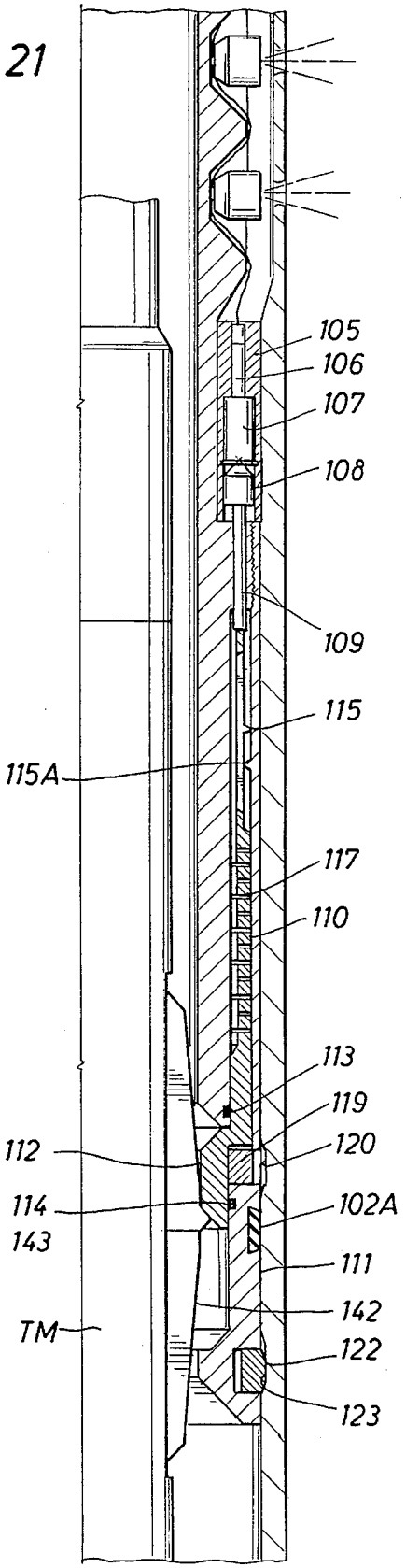
Figure 19:
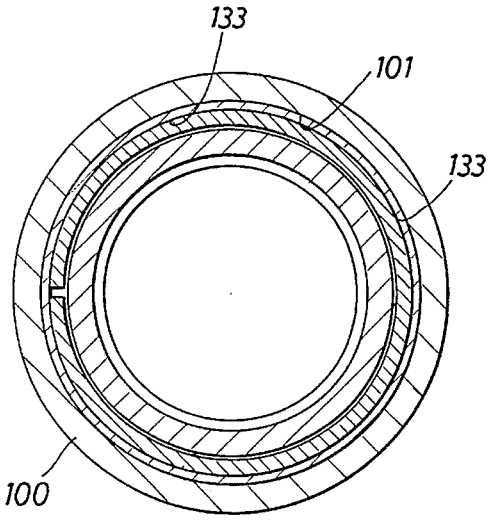
Figure 20:
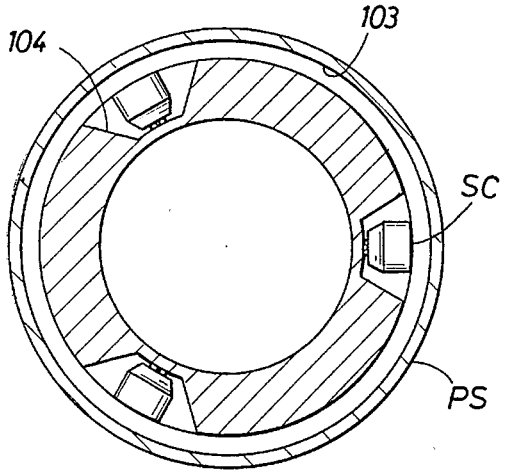
Figure 22:
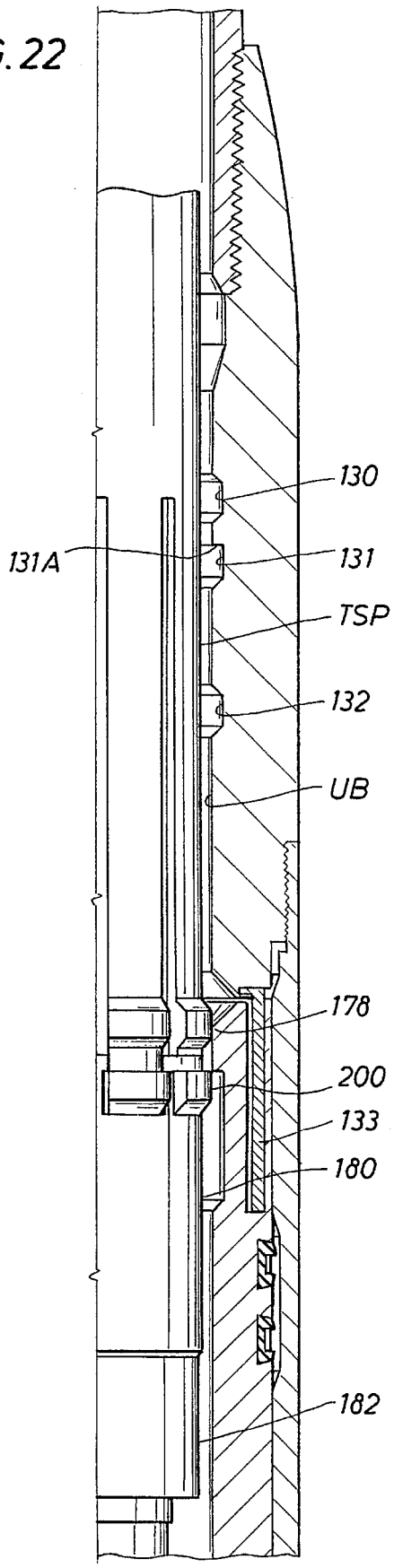
Figure 23:
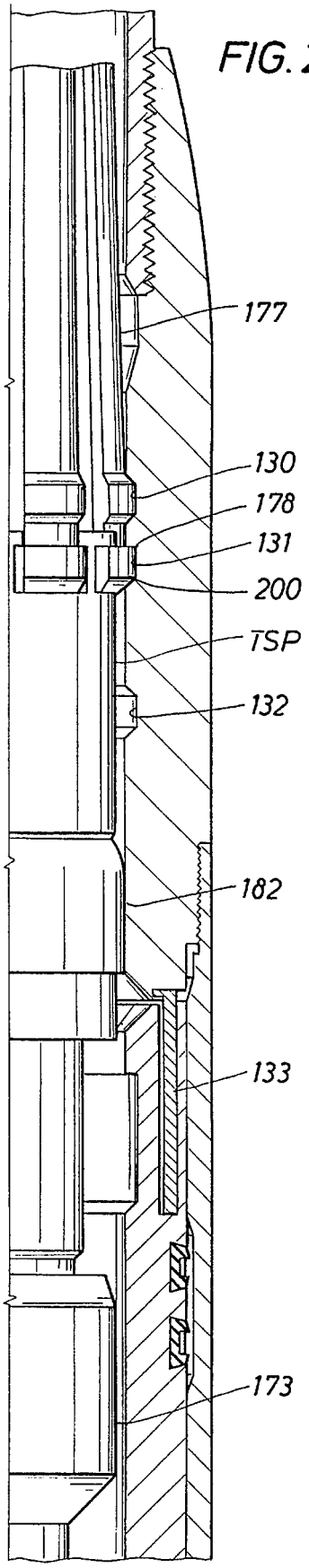
Figure 24A:
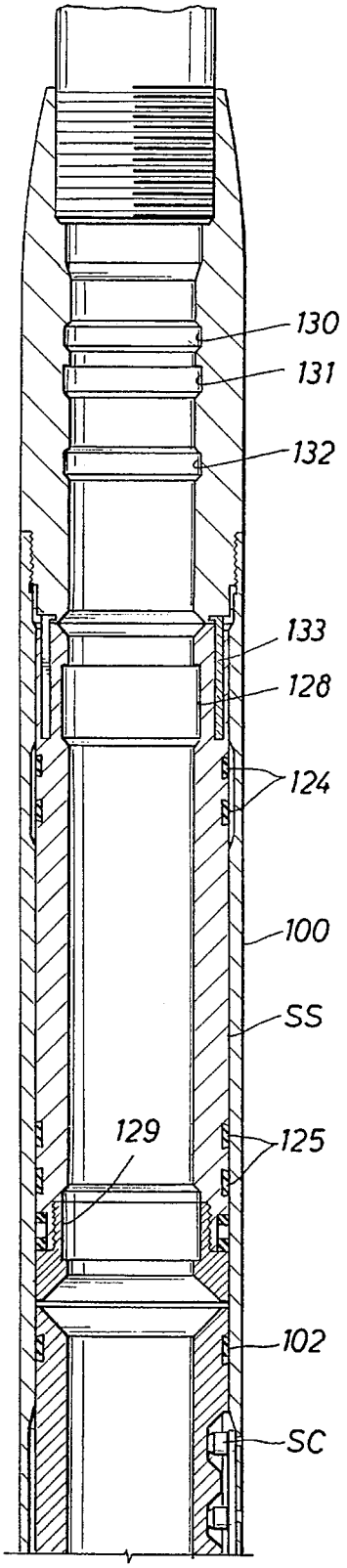
Figure 24B:
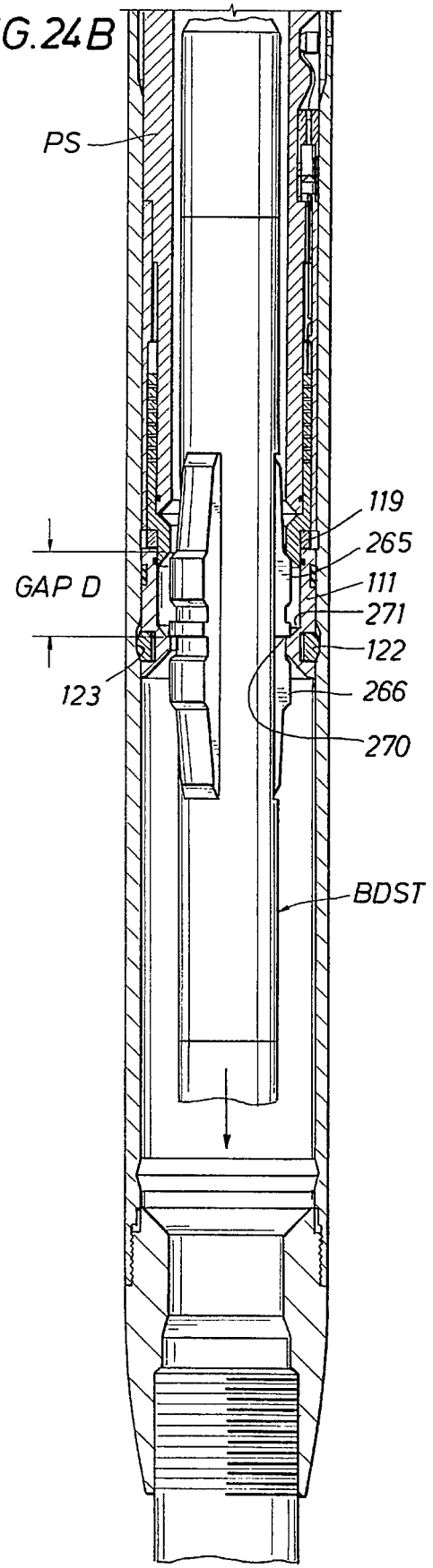
Figure 25A:
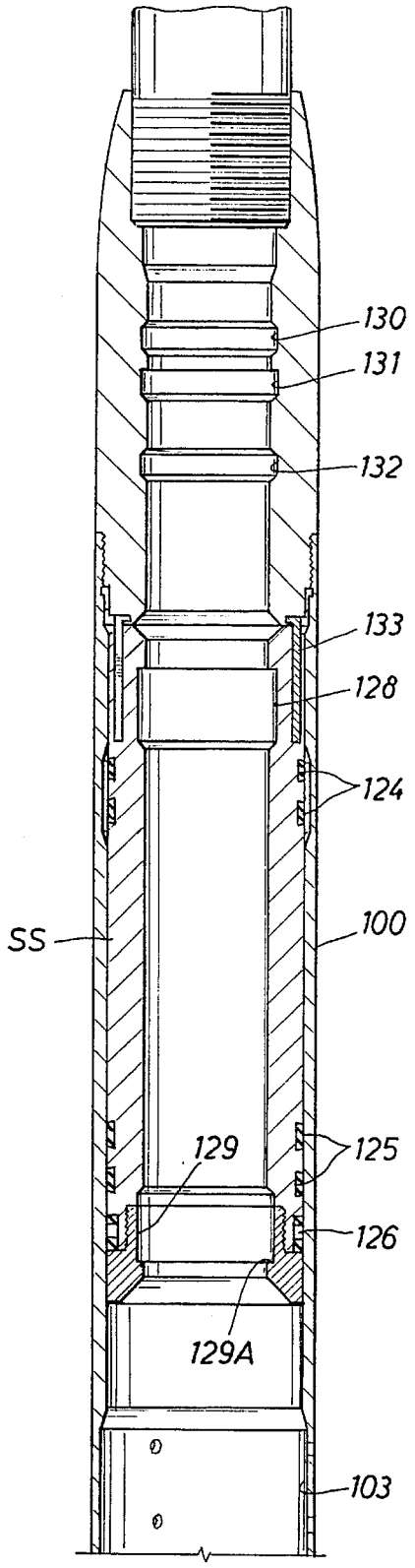
Figure 25B:
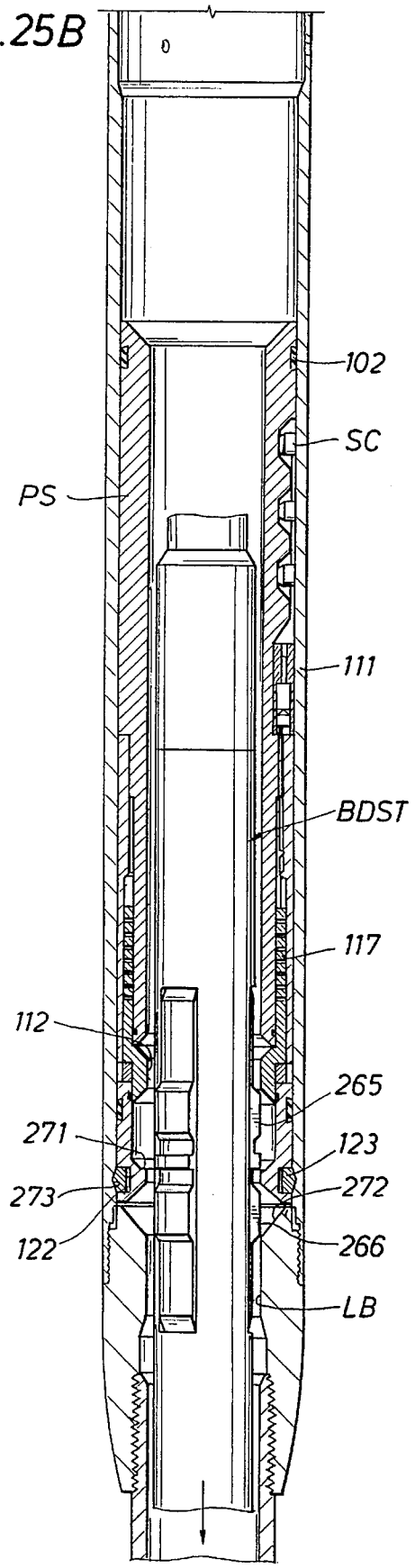
Figure 26:
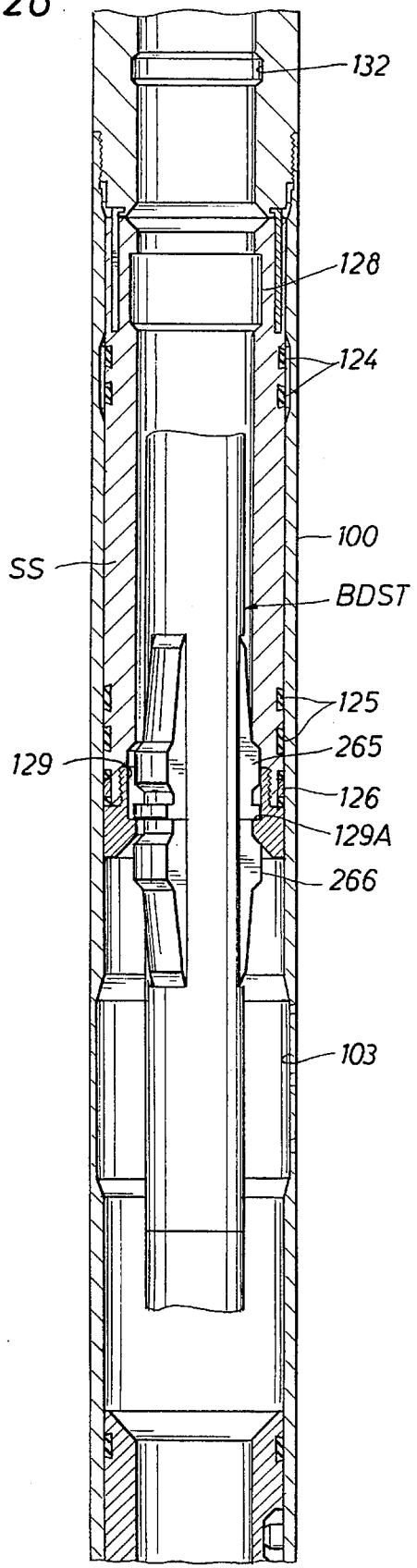
Figure 27:
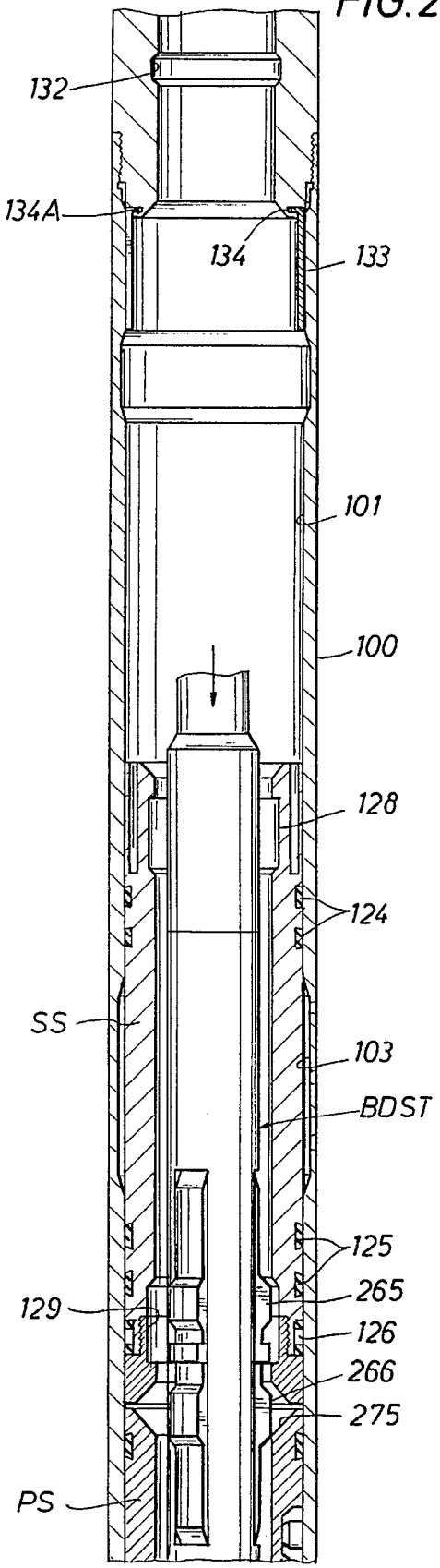
Figure 28:
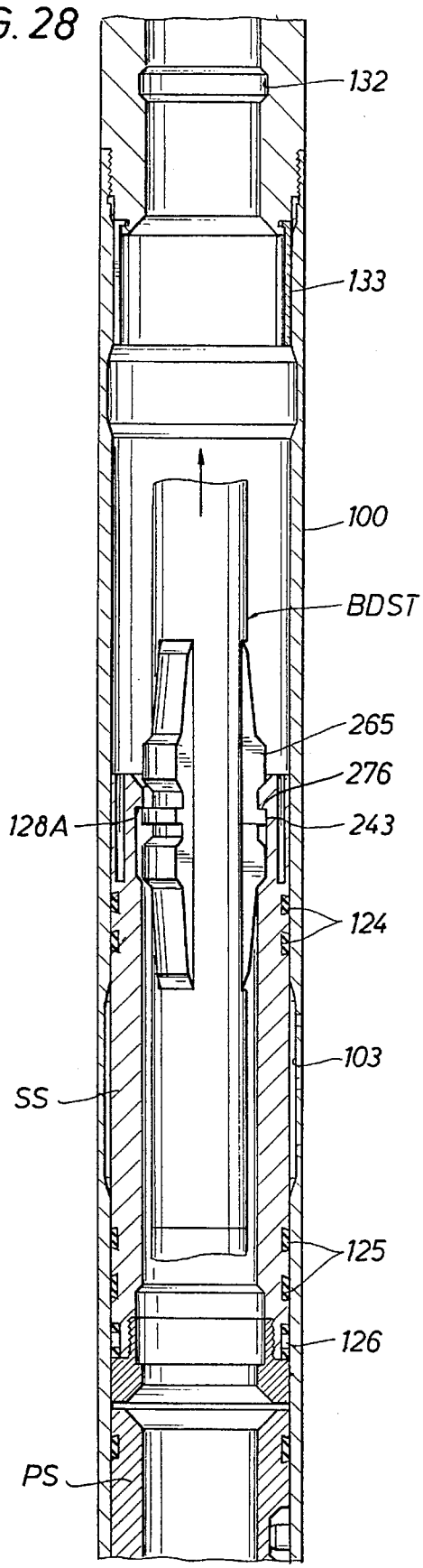
Figure 29:
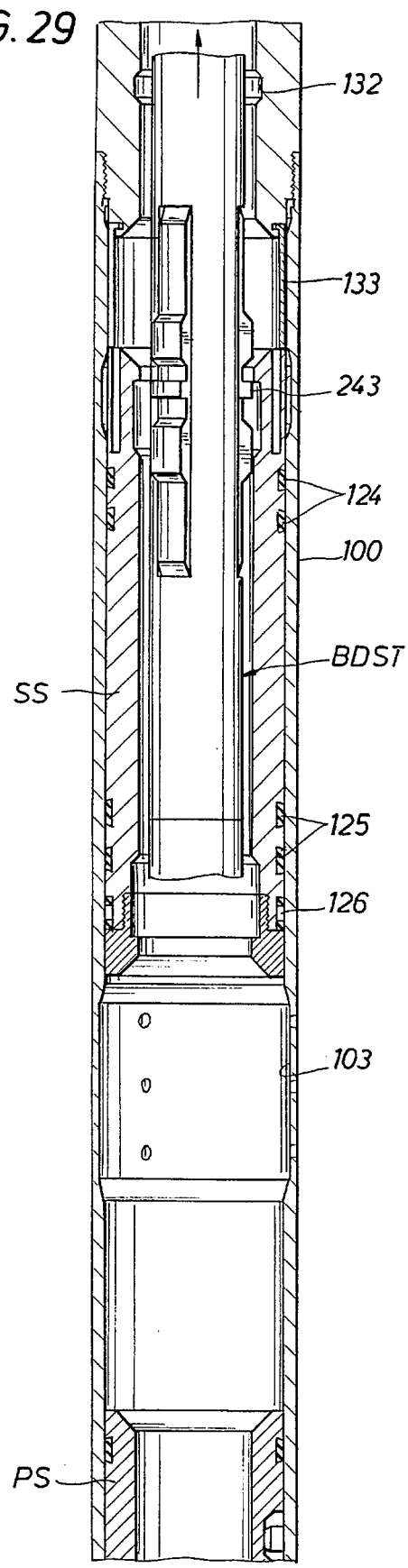
Figure 30A:
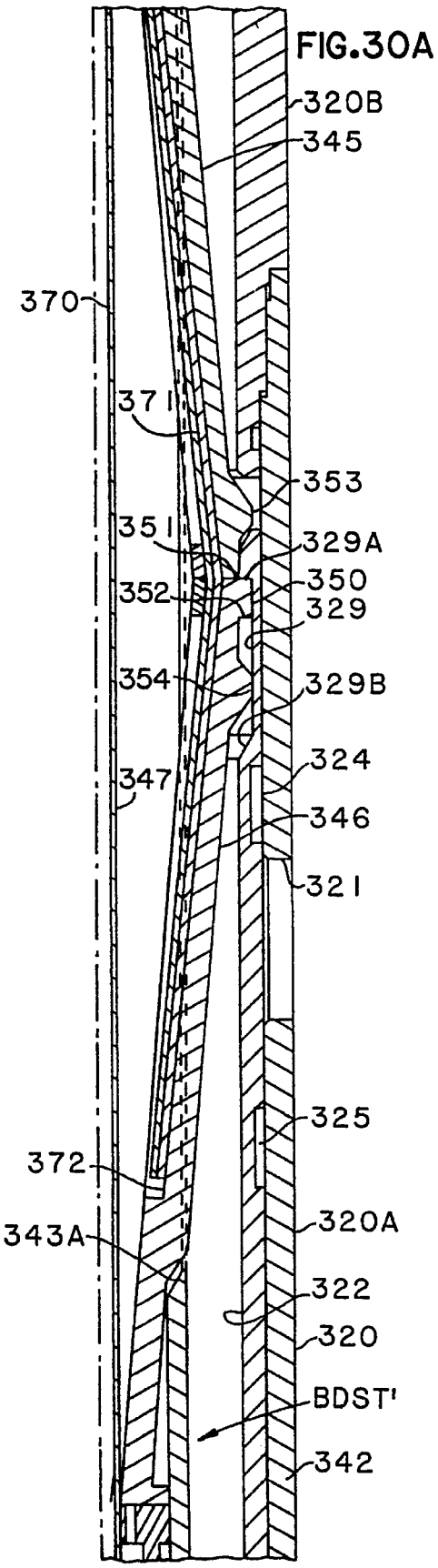
Figure 31A:
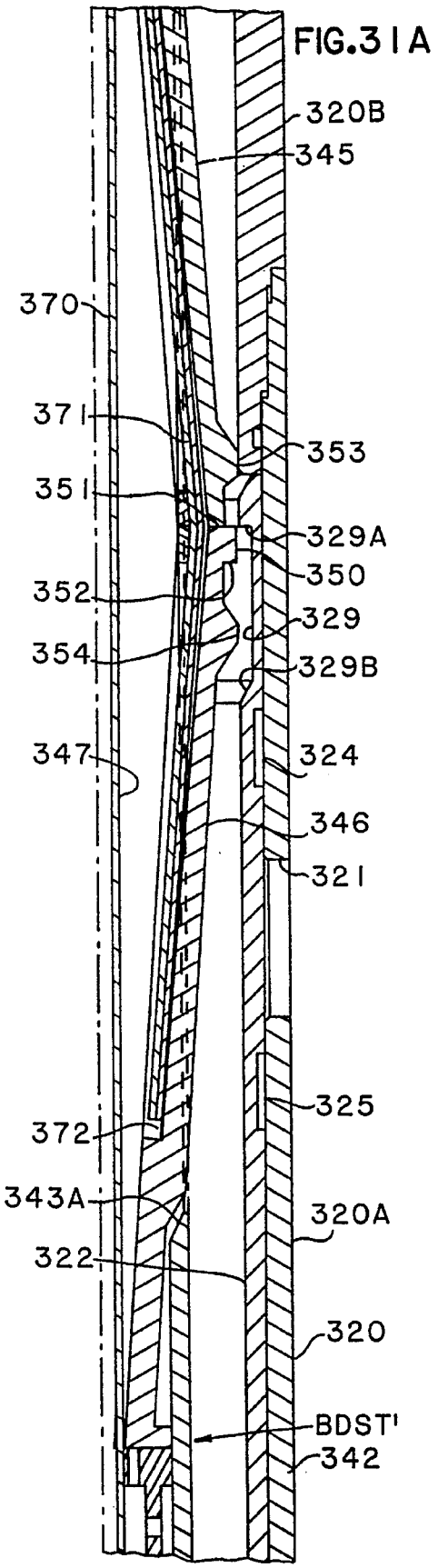
Figure 30B:
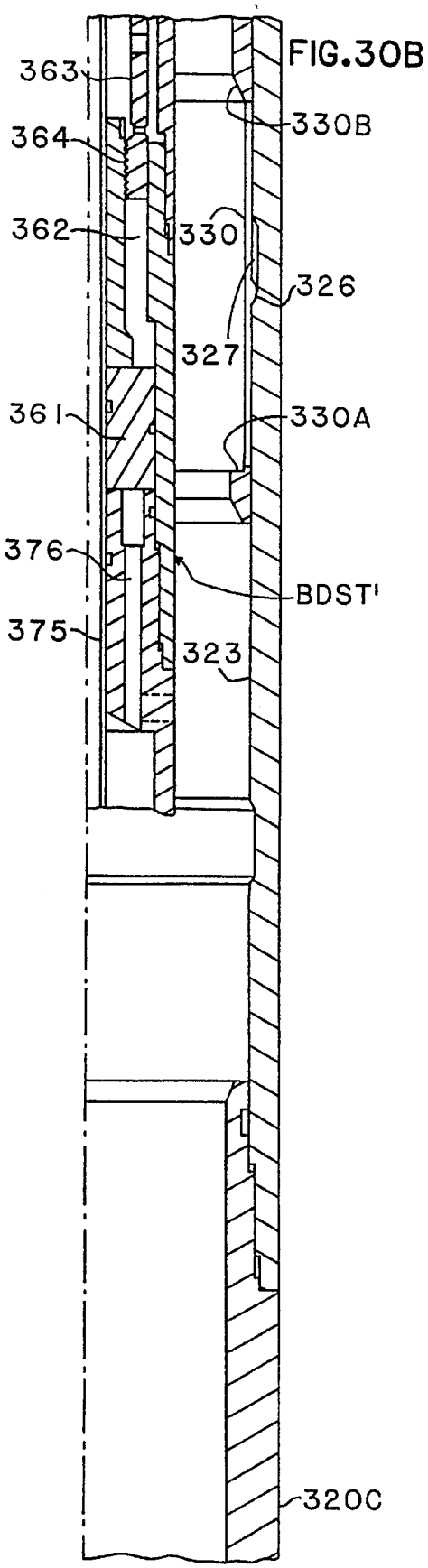
Figure 31B:
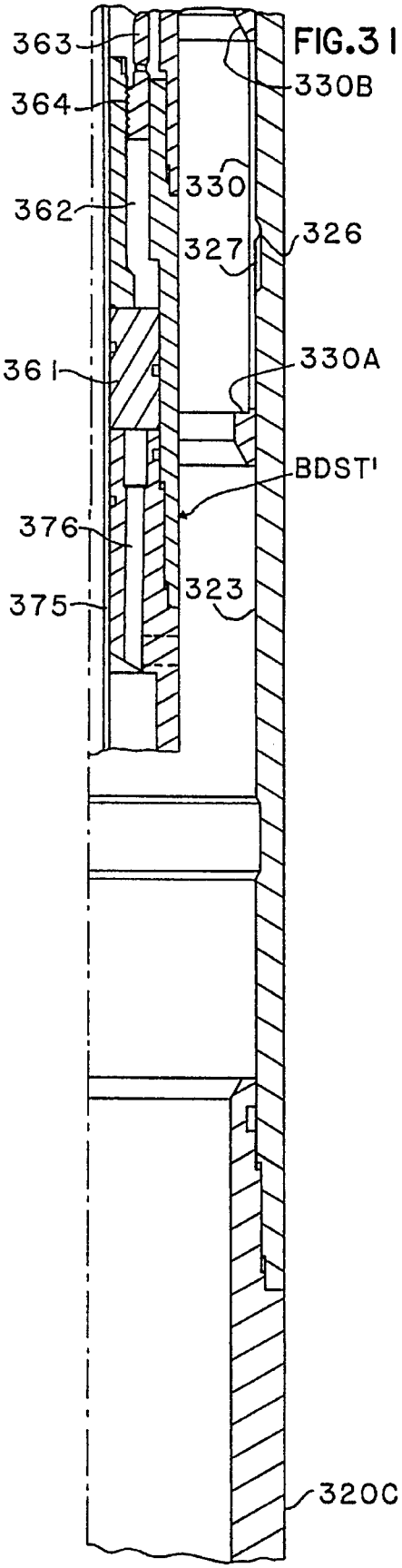
Figure 32A:
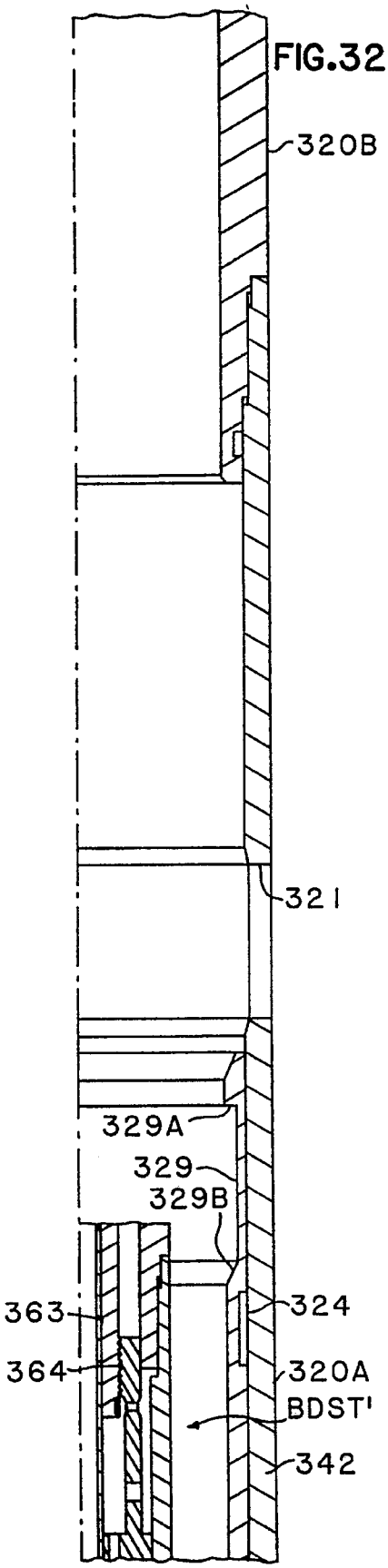
Figure 33A:
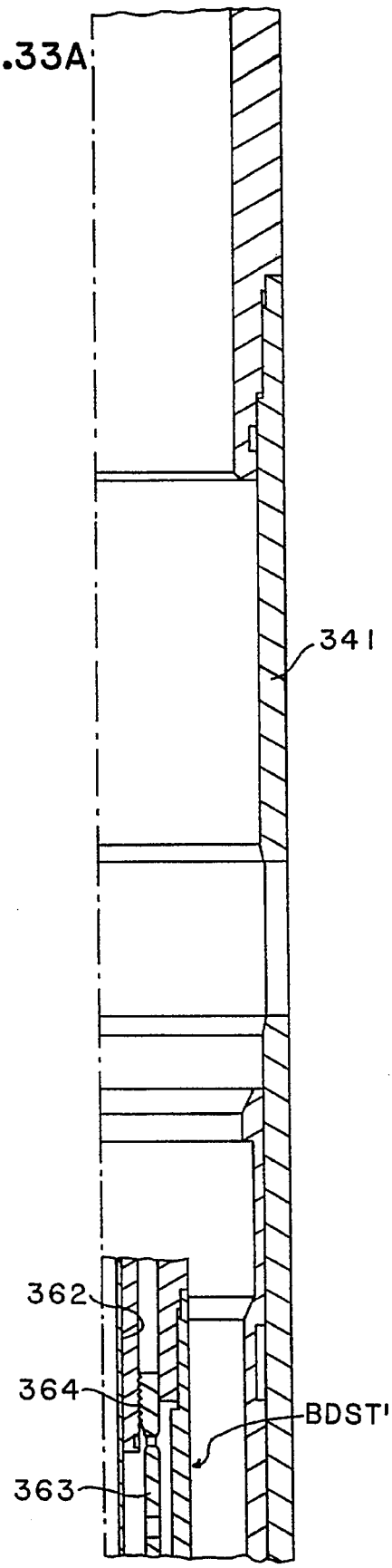
Figure 32B:
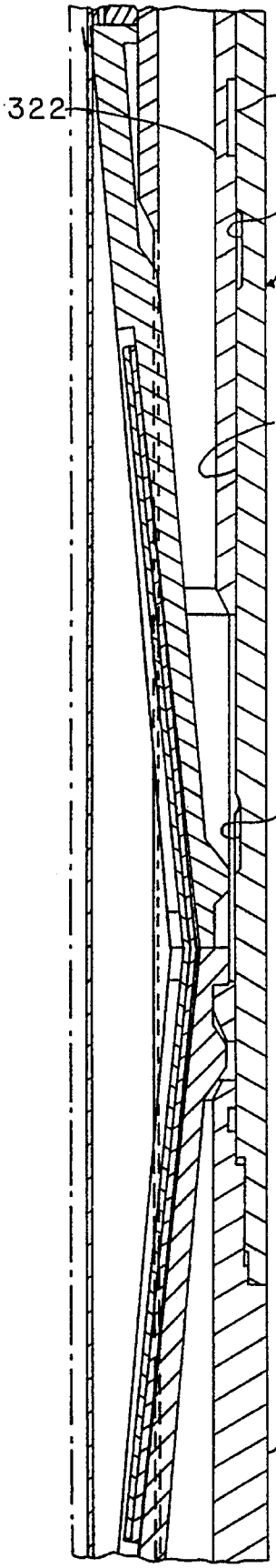
Figure 33B:
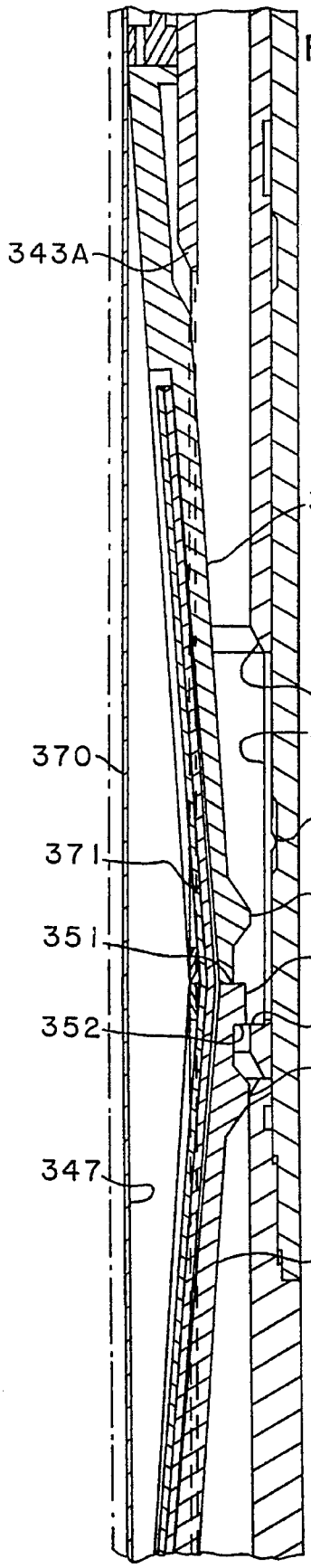
Figure 34A:
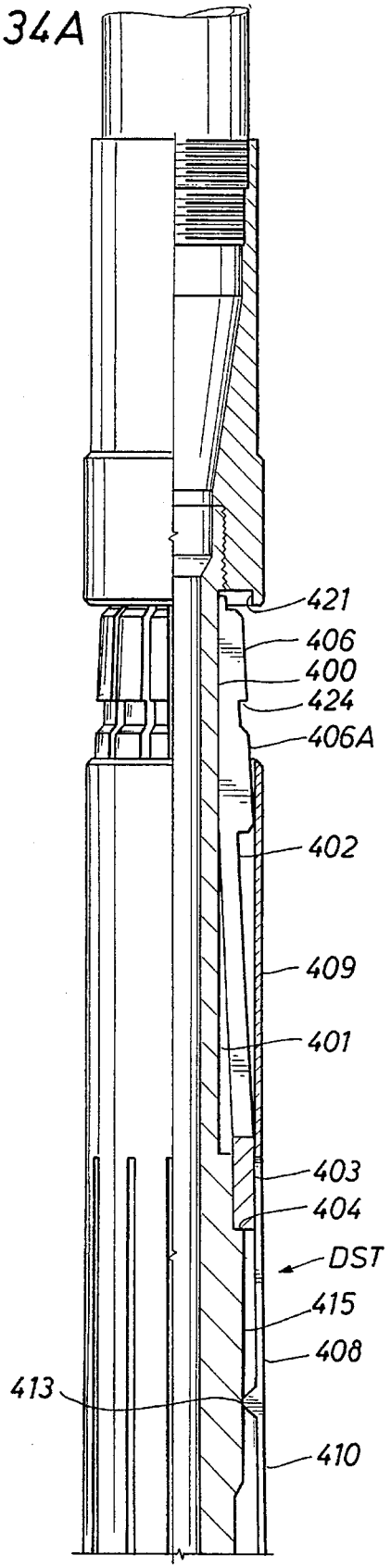
Figure 34B:
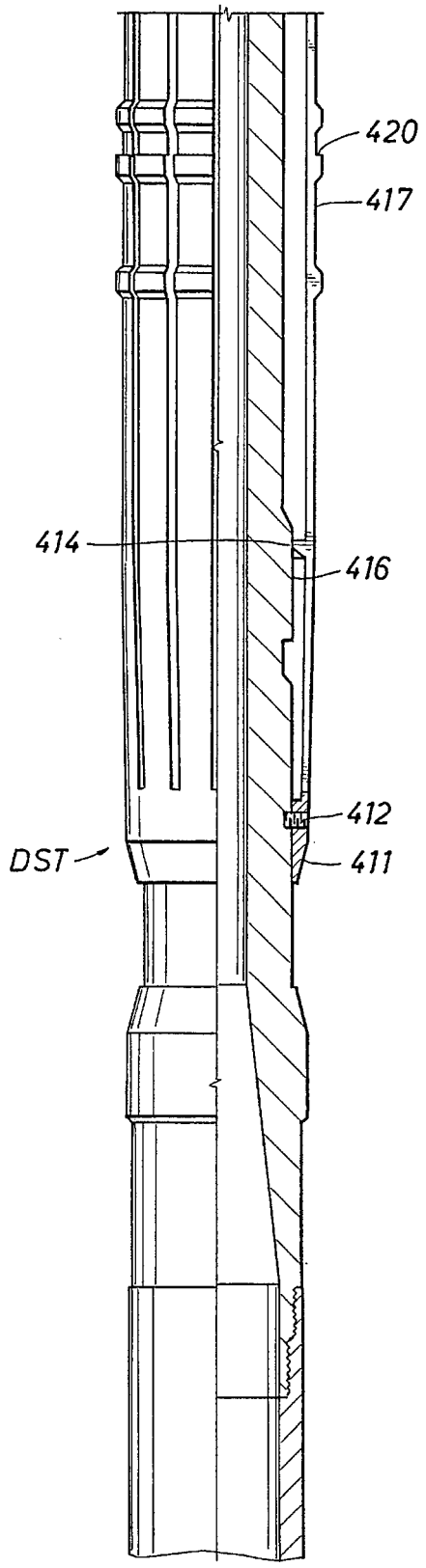
Figure 35A:
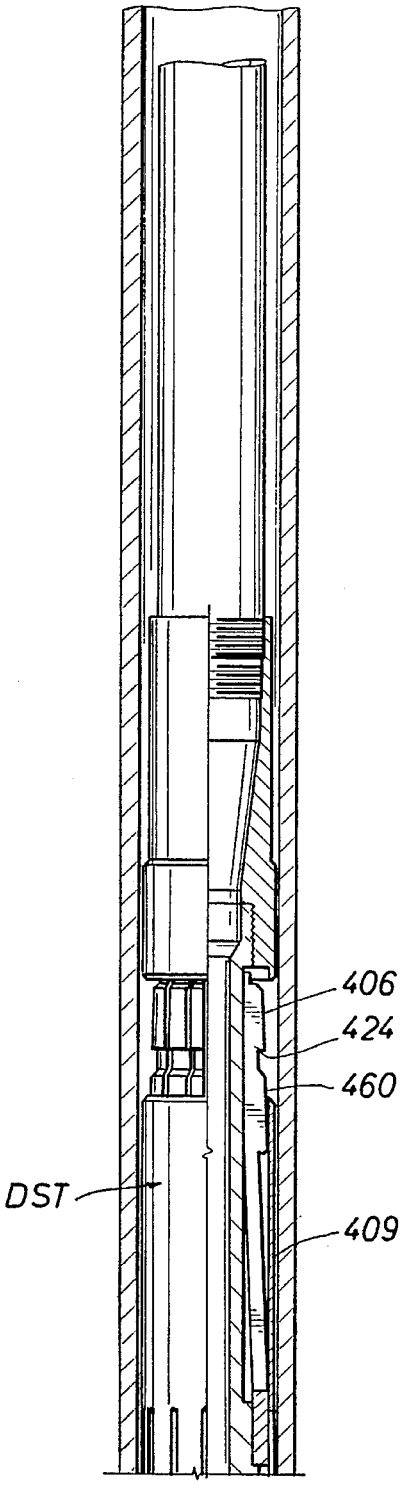
Figure 35B:
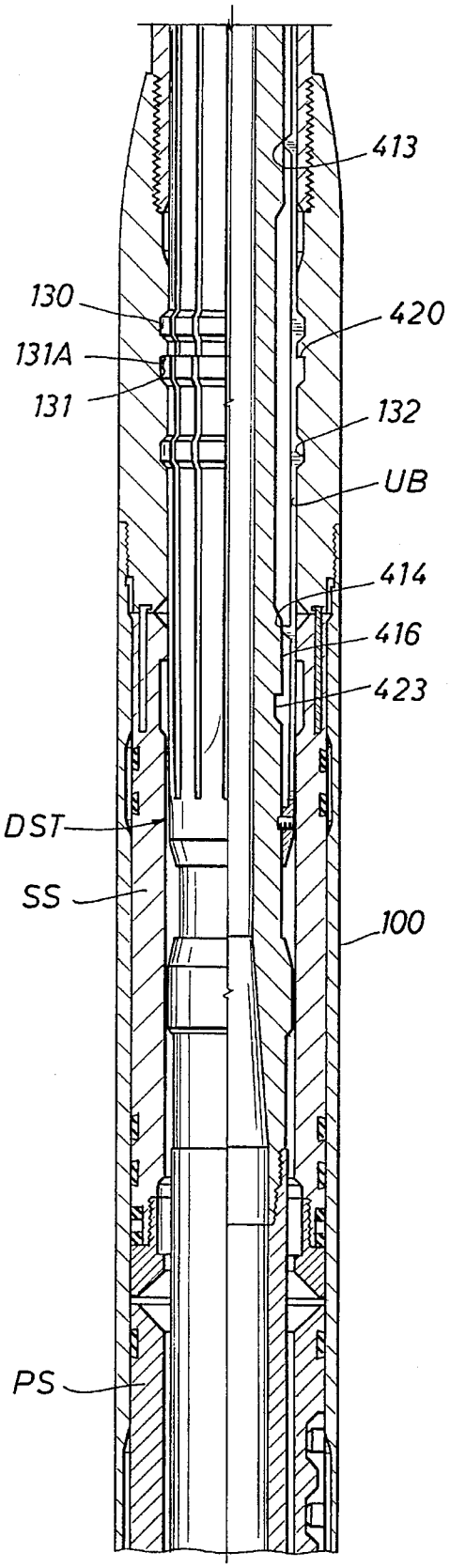
Figure 36A:
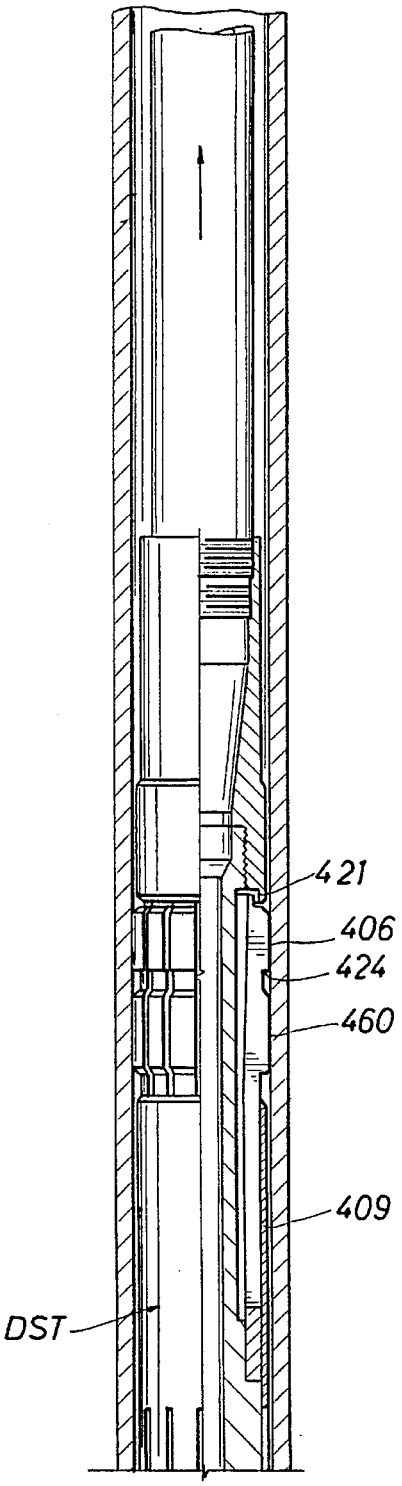
Figure 36B:
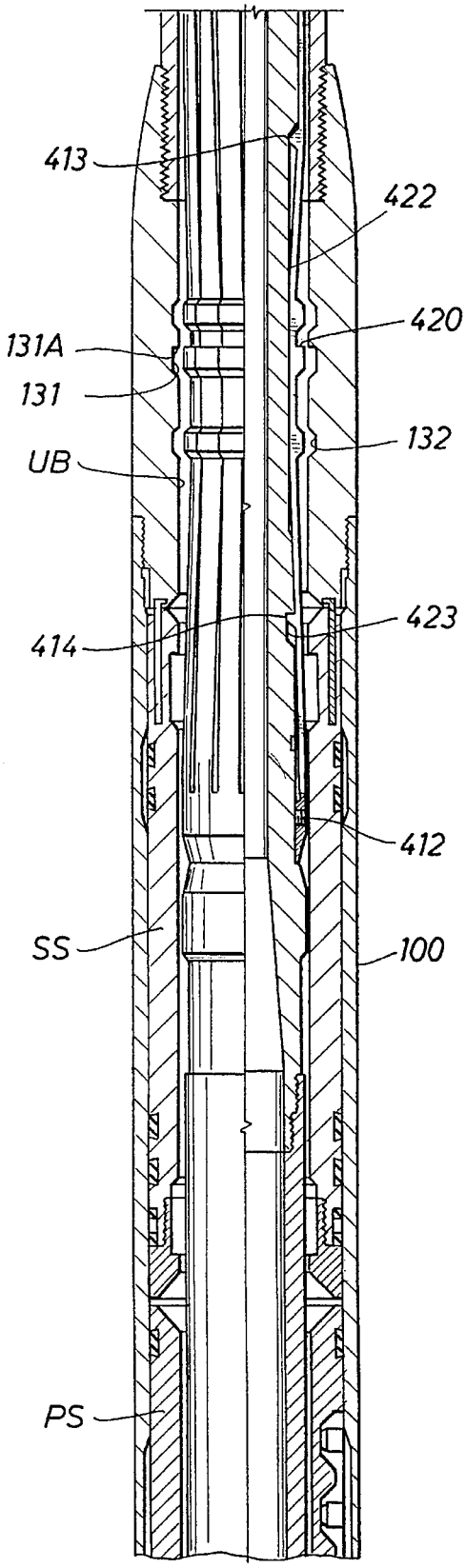
Figure 37A:
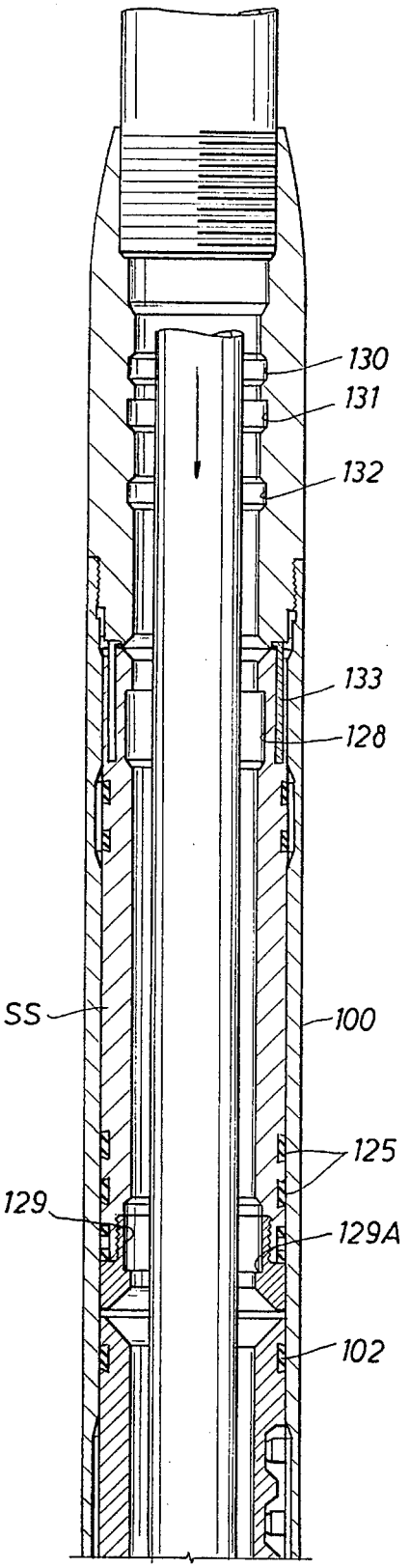
Figure 37B:
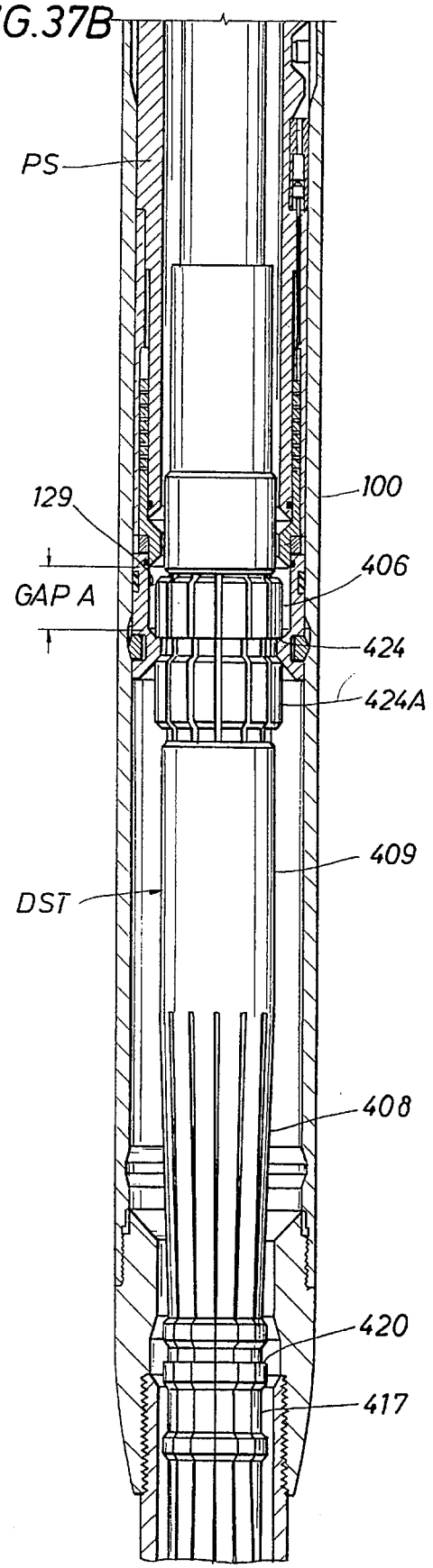
Figure 38A:
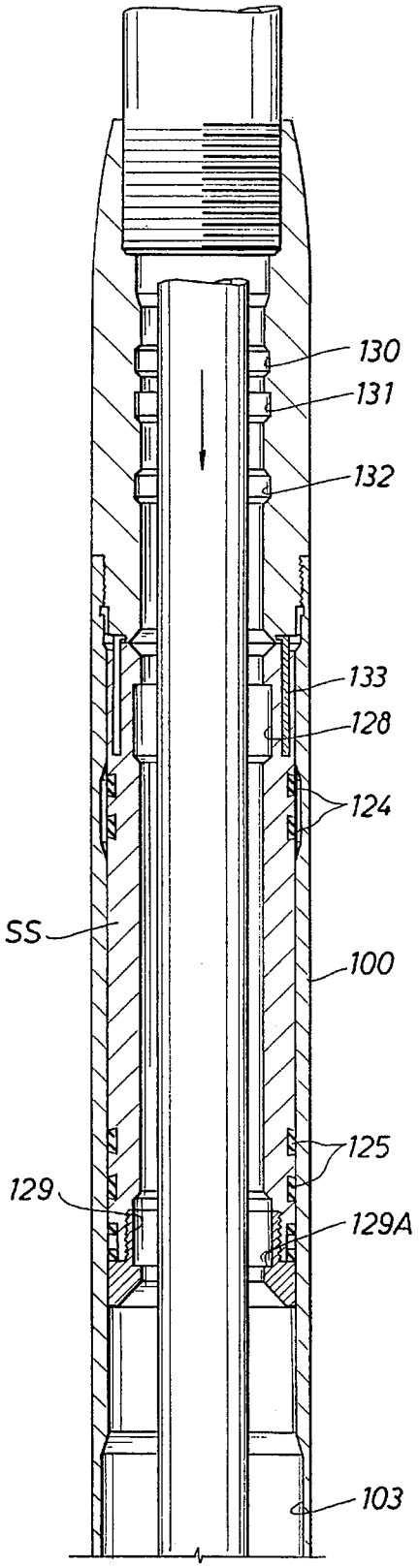
Figure 38B:
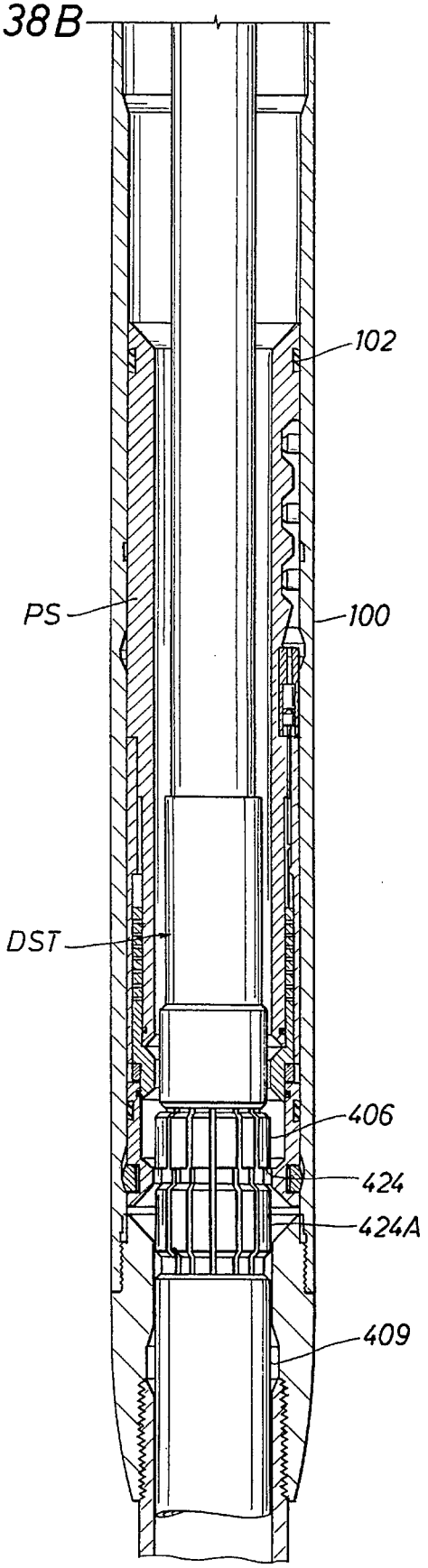
Figure 39A:
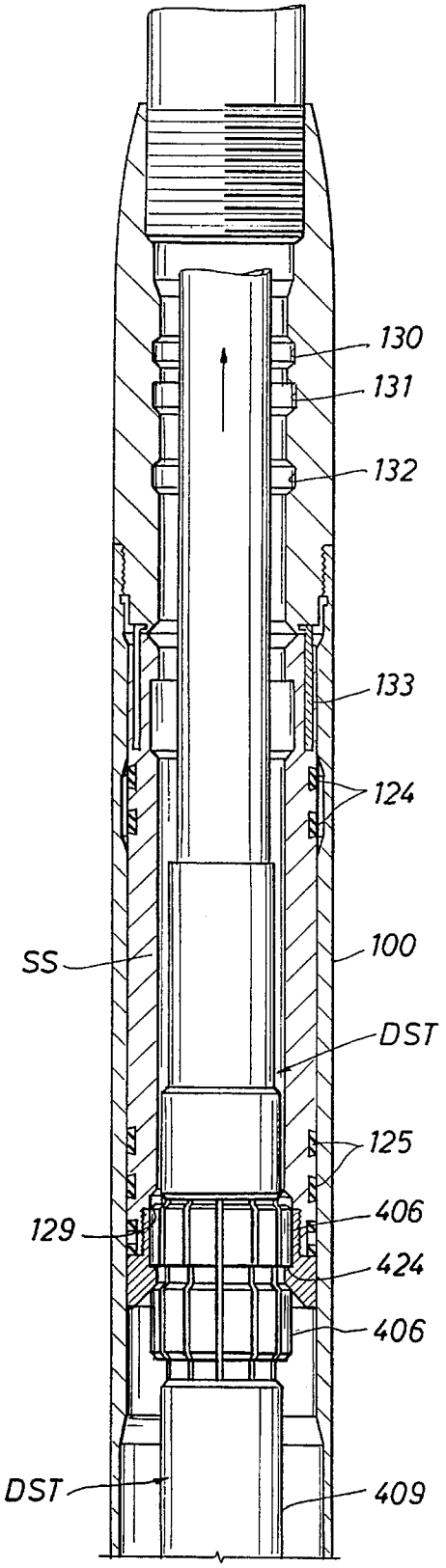
Figure 39B:
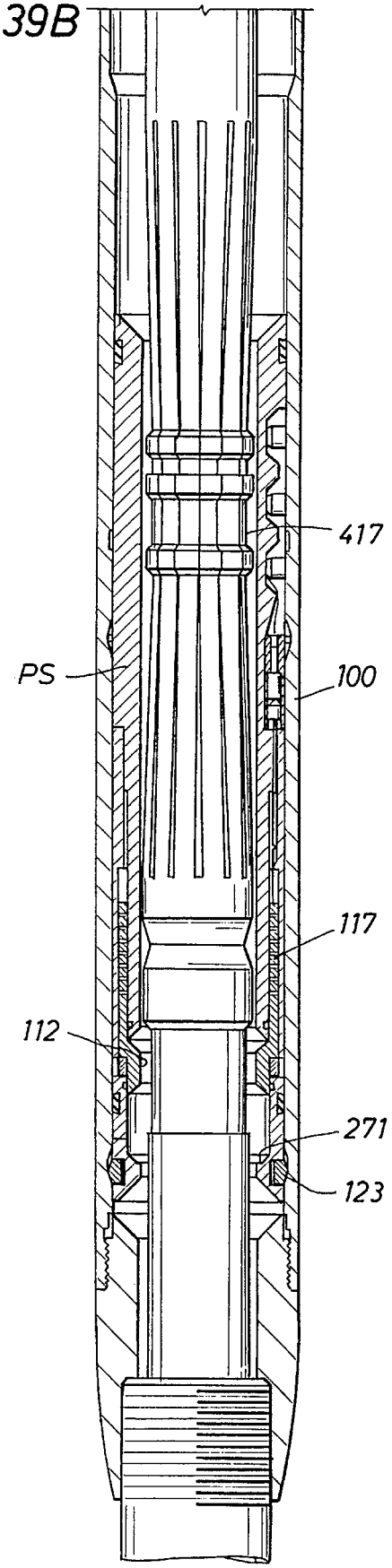
Figure 40A:
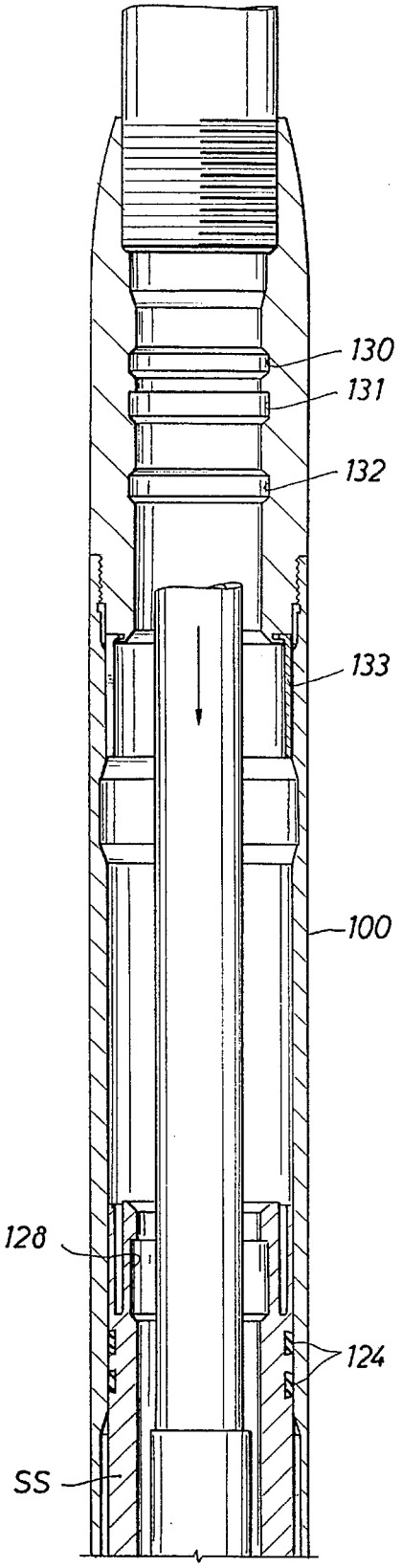
Figure 40B:
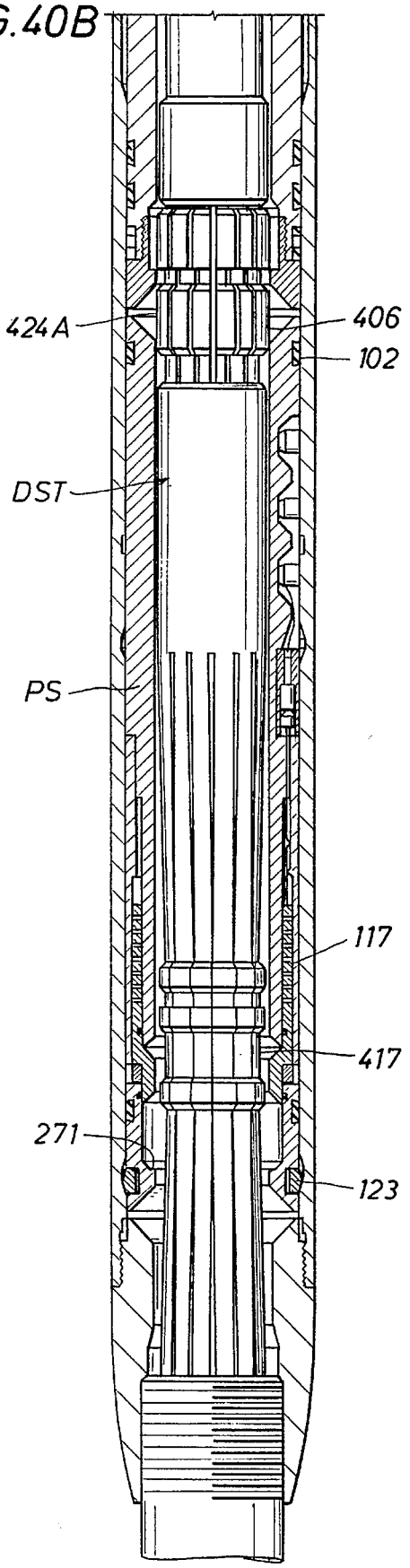
Figure 41A:
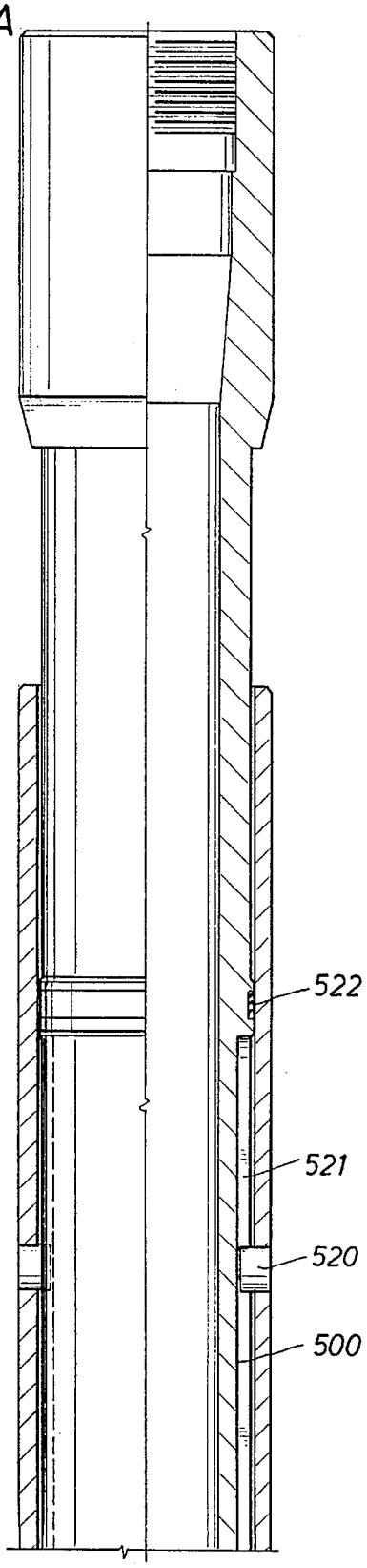
Figure 41B:
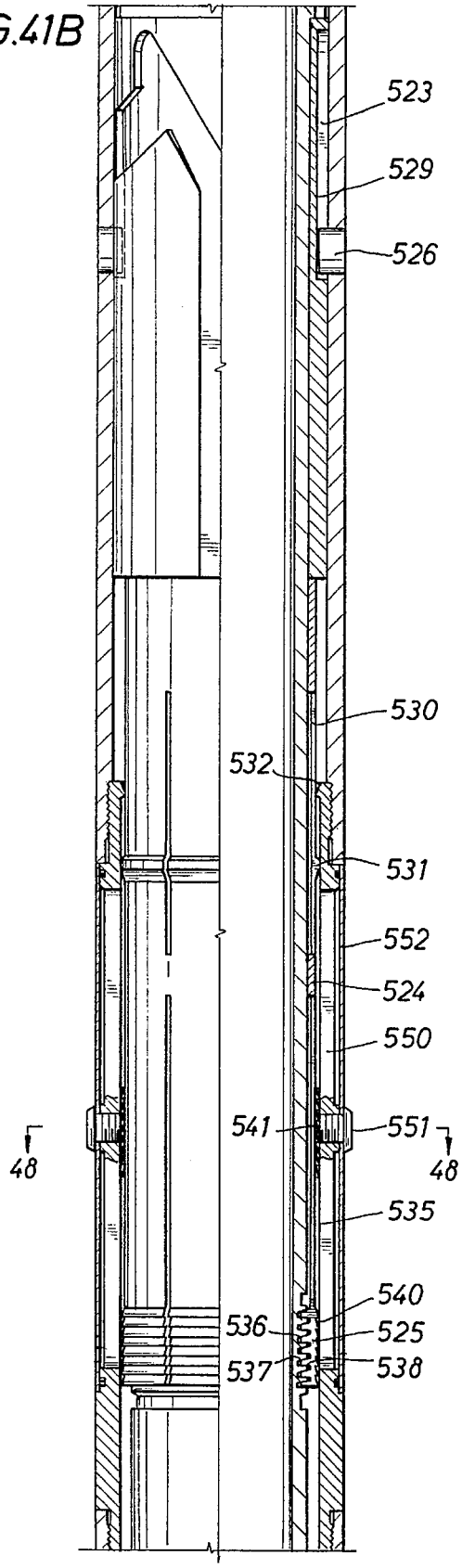
Figure 44A:
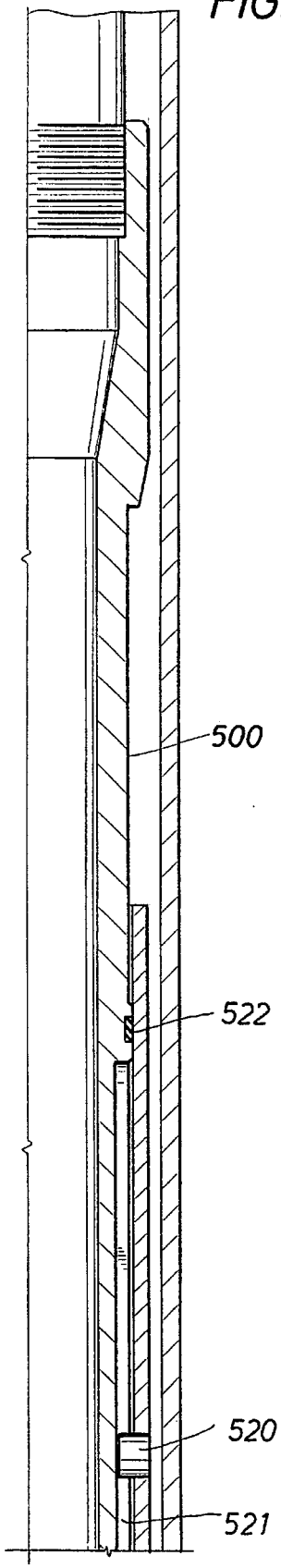
Figure 44B:
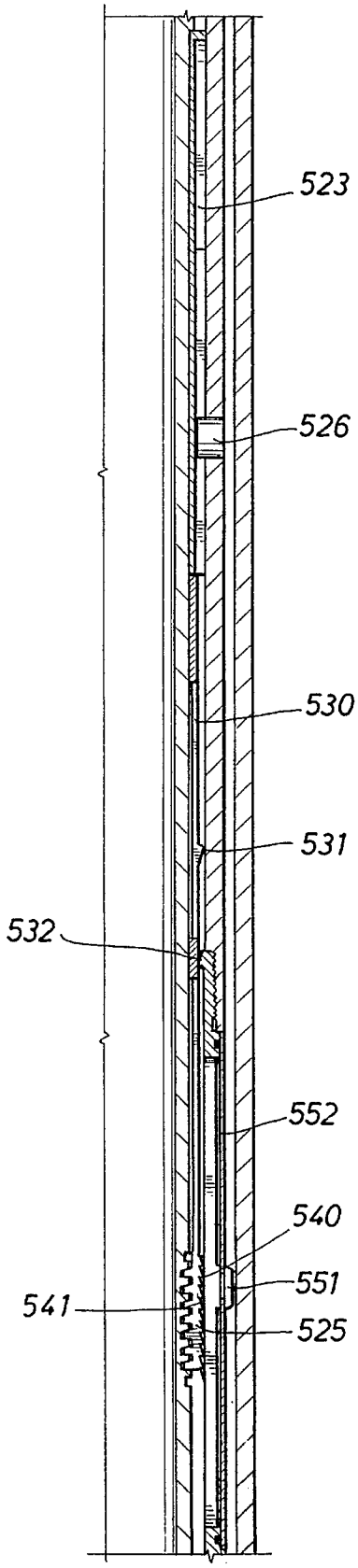
Figure 44C:
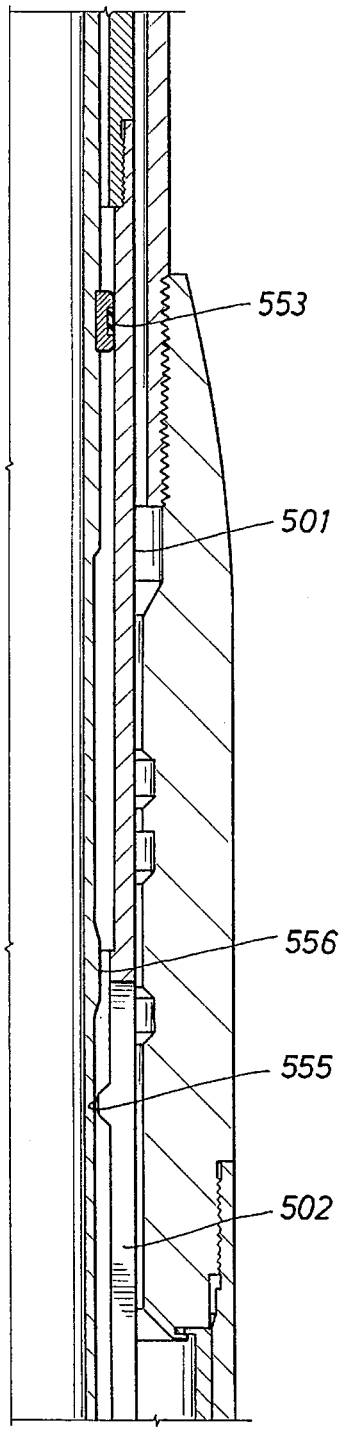
Figure 44D:
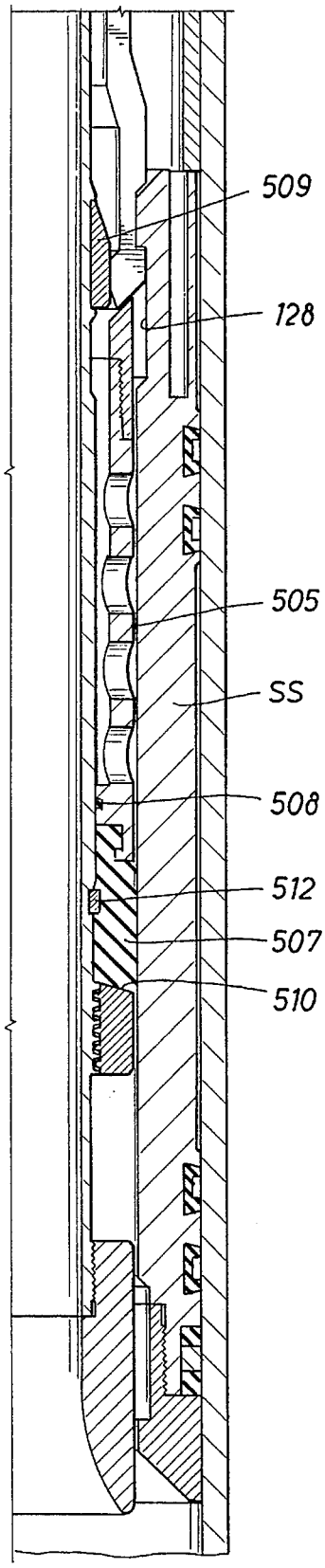
Figure 45A:
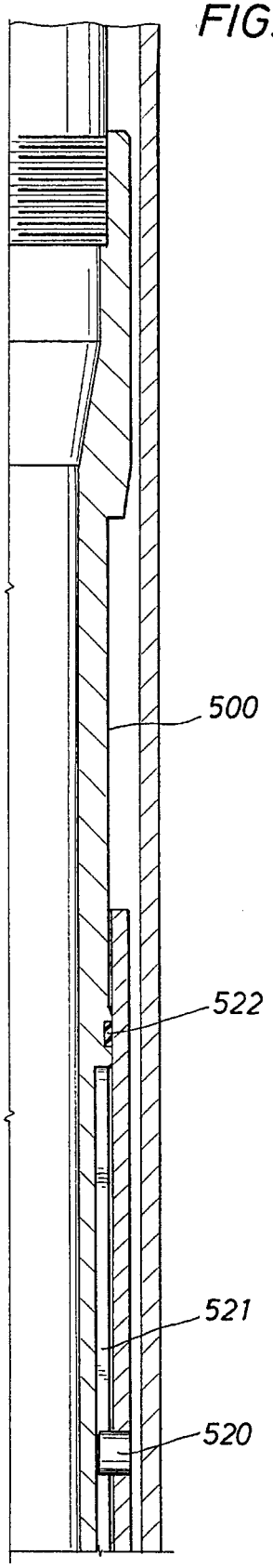
Figure 45B:
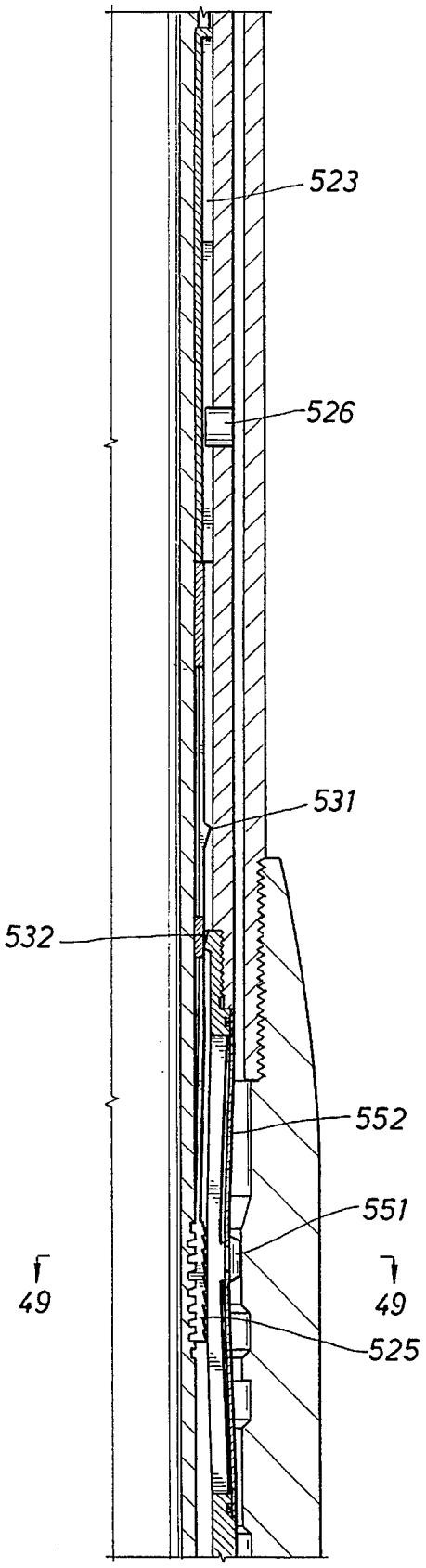
Figure 45C:
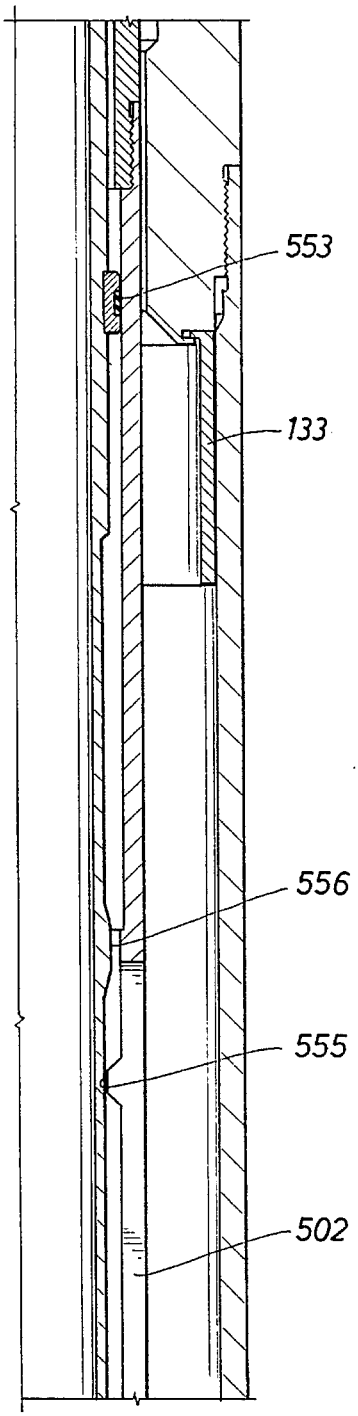
Figure 45D:
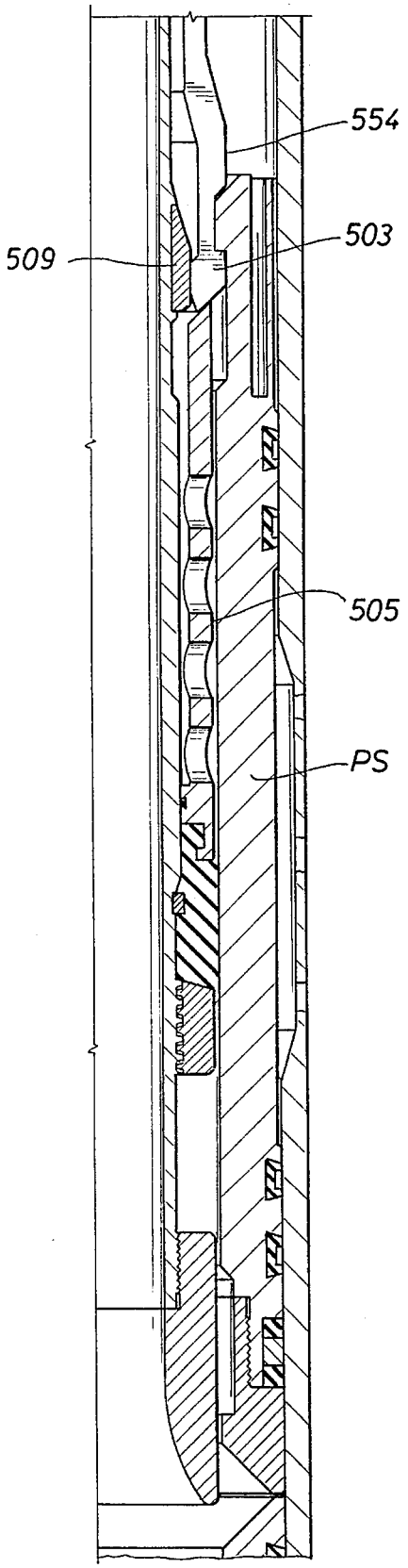

FIG. 1O is a view similar to FIG. 1N, but upon lowering of the seal sleeve to its lower position just above the perforation sleeve to cover the perforations, and then continued lowering of the work string to lower the downshifting and upshifting tools through the perforating assembly; and FIG. 1P is a view similar to FIG. 1Q, but upon raising of the upshifting and downshifting tools with the work string through the perforating assembly preparatory to perforating and treating one or more additional zones thereabove or removing from the casing string;

FIGS. 2A and 2B are detailed views, partly in elevation and partly in section, of the upper and lower portions of the trigger manipulator installed in the perforating work string and with its latch dogs in their collapsed position to permit the tool to pass freely through one or more perforating assemblies in the casing string;

FIG. 3 is a view of upper and mid portions of the trigger manipulator, but with the latch dogs expanded in response to an increased pressure within the bore of the tool to positions for engaging and manipulating the trigger of the perforating sleeve, as shown in FIGS. 18A to 21;

FIG. 4 is a cross-sectional view of the trigger manipulator with the latch dogs in their collapsed positions, as seen along broken lines 4—4 of FIG. 2A;

FIG. 5 is another cross-sectional view of the trigger manipulator with the latch dogs expanded, as seen along broken lines 5—5 of FIG. 3;

FIGS. 6A and 6B are views, partly in longitudinal section and partly in elevation, of the upper and lower portions of the tension set packer prior to activation and thus in a position for free movement through the casing string and perforating assembly;

FIG. 7 is a similar view of the intermediate and lower portions of the tension packer, following movement of the latch dogs thereof to their expanded positions;

FIG. 8 is a view of the tension packer similar to FIG. 7, but with the latch dogs locked in their expanded positions in which they engage a groove of the upper bore of the assembly housing in order that tension may be applied to expand the packing element, as also shown in FIG. 23;

FIG. 9 is a view, partly in longitudinal section and partly in elevation, of one embodiment of the bidirectional shifting tool for use in shifting the perforating and seal sleeve of the perforating assembly, as shown in FIGS. 24A to 29, and with the latch dogs thereof shown in their retracted position to permit the tool to be raised and lowered with the perforating string within the casing string and perforating assembly;

FIG. 10 is a view of the bidirectional shifting tool similar to FIG. 9, but with the latch dogs expanded to positions for shifting the sleeves in response to increased pressure in the tool;

FIGS. 11A, 11B, and 11C are longitudinal sectional views of the upper, intermediate, and lower portions of a modified bidirectional tool for use in shifting a single sleeve within a ported conduit, with the latch dogs thereof in retracted position to permit it to be moved freely through the casing string and perforating assembly;

FIGS. 12A, 12B, and 12C are partial longitudinal sectional views of the upper, intermediate, and lower portions of the modified tool, with the latch dogs moved to their expanded positions, in response to an increase in pressure within the bore of the manipulator, to engage in a groove in the sleeve, as shown in FIGS. 30A–33B;

FIGS. 13A, 13B, and 13C are partial longitudinal sectional views of the modified shifting tool following emergency release of the latch dogs from expanded positions;

FIGS. 14, 15, and 16 are cross-sectional views of the modified tool, with FIG. 14 being viewed along broken lines 14—14 of FIG. 11B, FIG. 15 being viewed along broken lines 15—15 of FIG. 12B, and FIG. 16 being viewed along broken lines 16—16 of FIG. 11C;

FIG. 17 is a diagrammatic illustration of passageways extending through the part of the shifting tool shown in the cross-sectional view of FIG. 16;

FIGS. 18A and 18B are longitudinal sectional views of the upper and lower portions of the perforating assembly, with the seal and perforating sleeves in their upper positions within the housing of the assembly, as shown in FIG. 1B, and with the latch dogs of the trigger manipulator expanded to positions to engage the trigger of the perforating sleeve as it is raised within the perforating sleeve;

FIG. 19 is an enlarged cross-sectional view of the assembly, through the upper end of the seal sleeve, as seen along broken lines 19—19 of FIG. 18A;

FIG. 20 is another enlarged cross-sectional view of the assembly, through a mid portion of the perforating sleeve, as seen along broken lines 20—20 of FIG. 18A;

FIG. 21 is an enlarged partial longitudinal sectional view of the perforating sleeve and the trigger manipulator upon raising of the perforating work string from the position of FIG. 18B to cause the manipulator to engage and raise the trigger of the perforating sleeve to detonate the shaped charges thereof, as shown in FIG. 1B;

FIG. 22 is a partial enlarged longitudinal sectional view of the upper bore of the housing of the perforating assembly and the upper end of the seal sleeve below it, with the perforating work string raised from the position of FIG. 21 to raise the trigger manipulator and bidirectional shifting tool to a position above the perforating assembly and the tension set packer to a position for packing off within the upper bore of the housing of the assembly;

FIG. 23 is a view similar to FIG. 22, but upon further raising of the tension set packer with the perforating work string to engage the latch dogs thereof in a groove within the housing bore, so that, upon further raising of the work string, the packing element is expanded into sealing engagement with the bore to permit the testing of the sealing integrity of the perforating assembly, as shown in FIG. 1C;

FIGS. 24A and 24B are longitudinal sectional views of the perforating assembly wherein, following an unsuccessful test of the sealing integrity of the assembly, the latch dogs of the bidirectional shifting tool expanded in order to engage the perforating sleeve, as shown in FIG. 1D, for shifting it to its lower position in the perforating assembly;

FIGS. 25A and 25B are longitudinal sectional views similar to FIGS. 24A and 24B, but upon lowering of the perforating sleeve to its lower position, as shown in FIG. 1E, and further lowering of the string to cause the bidirectional shifting tool to be released from engagement with the perforating sleeve;

FIG. 26 is a longitudinal sectional view of the upper portion of the perforating assembly upon raising and subsequent lowering of the work string to cause the expanded latch dogs of the bidirectional shifting tool to engage the seal sleeve, as shown in FIG. 1F, preparatory to shifting it to its lower position;

FIG. 27 is a view similar to FIG. 26, but upon lowering of the bidirectional shifting tool with the perforating work string to lower the seal sleeve to its lower position just above the perforating sleeve, whereby the spacer sleeve is released, and further lowering of the string to cause the bidirectional shifting tool to be released from the seal sleeve so that, upon lowering and release of pressure, it may be raised therefrom, as also shown in FIG. 1G;

FIG. 28 is a view similar to FIG. 27, but upon raising of the perforating work string to cause the latch dogs of the bidirectional shifting tool to engage a groove in the upper end of the seal sleeve in order to raise it back to its upper position;

FIG. 29 is a view similar to FIG. 28, upon further raising of the work string and bidirectional shifting tool to lift the seal sleeve to an upper position engaged with the spacer sleeve previously released from the upper end of the seal sleeve, and showing the shifting tool with its latch dogs released from engagement with the seal sleeve upon reduction in pressure in the tool;

FIGS. 30A and 30B are partial longitudinal sectional views of upper and lower portions of a ported housing installed in a well conduit and having a sleeve shiftable therein to open and close the ports, and with the latch dogs of the bidirectional shifting tool shown in FIGS. 11A to 17, expanded by increased pressure in the tool to engage in a groove in the upper end of the sleeve to raise it from its lower toward an upper position to close the port in the housing;

FIGS. 31A and 31B are views similar to FIGS. 30A and 30B, but upon further raising of the sleeve to its fully upper position to cause the latch dogs of the bidirectional shifting tool to be released from the groove in the upper end of the sleeve;

FIGS. 32A and 32B are views similar to FIGS. 31A and 31B, but upon lowering of the bidirectional shifting tool to cause its latch dogs to engage in a lower groove of the shiftable sleeve in order to lower it toward a position opening the ports in the housing;

FIGS. 33A and 33B are views similar to FIGS. 32A and 32B, but upon still further lowering of the bidirectional shifting tool to fully lower the sleeve and cause the latch dogs of the shifting tool to be released from the lower groove in the sleeve as it reaches its lowermost position;

FIGS. 34A and 34B are views, partly in longitudinal section and partly in elevation, of the downshifting tool installed in the treatment work string and with the latch dogs thereof in their retracted positions preparatory to lowering with the work string into the perforating assembly;

FIGS. 35A and 35B are views of the upper and lower portion of the downshifting tool of FIGS. 34A and 34B, upon lowering with the work string below the lowermost perforating assembly and then raising to a position in which collet fingers retaining the latch dogs in the retracted positions are engaged within grooves in the upper bore of the housing above the seal sleeve;

FIGS. 36A and 36B are views similar to FIGS. 35A and 35B, upon further raising of the work string to lower the collet fingers and thus release the latch dogs to expand as well as release the collet fingers to retract from the grooves in the upper bore of the housing of the perforating assembly, thus arming the tool;

FIGS. 37A and 37B are views similar to FIGS. 36A and 36B, but upon lowering of the downshifting tool with the work string to cause the released latch dogs to engage within a groove about the lower end of the perforating sleeve in order to lower it, as shown in FIG. 1H;

FIGS. 38A and 38B are views similar to FIGS. 37A and 37B, but upon lowering of the treatment work string to lower the perforating sleeve with the downshifting tool and then cause the latch dogs of the downshifting tool to be released upon continued lowering of the work string toward the position shown in FIG. 1I;

FIGS. 39A and 39B are views similar to FIGS. 38A and 38B, but upon raising of the downshifting tool with the work string above the seal sleeve, as shown in FIG. 1J, and then lowering it to cause its latch dogs to engage in a lower groove in the seal sleeve preparatory to lowering the seal sleeve to its lower position, as shown in FIG. 1K;

FIGS. 40A and 40B are views similar to FIGS. 39A and 39B, but upon lowering of the seal sleeve with the downshifting tool to its lower position just above the already lowered perforating sleeve, and further lowering thereof to cause the latch dogs of the downshifting tool to be released from the groove in the lower end of the lowered seal sleeve and thus permit the tool to be lowered therepast, as shown in FIG. 1L;

FIGS. 41A, 41B, 41C, and 41D are views, partly in longitudinal section and partly in elevation, of the upper end, upper intermediate portion, lower intermediate portion, and lower end, respectively, of the upshifting tool with pack-off, with the parts of the tool in the positions they occupy as it is lowered with the treatment work string into the perforating assembly;

FIGS. 42A, 42B, 42C, and 42D are partial sectional views of the upshifting tool of FIGS. 41A–41D lowered into the perforating assembly to a level in which sensor buttons thereon move into the restricted upper bore of the housing of the perforating assembly whereby the inner body of the tool may be lowered, upon continued lowering of the work string, in order to initially index the parts of the tool to a position for expanding its latch dogs;

FIGS. 43A, 43B, 43C, and 43D are views of the upshifting tool and assembly, similar to FIGS. 42A–42D, but upon lowering of the tool below the lower end of the perforating sleeve and raising of the body thereof to further index the parts as the latch dogs are forced into an outwardly armed position;

FIGS. 44A, 44B, 44C, and 44D are views similar to FIGS. 43A-43D, but wherein the upshifting tool has been raised with the treatment work string to further index the parts and cause the latch dogs thereof to engage in the upper groove of the seal sleeve and raise it with the work string to an upper position in which it engages the released spacer sleeve, and further in which an expander part on the body has moved within the latch dogs to hold them in latching position and the packing element has been expanded into sealing engagement with the bore of the seal sleeve to permit treatment fluid to be circulated downwardly into the uncovered perforations, as shown in FIG. 1M;

FIGS. 45A, 45B, 45C, and 45D are views similar to FIGS. 44A–44D, but upon lowering of the work string so as to lower the seal sleeve therewith, as shown in FIG. 1N, toward a position covering the perforations in the housing of the perforating assembly;

FIGS. 46A, 46B, 46C, and 46D are views similar to FIGS. 45A–45D, but upon continued lowering of the work string to still further index the parts and release the latch dogs and permit the packing element to contract;

FIGS. 47A, 47B, 47C, and 47D are views similar to FIGS. 45A–45D, but showing the emergency release of the latch dogs to permit the packing element to return to its contracted position;

FIG. 48 is a cross-sectional view of the upshifting tool, as seen along broken lines 48—48 of FIG. 41B, and showing the sensor buttons in their non-collapsed position;

FIG. 49 is another cross-sectional view of the tool, as seen along broken lines 49—49 of FIG. 45B, and showing the sensor buttons in their collapsed position; and FIG. 50 is a development of the outer side of the indexing sleeve carried between the body and housing of the tool and showing a pathway formed therein to provide slots which receive a non-rotation pin on the housing in order to index the parts of the tool into its various positions illustrated in FIGS. 41A to 50.

With reference now to the details of the above described drawings, and particularly the diagrammatic illustrations of FIGS. 1A–1P, the well bore, which is indicated by reference character WB, is drilled in accordance with conventional practices, and the casing string or liner, indicated in its entirety by the reference character CS, is lowered to full depth in the bore to form an annulus ANN between the string and well bore. When lowered to full depth, the casing string is suspended at its upper end from an upper well casing lining the upper end of the well bore. As previously described, the illustrated well bore is actually a horizontal section thereof extending laterally from a vertical section extending from the surface to penetrate a plurality of spaced production zones.

A conventional float shoe FS installed in the lower end of the liner casing receives the lower end of a cementing work string CWS lowered into the casing string, as shown in FIG. 1A, thereby permitting cement to be pumped downwardly through the cementing work string and out the float shoe FS into the annulus ANN. When the desired column of cement has been pumped into the annulus and permitted to set to anchor the casing, the cementing work string may be removed from within the casing string to prepare for the perforating and treating of the production zones in accordance with the present invention.

Although only one is shown, the invention contemplates that a plurality of perforating assemblies PA have been installed in the casing string at spaced locations therealong so as to dispose each of them opposite a production zone. As also previously described, each such perforating assembly includes a housing 100 connected as part of the casing string, and having a recess 101 about its bore to receive a perforating sleeve PS in an intermediate portion thereof and a seal sleeve SS above the perforating sleeve and below the upper bore UB of the housing. As will be described in detail to follow, shaped charges are carried within a sealed chamber which may be at atmospheric pressure and which is formed between the perforating sleeve and bore of the housing to face each zone to be perforated.

As a first step in the perforating procedure, following removal of the cementing work string, the perforating work string PWS is lowered into the casing string and through the lower end of a selected perforating assembly. As shown in FIGS. 1B and 1C, the perforating work string carries a tension set packer TSP at its lower end, a bidirectional shifting tool BDST spaced above the tension packer, and a trigger manipulator TM spaced above the bidirectional shifting tool.

Upon lowering through the perforating assembly, the trigger manipulator TM may be raised with the work string to engage the trigger of the perforating sleeve in order to detonate the shaped charges and thus perforate the housing as well as the cement column and production zone opposite thereto, as illustrated in FIG. 1B.

At this time, pressure within the trigger manipulator is lowered to release it from the trigger of the perforating sleeve, so that the perforating work string may be raised to dispose the tension set packer TSP within the upper bore UB of the housing, as shown in FIG. 1C, whereby the latch dogs thereof may engage in grooves in the upper bore UB so that tension may be applied to the perforating work string to expand an annular packer element into sealing engagement with the bore. Test pressure may then be circulated downwardly through the perforating work string in order to test the sealing integrity of the perforating assembly following detonation of the shaped charges. Assuming that there is no leak, and the pressure within the perforated formation is isolated, the operator may remove the perforating work string and proceed to the treatment procedure illustrated in connection with FIGS. 1H to 1P.

However, it is important that each assembly be pressure-tight before the operator perforates another zone, because if, upon subsequent operation, more than one assembly leaks, i.e., allows fluid to enter the zone, the operator will not know which zone is being treated. Hence, in the event there is leakage, the operator will not remove the perforating work string, but instead will manipulate it in a manner to perform the remedial operations illustrated in FIGS. 1D to 1G.

For this purpose, the perforating work string is lowered from the position of FIG. 1C to the position of FIG. 1D so as to engage the bidirectional shifting tool BDST with the perforating sleeve, whereby the perforating sleeve may be lowered from its upper position of FIG. 1D to its lower position of FIG. 1E in which it uncovers the perforations. At this time, the perforating work string is released from the perforation sleeve and again raised to engage the bidirectional shifting tool with the seal sleeve, as shown in FIG. 1F, and then lowered to in turn lower the seal sleeve to a lower position covering the perforations (FIG. 1G). The bidirectional shifting tool is then released from the shifted seal sleeve, and raised to again dispose the tension set packer in sealing engagement of the upper bore of the housing, as shown in FIG. 1G, whereby test pressure may again be circulated downwardly through the perforating work string to test the sealing integrity of the perforated zone.

When the perforated zone has been properly isolated, the operator continues manipulation of the perforating work string in order to perforate the other zones. As previously described, the operator may do so in any order which he chooses—i.e., from the lowermost up, from the uppermost down, or in between.

Following perforation of all the zones, and assurance that all zones are isolated from one another, the operator replaces the perforating work string with the treatment work string TWS which, as previously described, and as shown in FIGS. 1H to 1P, carries an upshifting tool UST at its lower end and a downshifting tool DST spaced above the upshifting tool. As also previously mentioned, the downshifting tool also carries a pack-off which enables treatment fluid to be circulated downwardly through the treatment work string and into the perforated zone.

As compared with the procedure followed in the manipulation of the perforating work string, however, the treatment work string is lowered to a position beneath the lowermost assembly that has been perforated to enable the operator to treat the zones from the lowest up. Thus, as shown in FIG. 1H, the treatment work string TWS has been lowered through this assembly to engage the downshifting tool DST with the perforating sleeve in the upper position it occupies in FIG. 1C. At this time, upon further lowering of the work string, the perforating sleeve is lowered to the position of FIG. 1I to uncover the perforations, similarly to the lowering of the perforation sleeve during the remedial steps of FIGS. 1D and 1E.

As the downshifting tool lowers the perforating sleeve into its lower position, it is automatically released from the perforating sleeve, so that the treatment work string may be raised back through the perforating assembly to a position to dispose its lower end above it, as shown in FIG. 1J. At this time, lowering of the work string will cause the upshifting tool to pass through the sleeves of the perforating assembly and the downshifting tool to engage with the seal sleeve so as to lower it, upon continued lowering of the treatment work string, as shown in FIG. 1K, until the seal sleeve reaches a position just above the lowered perforating sleeve, as shown in FIG. 1L, at which time the downshifting tool is again automatically released from the seal sleeve to permit it to move downwardly through the perforating assembly, as shown in FIG. 1L. As was described in connection with the remedial procedure, lowering of the seal sleeve releases the spacer sleeve.

Raising of the treatment work string will cause the downshifting tool DST to pass through the sleeves and the upshifting tool UST to engage with the seal sleeve, whereby continued raising of the work string will raise the seal sleeve to an upper position above the perforations determined by the engagement with the spacer sleeve, as shown in FIG. 1M, which is a somewhat lower position than it occupied in its original uppermost position shown in FIGS. 1I and 1J.

Upon raising of the seal sleeve to the position shown in FIG. 1M, continued raising of the treatment work string will cause the packing element of the upshifting tool UST to be expanded into sealing engagement with the bore of the seal sleeve, whereby treatment fluid may be circulated downwardly through the work string and into the open perforations. When the zone has thus been treated, the work string TWS may be lowered, with the assist of annulus pressure creating a force across the packing element to urge it downwardly, so that the seal sleeve is shifted downwardly, as shown in FIG. 1N, and then into its lower position just above the lowered perforating sleeve, in which it covers the perforations into the treated zone (FIG. 10).

This lowering of the work string will cause the upshifting tool and pack-off to be released from the seal sleeve, and thus permit the work string to be lowered through the perforating assembly to the position shown in FIG. 10, whereupon the work string may be again raised to lift the upshifting tool and downshifting tool through the perforation assembly whose perforations are now covered by the seal sleeve. The treatment work string may be then raised to the next lowered perforated zone to be treated. Then when the operator is ready to produce the well, he may lower a suitable tool into the perforating assembly in order to engage and lift each seal sleeve from the position shown in FIG. 1P.

With reference now to the details of the perforating assembly, when the perforating sleeve PS is located in its upper position intermediate the upper and lower ends of the recess 101 of the housing, it forms with the housing an atmospheric chamber containing the shaped charges and other parts required for perforating the housing and the formation opposite thereto. For this purpose, and as shown in FIGS. 18A and 18B, the seal sleeve carries seal rings 102 and 102A thereabout for sealably engaging the bore 101 of the housing above and below pockets 104 formed about the circumference of the sleeve each to receive a shaped charge SC facing the bore of the housing opposite a thin-walled section 103 thereof. As best shown in FIG. 21, each of the shaped charges is connected by suitable wiring with a firing cartridge 105 received in the sleeve generally intermediate its upper and lower ends. A booster 106 extends through each cartridge and is engaged at its lower end with a detonator 107 above the upper pointed end of a firing pin 108, the boosters working in parallel with an aircraft-industry-type jumper system as well-known in the art.

A transfer pin 109 is carried within an opening formed in the sleeve beneath the firing pin and above a trigger 110 which extends through the lower end of the opening in the sleeve and, as shown in FIG. 18B, is initially located with its upper end spaced a short distance from the lower end of the transfer pin. More particularly, the trigger is initially held between the transfer pin and an inner flange about a lower extension 111 of the sleeve beneath the trigger. The flange has an inner diameter slightly less than that of the perforating sleeve, thus preventing accidental and unintended engagement with the lower end of the trigger by tools adapted to be raised and lowered through the perforating sleeve and other parts of the perforating assembly. The inner diameter of the trigger is sealingly engaged by an O-ring 113 carried about the annular opening in the lower end of the sleeve, and the outer diameter of its lower end 112 is sealably engaged by an O-ring 114 carried by the inner diameter of the lower extension 111. As best shown in FIG. 21, these sealing diameters are essentially equal so that the trigger may be reciprocated within the annular opening without having to overcome hydrostatic forces.

The intermediate portion of the trigger has collets with outer protrusions 115 which are releasably engaged by inner protrusions 115A on the inner diameter of the opening through the sleeve to releasably hold the trigger against upward movement from the inactive position shown of FIG. 18B. The trigger includes a beam spring 117 intermediate the protrusions 115 and its lower end 112, and keys 119 extend through holes in the sleeve extension 111 to engage in a groove 120 formed about the bore of the housing. With the trigger in its lower position shown in FIG. 18B, its outer diameter holds the keys in the groove to prevent longitudinal movement of the perforating sleeve in the housing.

A C-ring 122 carried about a groove in the extension below the seal ring 102A normally assumes an outer position in a groove 123 about the bore of the housing. The upper and lower edges of the groove 123 are beveled so that the protruding outer side of the C-ring 122 merely acts as a detent to hold the extension and thus the sleeve in their upper position before the sleeve is lowered. With the perforating sleeve releasably held in the position shown, the lower end of the trigger and the upper side of the lower inwardly extending flange of the extension 111 form a gap A (FIG. 18B) which is of such size as to ensure that none of the tools in the work strings other than the trigger manipulator TM will have any effect on the perforating assembly. That is, as the perforating work string is elevated through the perforating assembly, as will be described in connection with FIG. 21, the gap permits only the trigger manipulator to engage and raise the trigger 110 to detonate the shaped charges.

The seal sleeve SS, which is disposed intermediate the upper end of the perforating sleeve and the lower end of the bore UB through the housing carries a pair of upper and lower seal rings 124 and 125 about its upper and lower ends, and a metal-to-metal-type seal ring 126 beneath the lower seal rings 125. The metal-to-metal seal protects the lower elastomeric seals 125 from unloading pressure as the sleeve is shifted from a position in which it closes the perforations to be formed in the housing and the upper position shown in FIG. 18A. A recess 127 is formed in the housing bore opposite the upper seal rings 124 when the sleeve is in its upper position to prevent trapped atmospheric pressure from creating excessive friction or potentially damaging the seal rings 124 when shifted in a high hydrostatic well environment.

An upper groove 128 is formed about the bore of the seal sleeve near its upper end, and a lower groove 129 is formed thereabout near the lower end of the seal sleeve. The upper groove 128 has an abrupt shoulder 128A at its upper end, and the lower groove 129 has an abrupt shoulder 129A at its lower end, the shoulders 128A and 129A thus facing oppositely with one another. As will be described to follow, these grooves are adapted to be engaged by suitable tools for shifting the seal sleeve upwardly and downwardly.

Upper, intermediate and lower grooves 130, 131, and 132, respectively, are formed in the upper bore of the housing, with the upper and lower grooves 130 and 132 having tapered ends, and the intermediate groove having an upper abrupt end 131A. These grooves form a profile for cooperation with the tension set packer TSP, as will also be described to follow.

A C-ring 133 carried within an annular groove 133A in the upper end of the seal sleeve is so formed that, when removed from the groove, in response to lowering of the seal sleeve, as shown in FIG. 27, it will expand outwardly against the recess 101 in the bore of the housing. The upper end of the sleeve has a flange 134 which is received in an outwardly facing groove 134A about the lower end of the upper bore UB of the housing so as to suspend the spacer sleeve therefrom when the seal sleeve is removed, whereby the lower end of the sleeve is positioned to limit subsequent upward movement of the sleeve during the treatment procedure, for a purpose apparent from the description to follow.

As indicated on FIG. 18A, a gap B is formed between the lower end of the upper bore UB of the housing and the upper end of the seal sleeve in its upper position. As will also be described to follow, this gap is of such length as to ensure that none of the tools of the work strings will engage the upper groove 128 of the seal sleeve unless the seal sleeve has been lowered.

Likewise, the lower end of the seal sleeve and upper end of the perforating sleeve in the upper positions of the two sleeves form a gap C between them to ensure that the lower groove 129 of the seal sleeve will be engaged by the downshifting tool DST installed in the treatment work string only when the perforating sleeve has already been shifted to its lower position, and that the seal sleeve will be engaged by the upshifting tool UST to lift it to its upper position only when the seal sleeve is in its lower position.

As shown in FIGS. 2A, 2B, 3, 4, and 5, the trigger manipulator TM includes a tubular body 140 which is connectable in the perforating work string PWS for lowering therewith through the perforating assembly into a position beneath the perforating sleeve in order to engage and raise the trigger thereof and thus detonate the shaped charges. Windows 141 are spaced about the circumference of the body each to receive a beam 142 for guided radial movement with respect to the body and having dogs 143 on its outer side intermediate its upper and lower ends. A tubular member or sleeve 144 extends longitudinally within the body to form a continuation of the bore through the upper and lower ends of the body and an annular space 145 between it and a recess formed by an enlarged inner diameter portion 146 of the mid portion of the body in which the ends of the beam are received.

The upper and lower ends of the tubular member 144 are surrounded by upper and lower pistons 147 and 148, and the inner diameters of the pistons carry O-rings 149 to form a sliding seal with the sleeve or liner, and the outer ends of the pistons carry seal rings 150 for sealing with respect to the bore of the housing. The upper piston is located in its upper position by a ring 151 releasably connected to the upper end of the piston by a shear screw 152 and engaging at its upper end with the upper end of the recess, while the lower piston is located in its lowermost position by a similar ring 153 releasably connected to the lower end of the piston by a shear screw 154 and engaging at its lower end with the lower end of the housing recess.

The upper piston is yieldably urged to its upper position by a coil spring 155 between a flange on the upper end of the upper piston and a retainer ring 156 held by a snap ring within the bore of the housing, and the lower piston is yieldably urged to its lowermost position by a coil spring 157 between a flange about the lower end of the piston and a retainer ring 158 held by a snap ring in the bore of the housing. More particularly, holes are formed in the rings 151 and 153 so that pressure within the housing of the tool is free to act across the area of each of the pistons between the inner and outer O-rings 149 and 150 to urge the upper piston downwardly against the force of spring 155 and urge the lower piston upwardly against the force of spring 157.

Each of the beams 142 is formed of upper and lower beam sections having their upper and lower ends held within flanges 160 on the ends of the pistons, and their inner ends shaped to engage one another at their outer diameters, as shown in FIG. 2B, when the beams are in retracted positions. The beams are yieldably urged to their retracted position by bow springs 160 which are retained at their ends by the pistons and extend through holes in adjacent ends of the beam sections. The beams are permitted to assume this retracted positions, wherein the dogs 143 are within the outer diameter of the housing, when the pressure within the tool is relatively low, such that the pistons are forced into their upper and lower positions, respectively, by the force of the coil springs.

However, the lower end of the perforating work string, and, in particular, the lower end of the tension set packer TSP to be described to follow, has a restricted opening therein so that increase in the circulation of fluid downwardly through the perforating work string will increase pressure within the body of the trigger manipulator, which in turn will act upon the upper and lower pistons to urge them toward one another against the force of the bow springs. As a result of the oppositely directed forces on the upper and lower ends of the beams, the beam sections are adapted to be pivoted outwardly to cause their oppositely facing ends to move into abutment with one another, as shown in FIG. 3, wherein the dogs 143 are held firmly in their expanded positions.

With the dogs of the trigger manipulator in their outer position, the perforating work string is raised upwardly to bring the dogs into engagement with the lower end of the perforating sleeve extension 111. Since the extension 111 is held against upward movement by ring 119, the dogs will yield inwardly, as shown in FIG. 18B, despite the fluid pressure in the trigger manipulator urging them outwardly, as to permit them to pass the inwardly extending lower end of the extension and expand into engagement with the lower end 112 of the trigger, as shown in FIG. 21.

As the trigger is raised with the manipulator, the beam spring 117 is compressed to store energy therein. When a predetermined force is thus applied to the detent formed by the protrusions 115 and 115A above the beam springs, it will release the trigger to permit its upper end to move rapidly upwardly to detonate the shaped charges and thus form perforations in the thin portion of the housing opposite them, as shown in FIG. 21, as well as the column of cement about them and the production zone opposite thereto.

As also shown in FIG. 21, this raising of the lower end of the trigger will permit the key 119 to move inwardly through the holes in the sleeve and into engagement with the reduced outer diameter of the lower end 112 of the trigger opposite the enlarged portion of the trigger above its lower end. At this time, the perforating sleeve is held in its upper position by the detent ring 122, which thus prevents the trigger from moving back to its lower position. Circulation of fluid through the perforating work string may then be so controlled as to reduce the pressure in the trigger manipulator, thereby permitting the dogs 143 to retract, so that the trigger manipulator may be moved upwardly through the remainder of the perforating assembly. However, even if in their expanded positions, the dogs of the trigger manipulator will not engage in either of the gaps A and B above the seal sleeve and between the seal and perforating sleeves because the portions of beams 142 above and below the dogs prevent entry.

At this time, the operator may test the sealing integrity of the perforating sleeve, and thus be assured that the perforated zone is isolated from the remainder of the well bore. For this purpose, the operator continues to raise the perforating work string to the position shown in FIG. 1C so that, upon packing off of the tension set packer TSP within the upper sub, test pressure may be circulated downwardly through the perforating work string to perform the test.

As shown in FIGS. 6A, 6B, 7 and 8, the tension set packer TSP includes a tubular body 170 which is installed in the lower end of the perforating work string. More particularly, the body 170 has an enlarged upper end 171 with a downwardly facing shoulder 172 thereabout and an enlarged lower end 173 with an upwardly facing shoulder 174 thereabout, the intermediate portion of the body being of reduced outer diameter. A tubular member 175 surrounding the reduced outer diameter of the tubular body has an upper end 176 facing the shoulder 172 on the tubular body 170 and collet fingers 177 extending downwardly from an intermediate portion thereof and having enlarged heads 178 providing latch dogs at their lower ends. The collet fingers are of such configuration that they normally assume a contracted position in which, as shown in FIG. 6B, the inner sides of their heads are adjacent the outer diameter of the tubular body 170.

A gauge ring 180 is supported from the collet fingers to surround the reduced diameter of the tubular body 170 beneath them and carries an O-ring 181 for sealably surrounding the outer diameter of the body during relative longitudinal reciprocation between them. An annular packing element 182 of rubber or other elastomeric material is bonded to the gauge ring at its upper end and has a lower free end above a ring 183 releasably secured about the body by a set screw 183A above the shoulder 174 thereon. For reasons to be described to follow, a stop ring 184 supported about the body above the ring 183 and below the gauge ring has an outer diameter adapted to move within the inner diameter of the open lower end of the packing element 182.

An annular piston 185 is received within the upper end of an annular space between the body 170 and the tubular member 175, and, in the position shown in FIG. 6A, prior to expansion of the collet fingers, is supported on an upwardly facing shoulder 186 on the inner side of tubular member 175 above the collet fingers 177. The piston is urged downwardly to the position of FIG. 6A by means of a coil spring 187 compressed between the piston and the lower side of the enlarged upper end 176 of the tubular member 175. An upper seal ring 188 is carried by the inner diameter of the piston for sealably engaging the outer diameter of the tubular body above a port 189 in the body 170, and a seal ring 191 is carried about the body beneath the port 189 for sealably engaging with an enlarged inner diameter portion of the piston 185 beneath the port.

Thus, the piston and body form an annular pressure chamber 192 having a downwardly facing surface which is responsive to pressure within the tubular body and thus within the perforating work string, to urge the piston upwardly and thus further compress the spring 187. An orifice 195 is formed in the lower end 173 of the body 170 so that, as previously suggested, an increase in circulation of fluid through the perforating work string will increase the pressure therein, and thus the pressure within the tension set packer TSP and within the above described trigger manipulator TM, as well as the bidirectional shifting tool BDST to be described.

The piston has a lower extension 196 having an outwardly enlarged lower end 197 which, in the position of FIG. 6A, is disposed below an inward protrusion 198 on the collet fingers, whereby, upon raising of the piston, in response to an increased pressure within the pressure chamber, the enlarged lower end 197 moves within the protrusion 198 to urge the collet fingers to their outwardly expanded positions, as shown in FIG. 7. As will be described, when in this outer position, the latch dogs on the enlarged heads 178 on the collet fingers are adapted to engage in grooves about the upper bore UB of the housing of the perforating assembly, so as to permit the body 170 to be raised with respect to the collet fingers and thus the packing element 182 below them.

As the body 170 is so raised, a conically shaped shoulder 201 on the lower ends of the dogs will engage the upwardly facing conical shoulders on the gauge ring 180 so as to force the gauge ring downwardly, and thus, when the dogs are held in expanded position, as will be described, lower the packing element 182 with the gauge ring until it engages the upper end of fixed ring 183 beneath it. More particularly, as shown, the lower open end of the packing element and the upper end of the gauge ring 183 have downwardly and outwardly tapering conically shaped surfaces to urge the packing element outwardly to the expanded position shown in FIG. 8 when it is so lowered.

An expander ring 202 is carried about the body 170 within a reduced inner diameter of the gauge ring 180 and beneath the dogs on the collet fingers, in their contracted positions of FIG. 6B. The upper end 203 of the expander ring is conically shaped to engage a similarly tapered shoulder 204 on the inner sides of the dogs so as to move within the inner diameter of the collet fingers and thus lock them in their outer positions within the grooves of the upper sub, as shown in FIG. 8.

The collet fingers are free to contract, as shown in FIG. 6B, so that pressure may be applied to the inside of the work string as the packer is moved upwardly through the seal sleeve and perforating sleeve of the perforating assembly. As will be understood from FIGS. 7 and 8, the enlarged heads of the collet fingers will move upwardly through groove 132 until the dogs are opposite the groove 131 and the enlargements above it are opposite groove 130, at which time they will expand into the grooves to latch the collet fingers against upward movement. At this time, tension is applied to the perforating string to cause the packing element 182 to expand into engagement with the upper bore beneath the groove 132, as shown in FIG. 23, and in a manner previously described with respect to FIGS. 7 and 8.

Upon completion of the test of the sealing integrity of the perforating sleeve, the pressure in the perforating string may be reduced to permit the piston to be moved downwardly by spring 187 to the position of FIG. 6B, thus moving the enlargement on the lower extension of the piston below the protrusion 198 on the collet fingers. In addition to lowering the pressure in the tool, the operator will relieve the tension on the work string to permit the expander ring 202 to move downwardly with the tubular body of the tool as the collet fingers return to their normally contracted positions as shown in FIG. 6B. At this time, the perforating work string may be manipulated as desired, either to engage and shift the seal and perforating sleeves with the bidirectional shifting tool BDST during a remedial procedure, or to move the trigger manipulator to a position for causing detonation of the shaped charges in the perforating sleeve of another perforating assembly.

In the event of an emergency situation in which pressure may not be removed from the inside of the perforating work string, the tension set packer may nevertheless be released by raising the work string to force the nut or ring 183 against the lower end of the expanded packing element until it shears. When the nut has sheared and dropped onto the shoulder 174 at the lower end of the body, continued raising of the string will move the expander 202 out from within the upper end of the gauge ring 180 and thus from within the inner sides 204 of the dogs on the collet fingers, and then will raise the stop ring 184 within the packing element and into engagement with the lower end of the gauge ring 180 to cause its upper end to engage with the conical shoulders on the lower ends of the collet finger dogs to urge them inwardly out of engagement with the grooves in the upper bore UB. Obviously, when the tension packer is released in this manner, it must be retrieved from the well bore for redressing—namely, replacing the sheared nut 183.

In the event, however, a leak is detected, the remedial procedure described generally in connection with FIGS. 1D–1J and illustrated and described in more detail to follow, is followed. Thus, for this purpose, the perforating work string PWS is lowered from the FIG. 1C position above described to cause the bidirectional shifting tool BDST to first engage and lower the perforation sleeve PS and then again raised to cause it to engage and lower the seal sleeve SS to cover the perforations uncovered by lowering the sleeve PS, following which its sealing integrity is tested in a manner similar to that above described in testing the sleeve PS.

As shown in FIGS. 9 and 10, the bidirectional shifting tool BDST is similar in many respects to the trigger manipulator TM. Thus, it includes a tubular body 240 which is connectable in the perforating work string PWS intermediate the trigger manipulator TM and tension set packer TSP for lowering therewith into the perforating assembly and through the seal sleeve into the perforating sleeve for engagement therewith. Windows 241 are spaced about the circumference of the body each to receive a beam 242 for guided radial movement with respect to the body, and each beam has a latch dog 243 on its outer side intermediate its upper and lower ends. A sleeve or liner 244 extends longitudinally within the body to form an annular space 245 between it and a recessed portion 246 of the bore of the body in which the ends of the beam are received.

The upper and lower ends of the sleeve 244 are surrounded by an upper piston 247 and a lower piston (not shown but identical to upper piston 247 and arranged as piston 148 of the tool TM). The inner diameters of the pistons carry O-rings 249 to form a sliding seal with the sleeve or liner, and the outer ends of the pistons carry seal rings 250 for sealing with respect to the bore of the housing. The upper piston is located in its upper position by a ring 251 releasably connected to the upper end of the piston by a shear screw 252, while the lower piston is located in its lowermost position by a similar ring (not shown) releasably connected to the lower end of the piston by a shear screw and engaging at its lower end on the lower end of the housing recess 245.

The upper piston 247 is yieldably urged to its upper position by a coil spring 255 compressed between a flange on the upper end of the upper piston and a retainer ring 256 held by a snap ring within the bore of the housing, and the lower piston is yieldably urged to its lowermost position in a similar manner, and thus, as shown in the trigger manipulator TM, by a coil spring compressed between a flange about the lower end of the piston and a retainer held by a snap ring on the bore of the housing. More particularly, holes are formed in the rings so that pressure within the housing of the tool will act across the area of each of the pistons between the inner and outer O-rings 249 and 250 to urge the upper piston downwardly against the force of upper spring 255 and urge the lower piston upwardly against the force of the lower spring.

Each of the beams is yieldably urged to its retracted position, wherein they are within the outer diameter of body 240, by bow springs 242A which are similar in structure and function as well as structural arrangement within the tool, to those of the trigger manipulator TM.

Each of the beams 242 is formed of upper and lower beam sections having their outer ends held within flanges 260 on the upper ends of the pistons, and their inner ends shaped to engage one another at their outer diameters when the beams are in their retracted positions (FIG. 9). The beams are permitted to assume this retracted position, wherein the dogs 243 are within the outer diameter of the housing, so that the tool may move freely through the perforating assemblies PA, when the pressure within the tool is relatively low such that the pistons are retained in their upper and lower positions, respectively, by the force of the coil springs.

However, as previously described, due to the orifice in the lower end of the tension packer, increased circulation of fluid downwardly through the perforating work string will increase pressure within the tool BDST, which in turn will act upon the upper and lower pistons to urge them inwardly toward one another against the force of the springs. As a result of the oppositely directed forces on the upper and lower ends of the beams, the beam sections are adapted to be bent outwardly to cause their oppositely facing ends to move into abutment with one another, as shown in FIG. 10, wherein the dogs 243 are held firmly in their expanded positions.

The beam sections also have raised portions 265 and 266 above and below the dogs to form, with the dogs 243, a profile which, with the dogs held in this outward position, and the perforating work string raised to the position shown in FIG. 24B, is received in the gap D between the lower end of the raised trigger and lower end of the extension. It will be understood in this regard that the dogs will yield inwardly, despite the fluid pressure in the bidirectional shifting tool urging them outwardly, so as to permit them to engage only the perforating sleeve whose trigger has been raised to detonate the charges, thus insuring that the perforating sleeve cannot be lowered unless this has occurred.

As the dogs 243 fit into the gap D, an abrupt shoulder 270 on the lower ends thereof engages an abrupt shoulder 271 on the inwardly projecting flange of the extension 111. Since the keys 119 have retracted, in response to lifting of the trigger, the perforating sleeve may be moved downwardly with the perforating work string in response to a relatively small downward force. Thus, as previously advised, the ring 122 and groove 123 merely serve as a detent to hold the perforating sleeve in its upper position until moved downwardly by the perforating work string.

As the perforating sleeve is moved downwardly to its lower position, as shown in FIG. 25B, the lower tapered side of the lower enlargement 266 beneath the dogs will engage a downwardly conical shoulder 272 on the upper end of the lower bore LB of the housing so as to force the dogs inwardly out of the gap, and particularly to the inside of the abrupt shoulder 271, whereby the work string with the bidirectional shifting tool is released to indicate to the operator at the surface that the perforating sleeve has been lowered. Pressure within the tool BDST may then be lowered to permit it to be, moved upwardly into engagement with the seal sleeve for the purpose of lowering it to cover the perforations which have been uncovered by lowering of the perforating sleeve.

As the bidirectional downshifting tool is raised to dispose the locking profile opposite lower groove 129 in seal sleeve, with the fluid pressure raised, the latch dogs thereof will move outwardly into the groove 129 to dispose abrupt shoulder 270 thereon opposite abrupt lower shoulder 129A on the lower groove 129. As shown from a comparison of FIGS. 26 and 27, the seal sleeve may thus be moved downwardly with the perforating work string to a position just above the lowered perforating sleeve. When so lowered, the upper and lower seal rings 124 and 125 of the seal sleeve will engage with the inside of the housing above and below the perforations, thus covering them to isolate the formation.

As the seal sleeve is lowered, the spacer sleeve 133 will move out of the groove in the upper end of the seal sleeve and then expand outwardly into engagement with the inside of the housing recess, as shown in FIG. 27. As previously described, the spacer sleeve will be held in this position by virtue of its suspension from a groove in the lower end of the top sub by means of the flange 134.

A conical surface 275 is formed on the upper end of the perforating sleeve so that, as shown in FIG. 27, it will engage with the lower enlargement 266 beneath the dogs so as to force the dogs inwardly out of engagement with the abrupt shoulder in the lower groove in the seal sleeve, thus releasing the bidirectional shifting tool for movement downwardly beneath the shifted seal sleeve. This, of course, indicates to the operator at the surface that the seal sleeve has been shifted.

As previously described, at this stage in the remedial process, the pressure in the tool BDST is lowered to permit the perforating work string to be raised to dispose the tension set packer within the upper bore whereby, upon manipulation of the work string, as previously described, the annular sealing element will be engaged with the upper bore to permit test fluid to be circulated downwardly through the perforating string in order to test the sealing integrity of the seal sleeve.

In the event this second test is also unsuccessful, it may be necessary to perform a straddle pack or a squeeze cementing job on the perforated zone before proceeding to the next perforating assembly. For this purpose and as best shown in FIGS. 28 and 29, the dogs 243 of the bidirectional shifting tool also have an abrupt shoulder on their upper sides 276 which, following testing of the sealing integrity of the seal sleeve, may be engaged with an abrupt shoulder 128A on the upper end of the upper groove 128 of the seal sleeve. This then permits the seal sleeve to be raised with the perforating work string to an upper position in which its upper end engages the lower end of spacer sleeve 133, as shown in FIG. 29, thus providing access to the perforated zone. This then is the position of the raised seal sleeve and lowered perforating sleeve shown in FIG. 1M, the seal sleeve in that case having been raised instead by the upshifting tool UST with pack-off to be described to follow.

The modified bidirectional shifting tool shown in FIGS. 11A to 17 and indicated in its entirety by reference character BDST' is, as previously described, and as will be more fully described in connection with FIGS. 31A–33B, useful in shifting a single sleeve 322 within a well conduit 320 for the purpose of opening and closing preformed ports 321 therein. It comprises a tubular body 341 connectible at its upper end to the lower end of a pipe or work string so as to permit it to be raised and lowered within the well conduit into and out of one or more vertically spaced housings in the well conduit. This pipe string may be coil tubing or in any case a thin string incapable of transmitting torque at great depths in the well. The body is closed at its lower end except for one or more orifices 342 formed therein to permit the build-up of pressure within the tubular body upon circulation of the fluids downwardly therethrough. Alternatively, the lower end of the tool body may be connected to a lower portion of the pipe string in which an orifice may be formed.

The tubular body 341 is made up of a series of tubular sections connected to one another in end-to-end relation, including an intermediate section having windows 343 formed therein at circumferentially spaced apart relation, as best shown in FIGS. 14 and 15. A series of beams 344 are mounted on the body each within a window 343 for guided movement radially between retracted and expanded positions. Thus, as shown in FIGS. 11 and 14, in their retracted positions, latch dogs 350 on the outer sides of the beams form continuations of the outer diameter of the tubular body, while in their outer positions, they extend outwardly from the body for engaging in a groove in the sleeve to be shifted, as will be described to follow.

More particularly, each is made up of a pair of beam sections 345 and 346 having their inner ends engaged with one another and their outer ends restrained against outward movement, as will be described. More particularly, each of the beam sections are disposed on the outer side of a sleeve or liner 347 which forms a continuation of the inner diameters of the end sections of the tubular body. As will be understood from a comparison of FIGS. 11B and 12B, the ends of the beam sections are so formed that oppositely disposed inward forces at their outer ends will cause them to deflect between their retracted and expanded positions of FIGS. 11B and 12B.

Latch dogs 350 are formed about the inner end of the lower beam sections and have abrupt shoulders 351 and 352 on their opposite sides. A raised shoulder 353 is formed on the upper beam section 345 near its inner end, but spaced from the shoulder 351, and the lower beam section 346 has a similar shoulder 354 formed thereon near its inner end, but spaced from the abrupt shoulder 352. When the beams are expanded, as shown in FIG. 12B, the outer diameters of the dog and shoulders 353 and 354 are essentially aligned.

As previously described, the beams are adapted to be moved from their retracted to their expanded positions in response to a predetermined increase in the pressure of the fluid within the body of the tool. For this purpose, a piston 360 is sealably slidable in the annular space between the sleeve 347 and enlarged inner diameter portion of the tubular body at the upper end of the upper beam section 345, and a piston 361 is sealably slidable within the annular space to the right of the right beam section 346. The increased fluid pressure is admitted to the annular space on the outer ends of each of the pistons through gaps at each end of the sleeve so as to cause the pistons to move inwardly toward one another and thus to exert inward forces on the ends of the beams.

More particularly, inward force is transmitted to the opposite ends of the beam sections by shear joints comprising threadedly connected tubular members 362 and 363 disposed within the annular space between the inner ends of the pistons and outer ends of the beam sections. As will be described, and in an emergency, when the beams cannot otherwise be disengaged from a groove, the threads connecting these members to one another may be sheared in response to a predetermined axial force applied to the pipe string.

As will be understood from the drawings, inward movement of the pistons in response to increased pressure will cause the outer ends of the beam sections to be moved toward one another to in turn cause the beams to deflect outwardly, as shown in FIG. 12B.

Bow springs 370 extend through slots 371 formed in the inner ends of the beam sections so as to yieldably retain them in retracted positions close to the inner sides of the liner. More particularly, the bow springs extend for a substantial longitudinal extent of an enlarged inner diameter portion 372 on the inner sides of the beam sections, and are so constructed as to normally assume flat positions. Thus, the springs provide relatively long moment arms about which a force is exerted to yieldably urge the beam sections inwardly, and thus return them to their retracted positions in response to a predetermined decrease in the fluid pressure within the body, when, for example, the sleeve has been shifted, and it is desired to move the tool to another position in the well conduit.

This modified bidirectional shifting tool BDST' is particularly useful in situations in which a so-called bidirectional impact tool is installed in the work string for activating or deactivating tools of this type in response to increases and decreases of fluid pressure in the tool itself. Thus, these impact tools operate in response to the control of fluid pressure in the string above them to transmit pulsations to the tool to be operated. Although useful in transmitting the necessary force to the tool through the pipe string, the pulsations could present a problem in that they might permit the latch dogs to move out of a groove in the shiftable sleeve.

Hence, according to the present invention, the modified bidirectional shifting tool has a means provided for dampening these pulsations, and, for this purpose, the tool body has a reduced diameter portion 375 outwardly of each of the pistons 360 and 361 and sealably engaged about the sleeve 347, and an orifice 376 is formed therein of a size to provide the desired dampening effect of the fluid acting on the outer ends of the piston. More particularly, additional pistons 360A and 361A are sealably slidable within the annular space outwardly of the orifices therefor thereby forming pressure chambers between the pistons 360 and 360A and 361 and 361A for fluid which must circulate through the orifices. The outer pistons thus serve as a barrier to debris in the body of the tool which might otherwise clog the passageways.

A one-way check valve 377 is disposed in another passageway through each portion 375 and arranged to allow relatively rapid flow into the chamber, but to prevent flow out of the chamber except through the orifices 376. Hence, although the latch dogs may be expanded outwardly into a groove relatively rapidly, any tendency for them to move out of the groove despite pulsations from the impact tool is minimized due to the orifices. A pressure relief valve 378 is also disposed within still another passageway through each portion 375 to relieve pressure in the event it became excessive.

As shown in FIGS. 30–32, housing 320 is connected in a well conduit which may be a well casing or a well tubing installed in a well. As in the perforating assemblies previously described, the housing may be installed in a horizontal section of the well which, of course, may be a substantial distance from the vertical portion of the well leading to the wellhead, and is made up of intermediate section 320A as well as end sections 320B and 320C threadedly connected in end-to-end relation. The ports 321 are formed in the housing to connect a recess 323 in the bore of the housing intermediate the inner ends of the housing sections 320B and 320C with the outside of the housing, and sleeve 322 is slidable in the recess between positions opening and closing the ports for any number of reasons, either to communicate the inside of the well conduit with the outside thereof or vice versa.

Packing 324 and 325 are carried about the outer diameter of the sleeve for disposal on opposite sides of the ports 321, as the sleeve is raised to close the ports, as shown in FIG. 31A, and to one side of the ports when the sleeve is lowered to open the ports, as shown in FIGS. 32A and 32B. The sleeve is retained in each of the positions by means of a detent 326 about its outer side disposable in a groove 327 in the housing when the sleeve is raised and in a groove 328 about the recess when the sleeve is lowered. These detents merely serve to releasably hold each sleeve in its respective position until an axial longitudinal force of predetermined value is applied thereto.

The sleeve has an upper groove 329 formed thereabout adjacent its upper end and a lower groove 330 thereabout adjacent its lower end. The groove 329 has an abrupt shoulder 329A on its upper end and a tapered surface 329B at its lower end. The groove 330 has an abrupt shoulder 330A on its lower end and a tapered surface 330B on its upper end. Thus, the abrupt shoulders 329A and 330A are opposed to one another.

In use, the shifting tool is normally lowered with the pipe string to a position within the well conduit just above or just below the sleeve to be shifted. More particularly, it is initially so located with the latches retracted, thus permitting the operator to select the sleeve to be shifted, it being understood that normally there could be a series of tubular housings in vertically spaced relation within the well conduit with sleeves installed in each. Thus, at this stage, the latch dogs would move freely through the well conduit to the desired position either just above or just below the sleeve to be shifted.

When the operator is prepared to shift the selected sleeve, he will increase circulation within the tool, and thus increase the pressure of fluid in the tool to cause the latch dogs to move to their outer positions. This, of course, will urge them against the inner diameter of the conduit so that, as the tool is moved vertically to a position opposite the groove of the sleeve, the latch dogs and one or both of the shoulders adjacent thereto will be urged outwardly into the groove.

Assuming the sleeve is to be raised to its upper position, as shown in FIGS. 30A and 30B, the tool is positioned to dispose the latch dogs opposite upper groove 329. Then, upon outward movement of the latch dogs and the lower shoulder 354 into the groove 329, the abrupt shoulder 351 on the upper sides of the dogs would be opposite the abrupt shoulders 329A on the upper groove 329, as shown in FIG. 30A, the upper shoulder 353 fitting above the upper end of the sleeve and the lower shoulder 354 being received in the groove. With pressure continuing to be held on the tool, the pipe string would then be raised to move the sleeve from its lower toward its upper position.

As the sleeve is so moved, the packings 324 and 325 straddle the port 321 and the upper shoulders 353 engage the upper end of the recess in the housing so as to cause the beams to be forced inwardly, and thus force the dogs and the shoulders inwardly out of the groove 329, as shown in FIG. 31A. The freed tool is thus free to move abruptly upwardly, indicating to the operator at the surface level that the sleeve had been fully shifted.

At this time, the operator could either continue to raise the pipe string preparatory to engaging in a groove of a sleeve in an upper housing to be shifted, or lower the pipe string preparatory to engaging in a sleeve in a lower housing so that the tool may be manipulated to either raise or lower the sleeve. Still further, in the event the operator desired to reopen port 321, the tool could be lowered with the pipe string to cause the latch dogs to be engaged in the lower groove 330 for the purpose of shifting the sleeve back to its lower position. Obviously, this subsequent shifting could occur after a considerable time lapse, and, in fact, after shifting one or more of the other sleeves.

In any case, upon shifting of the sleeve to the upper position, the latches are unable to move outwardly into a gap or space between the upper end of the sleeve and the end of the recess in the housing. Consequently, raising of the tool within the sleeve will permit the latches to be moved outwardly only into the lower groove 330 in preparation for shifting the sleeve to its lower position.

As in the case of the above described shifting of the sleeve upwardly, the fluid pressure in the tool would be increased, as the tool was moved to a position in which the latch dogs were opposite the groove 330, whereby they and upper shoulders 353 would be moved outwardly into the groove and the lower abrupt shoulders 352 on the dogs engage the oppositely facing shoulder 330A of the sleeve. Then, of course, as will be understood from FIGS. 32A and 32B and 33A and 33B, downward movement of the tool with the work string would shift the sleeve from its upper to its lower position. Again, as was true in the case of shifting of the sleeve to its lower position, this downward movement of the tool would cause the raised shoulder 354 to engage the shoulder on the lower end of the recess in the housing, thus retracting both the dogs and shoulders to force the bow springs inwardly, to the position shown in FIG. 33B, at which time the continued downward force on the tool body would cause the freed latch dogs to move downwardly quickly with the body, thus indicating to the operator that the sleeve had been shifted.

Assuming that, for whatever reason, such as locking of the pistons, the inward urging of the bow springs was not effective to retract the latches despite the decrease in fluid pressure, a vertical strain on the pipe string would shear the threads 364 between one set of the tubular members 362 and 363, thus permitting the beams to move in the direction of the application of force. As this occurs, the outer sides of the beams slide over tapered surfaces 343A on the ends of the windows, so as to urge the latch dogs to return to their retracted positions to permit retrieval of the shifting tool. As illustrated, this shearing has occurred between the lower tubular members 362 and 363, although it obviously could occur between the other set.

Assuming that the perforating sleeve did not leak, and the remedial procedure described above in connection with FIGS. 1D–1G was unnecessary, or, alternatively, that there was no leak during the remedial procedure, the operator would next follow the procedure illustrated and described in connection with the treatment work string in FIGS. 1H–1P. In particular, the operator would replace the perforating work string PWS with the treatment work string TWS for the purpose of first shifting the perforating sleeve PS downwardly to its lower position, as shown in FIGS. 1H and 1I, and then lowering the seal sleeve to its lower position, as shown in FIGS. 1J and 1K, using the downshifting tool DST shown in these figures.

The downshifting tool is shown in FIGS. 34A and 34B in its unarmed position to permit it to be lowered with the upshifting tool through the lowermost perforating assembly prior to being raised into engagement with the perforating sleeve in order to lower it, as shown in FIGS. 1H and 1I. The downshifting tool DTS comprises a tubular body 400 adapted to be connected as part of the treatment work string TWS at a position spaced above the upshifting tool UST. The body has a first reduced outer diameter portion 401 which is surrounded by a latch 402 comprising a collar 403 at its lower end supported by shoulder 404 about the body, and a collet having fingers extending upwardly from the collar and whose upper flanged ends form latch dogs 406 adapted to engage and raise each of the perforating and seal sleeves, as will be described to follow.

In the unarmed position of the tool, the latch dogs are held inwardly out of their normally outward positions by means of a retainer 408. More particularly, the retainer has a sleeve 409 about its upper end which, in its raised position, surrounds the enlarged upper ends of the collet fingers of the latch to hold the latch dogs inwardly, and collet fingers 410 which extend downwardly from the sleeve 409 for connection at their lower ends to a collar 411 releasably secured to the body by means of a shear screw 412. The collet fingers 410 have upper and lower internal protrusions 413 and 414 which, with the retainer fixed to the body in its raised position, engage enlarged outer diameter portions 415 and 416, respectively, of the tubular body to hold the collet fingers 410 of the retainer spaced from the body.

The outer sides of the collet fingers 410 have profiles 417 formed thereabout which, as will be described to follow, are adapted to engage in the matching profile formed by the grooves 130, 131 and 132 in the upper bore UB of the perforating assembly housing. More particularly, and as shown in FIG. 35B, the profile 417 includes an abrupt shoulder 420 which, when opposite the profile in the upper bore, as shown in FIG. 35B, will engage the abrupt shoulder 131A in the groove 131 to limit further upward movement of the retainer.

Consequently, continued upward movement of the latch dogs 402 with the work string, as shown in FIGS. 36A and 36B, will shear the screw 412 to permit the tubular body and latch dogs to move upwardly with respect to the retainer, thus permitting the enlargements including the fingers 406 on the latch to move above the upper end of the sleeve of the retainer, and thus move outwardly to a "disarmed" outer position, as shown in FIG. 36A. A flange 421 on the upper end of the reduced outer diameter portion of the body is positioned to limit outward expansion of the latch dogs.

As the body is raised relatively to the retainer, the upper protrusions 413 on its inner side moves opposite a further reduced diameter portion 422 of the body, and the lower protrusion 414 moves into a groove 423 about the body beneath the enlarged portion 416 thereof. As shown, the lower protrusion has an upwardly facing abrupt shoulder engagable with the downwardly facing abrupt shoulder on the groove 423 to lock the retainer in its lowered position of FIGS. 36A and 36B. At this time, the profiles 417 on the retainer collet fingers are free to flex inwardly toward the reduced outer diameter portion 422 of the body tool, and thus, in response to downward movement of the retainer with the remainder of the tool and the stimulating work string, move out of the grooves in the upper bore.

Thus, as shown in FIGS. 37A and 37B, the now armed tool may be lowered with the treatment work string to dispose the latch dogs 406 on the latch opposite the gap between the lower end of the raised trigger and the upwardly facing shoulder on the lower end of the sleeve extension 111. As previously described in connection with the operation of the bidirectional shifting tool, the latch dogs are of such size that they would be unable to move into the gap A between the trigger and the extension unless the trigger had been raised. In like manner, the latch dogs are of such size as to prevent their moving into the gap between the lower end of the raised seal sleeve and raised perforating sleeve as long as both the seal sleeve and perforating sleeve are in their upper positions as the work string is so lowered.

The enlargements on the upper ends of collet fingers have shoulders 406 beneath the latch dogs which fit below the extensions, so that abrupt shoulders 424 on the latch dogs are free to move into the gap to dispose the shoulders opposite the abrupt shoulder on the lower end of the extension 111. Thus, continued lowering of the tool DST with the work string will lower the perforating sleeve from the upper position of FIG. 37B to the lower position of FIG. 38B. AS the sleeve is moved into its lower position, the shoulders 424 on the collet fingers beneath the latch dogs will engage the conical surface on the upper end of the lower bore LB of the body to move them out of latching engagement with the abrupt shoulder on the lower end of the extension perforating sleeve, thus indicating to the operator that the perforating sleeve has been lowered.

At this time, the work string is again raised to raise the downshifting tool DST to a position in which the shoulders 424A are free to fit beneath the lower end of the sleeve to permit the latch dogs 406 to move outwardly to engage with the upwardly facing abrupt shoulder on the lower end of the groove 129 in the lower end of the seal sleeve, as shown in FIG. 39A, whereby the tool may be lowered with the work string to in turn lower the seal sleeve into its lower position just above the already lowered perforating sleeve, as shown in FIG. 40B. As the seal sleeve is lowered into this position, the shoulders 424A beneath the latch dogs will engage the conical shoulder on the upper end of the perforating sleeve to move the latch dogs out of latching engagement with the lower seal sleeve, thus indicating to the operator that the seal sleeve has also been lowered to its lower position. As will be understood, if the perforating sleeve was not lowered first, the latch dogs could not engage within the groove 129 in the seal sleeve, since the shoulders are too large to enter the gap which would be formed between the lower end of the seal sleeve and the upper end of the perforating sleeve.

As previously described, in connection with manipulation of the bidirectional shifting tool BDST during a remedial operation, this lowering of the seal sleeve will release the spacer sleeve 133, which, as shown in FIG. 40A, is supported at its upper end from the lower end of the upper bore of the housing.

Upon lowering of the seal sleeve to its lower position, as above described in connection with FIGS. 1J and 1K, and release of the downshifting tool DST therefrom, as described in connection with FIG. 1L, the upshifting tool UST, which is installed in the treatment work string TWS below the downshifting tool DST, is manipulated by the string in such a way as to raise the seal sleeve SS to its upper position of FIG. 1M, thereafter pack-off within the seal sleeve to permit the perforated zone, uncovered by raising of the seal sleeve, to be treated, as indicated diagrammatically in FIG. 1M, and then to lower the seal sleeve into its lower position, as shown in FIGS. 1M and 1N, following which it is released therefrom, as shown in FIG. 10, to permit retrieval of the work string, as shown in FIG. 1P. As will be understood from the following description of the detailed construction of the tool, and its cooperation with the perforating assembly, and in particular the seal sleeve, and as illustrated in FIGS. 41 to 50, it is adapted to be lowered first through any number of casing conveyed perforating assemblies to a position beneath the lowermost perforating assembly, as previously described, and then following the operations above described, raised to an assembly thereabove to perform similar operations.

The construction of the tool and seal sleeve are such that the tool will anchor and pack-off only within the seal sleeve, and then only if the perforating assembly has been perforated, and both the perforating sleeve and seal sleeves have been shifted to their lower positions. The tool is shifted between anchoring and bypass modes in response to lowering and raising of the tool through a restriction in the perforating assembly, and, once anchored within the seal sleeve, it will not release therefrom until the seal sleeve has been lowered to a position to isolate the perforated zone.

Thus, with the upshifting tool UST beneath the shifted sleeves, as shown in FIG. 1L, raising of the work string will cause the tool to engage its latch dogs in the upper groove of the seal sleeve, whereupon continued upward movement of the work string will raise the seal sleeve into engagement with the released spacer sleeve 133. As previously mentioned, the spacer sleeve creates a gap between the upper end of the seal sleeve and lower end of the upper bore UB of the body of the perforating assembly which is the only space or configuration which will receive shoulders above the latch dogs. Continued upward force will mechanically lock the latch dogs in the groove of the seal sleeve and then cause a packing element thereof to be sealed off in the bore of the seal sleeve, whereby the formation may be treated as by fracturing, acidizing or proppants and other stimulation fluids pumped down through the work string and into the now uncovered perforated zone. Following the treatment process, resin-coated sand is typically pumped into the formation, but stopped before all of the fluid is pumped.

The work string may then be lowered to close the zone, preferably with the assistance of a downward force due to pressure applied to the annulus between the work string and the well casing. Lowering of the seal sleeve will automatically release the latch dogs of the tool from the seal sleeve, thus indicating to the operator at the surface that the seal sleeve has been fully shifted. At this time, the underdisplaced resin may be reversed circulated out of the well before it cures and blocks the well bore. The upshifting tool UST may be then raised with the work string with no effect on the perforating assembly, inasmuch as the latch is prevented from engaging the seal sleeve until the next time the tool is lowered through a restriction, as will be described to follow.

As shown in the above described drawings, the upshifting tool UST comprises a tubular body 500 adapted to be installed in the work string for raising and lowering therewith, and a housing which includes a tubular member 501 at its upper end surrounding the tubular body in spaced relationship thereto and a collet assembly 502 at its lower end having collet fingers with latch dogs 503 on their lower ends adapted to be engaged in the upper groove 128 of the seal sleeve (see FIG. 44D). The collet fingers are so constructed that the latch dogs 503 normally assume the contracted position shown in FIGS. 41C and 42C wherein they are disposed closely about a reduced outer diameter portion 504 of the tubular body.

The tool further includes a pack-off assembly comprising a body 505 having ports 506 formed therein and an annular packing element 507 carried at its lower end. The pack-off assembly body is suspended from the latch dogs on the lower end of the collet assembly for limited vertical reciprocation with respect thereto and carries an O-ring 508 about its lower end which is sealably slidable over the outer diameter of the tubular body 500. The body 505 of the pack-off assembly closely surrounds an expander ring 509 fixedly mounted about the tubular body beneath the latch dogs 503, and, in the raised position of the assembly, the lower end of the packing element 507 is above a nut 510 threaded to the tubular body and affixed thereto by means of a set screw 511.

Figure 47A:
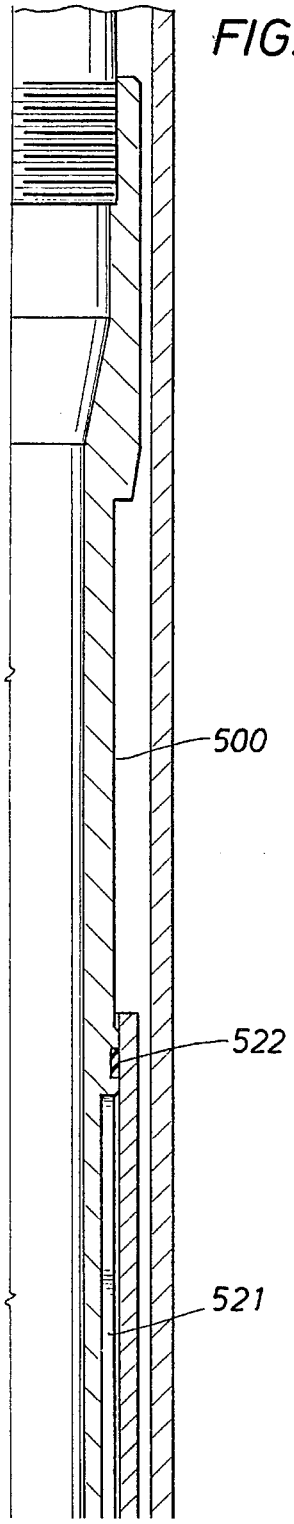
Figure 47B:
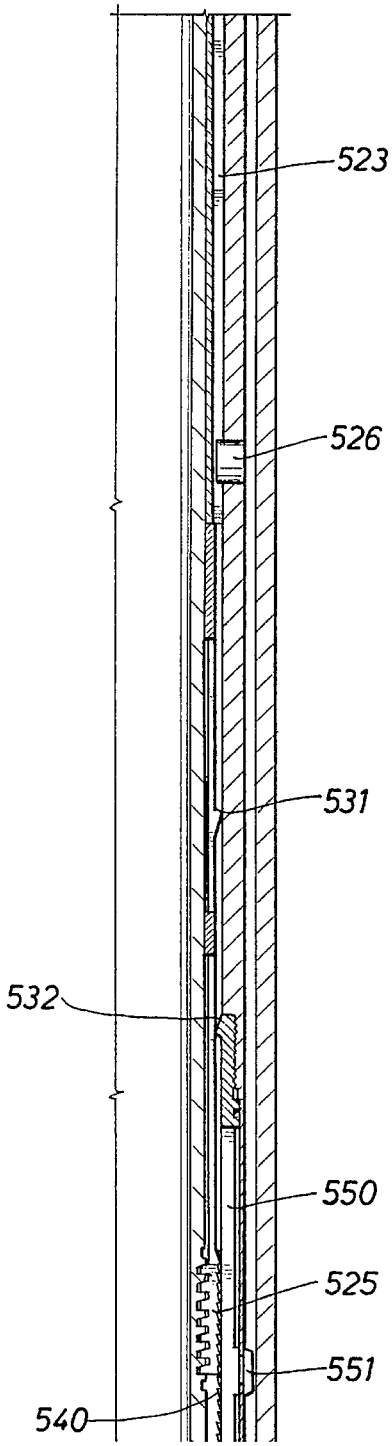
Figure 47A:
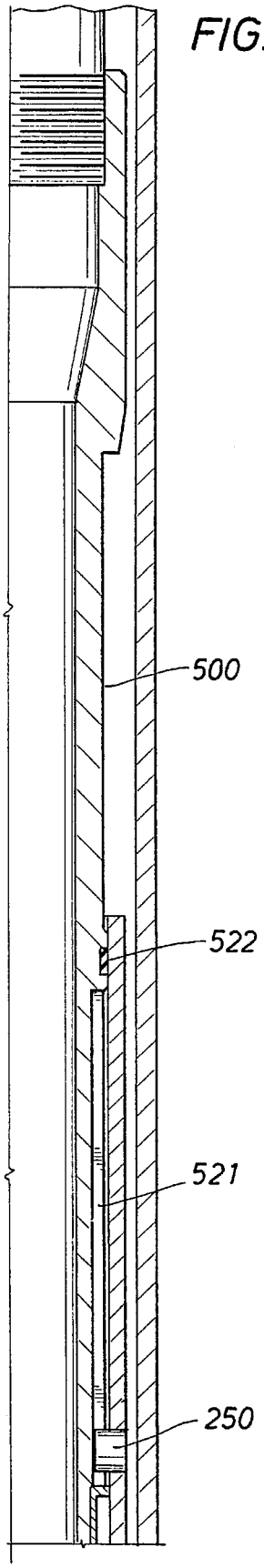
Figure 47B:
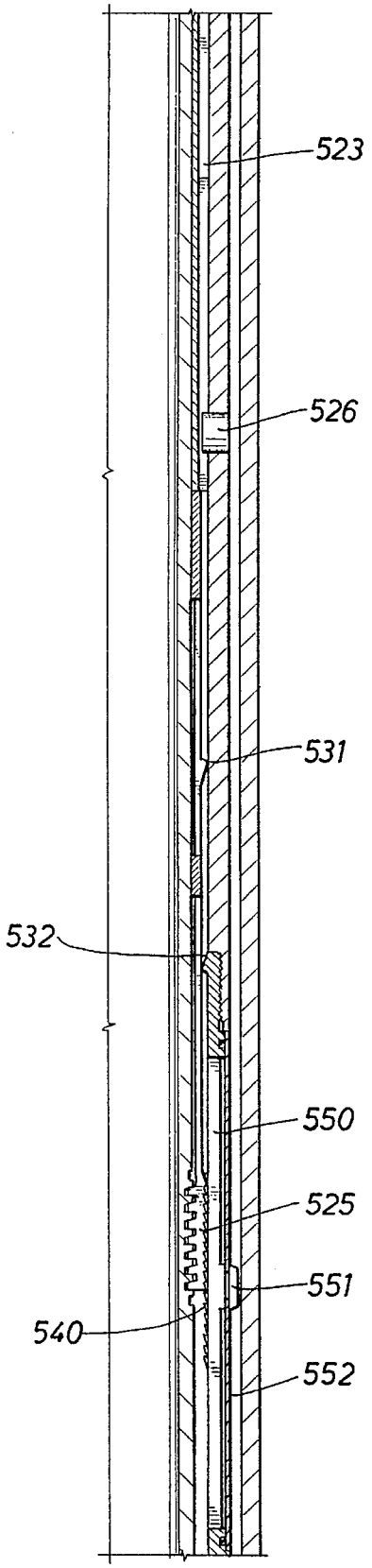
Figure 47C:
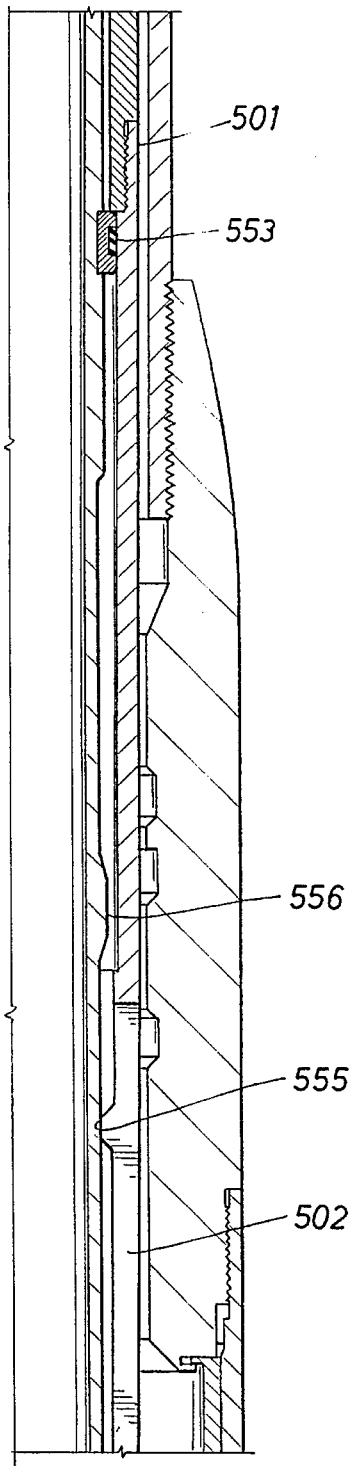
Figure 47D:
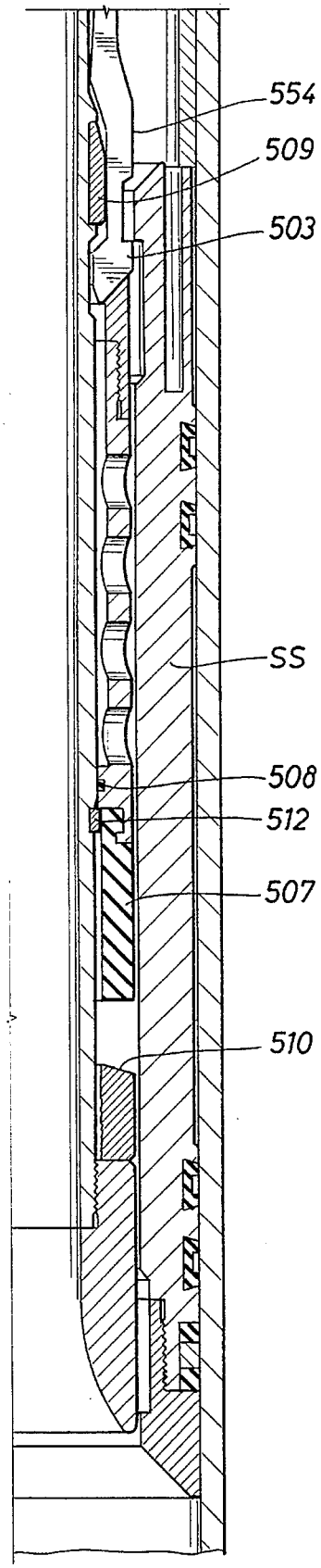

As will be described to follow, it may be necessary to shear the nut when the packer has been expanded, but cannot be otherwise released to permit retrieval of the tool from the assembly. As shown, the shear nut 510 is spaced above a collar about the lower end of the tubular body so that, upon shearing of the threads connecting it to the tubular body, it may be supported on the collar. There is another ring 512 about the tubular body above the nut 510 which is adapted to fit within the packing element 507 so as to engage by the lower end of the tubular body on which the packing element is suspended, as shown in FIG. 47D, in the event of an emergency release.

Figure 41C:
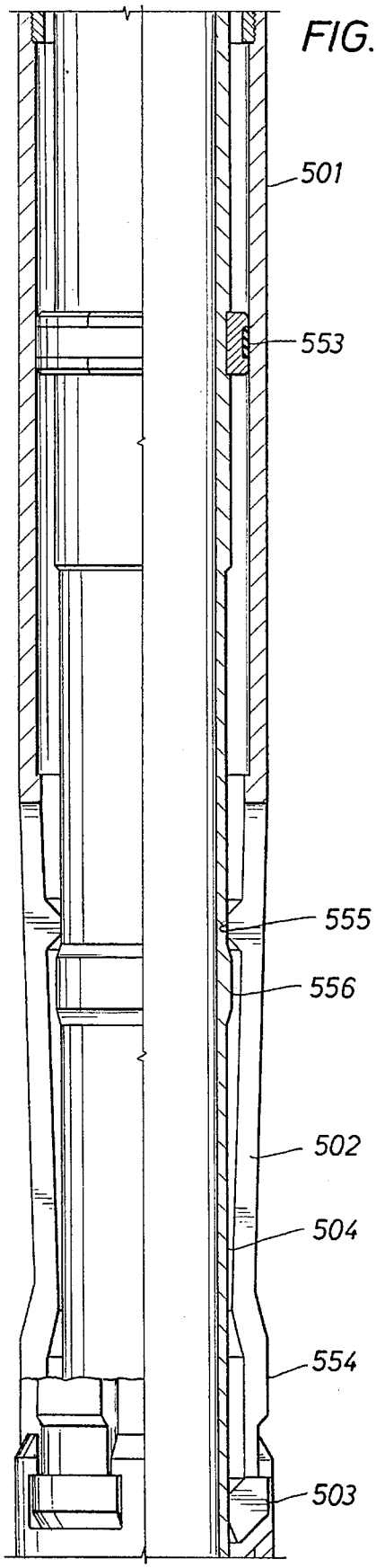
Figure 41D:
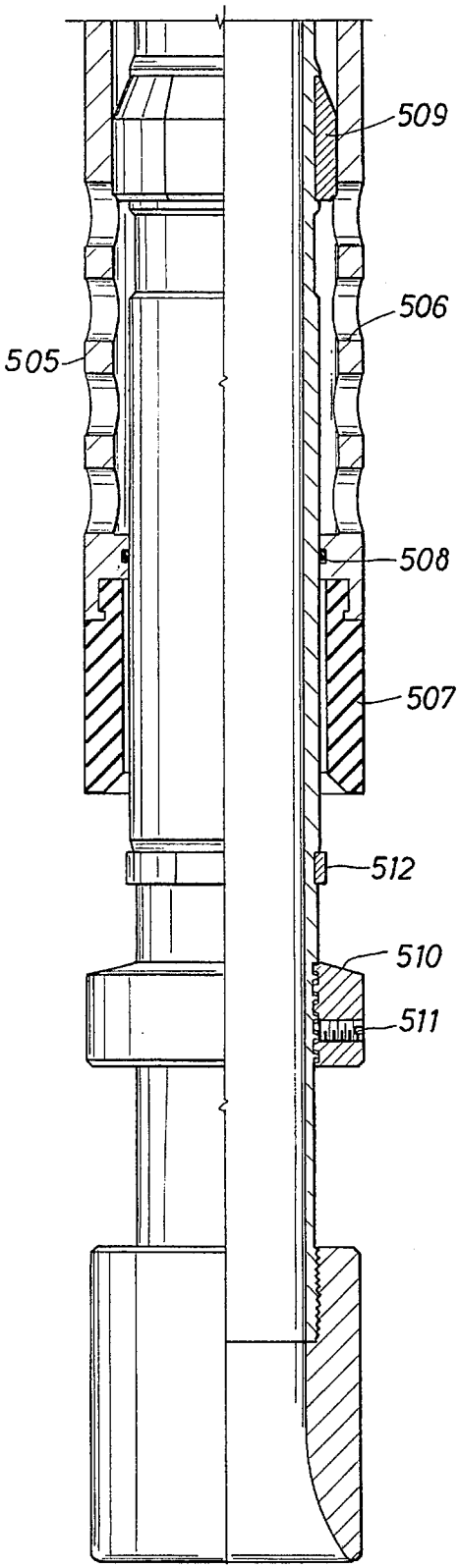

The packing element 507 and body 505 are supported from the latch dogs in much the same manner as the packing element 182 of the tension set packer TSP, as shown and described in connection with FIG. 6B. Thus, as shown in FIG. 41C, the latch dogs 503 are received within inverted "T" slots about the upper end of the body, which permit the latch dogs to move laterally or radially as well as vertically with respect to the body. Also, the lower ends of the T-slots and latch dogs are conically shaped to urge the latch dogs inwardly when moved downwardly from an upper to a lower position with respect thereto, as shown in FIG. 47D.

The tubular member of the housing carries one or more pins 520 received within vertical grooves 521 formed in the outer diameter of the tubular body so as to prevent rotation between the housing and the tubular body. There is a seal ring 522 carried about the tubular body above the groove 521 to prevent the entry of debris into the groove.

A "J" sleeve 523 is received within the annular space between the tubular member of the housing and the outer diameter of the tubular body beneath the grooves 521. The "J" sleeve is rotatable with respect to both the tubular body and housing, but is held in a fixed longitudinal position with respect thereto beween a shoulder about the body adjacent the lower ends of the grooves 521 and a lock collet 524 within the same annular space generally opposite a sensor sleeve of the housing, which is connected as part of the tubular member 501 of the housing above the collet assembly. The lock collet 524 is in turn held in a fixed vertical position by a body lock ring 525 at its lower end which engages grooves about the outer diameter of the tubular body, as will be described to follow.

The tubular member of the housing carries another pin 526 which is slidably received within a pathway 527 formed about the outer diameter of the "J" sleeve. As best shown in FIG. 50, and as will be described to follow, the pathway extends about the entire circumference of the "J" sleeve and is so formed as to closely receive the pin 526. More particularly, the pathway has a configuration which includes upper and lower shoulders at the ends of slots of the pathway which are engaged by the pin, responsive to relative vertical reciprocation between the body and housing, in order to determine their relative vertical positions during various stages of manipulation of the upshifting tool. As will be described to follow, the pathway also includes slanted surfaces connecting the slots to guide the pin from one slot to the other.

The upper portion of the lock collet 524 has milled slots 530 with protrusions 531 formed thereabout opposite the inner diameter of the sensor body (see FIG. 41B). The sensor sleeve, in turn, has an inwardly extending restriction 532 at its upper end which, as will be described to follow, forms a detent with the protrusion 531 which is releasable when the two are required to move longitudinally past one another. The lower portion of the lock collet 524 has collet fingers 535 formed thereon which are of such construction as to be urged outwardly against the inner diameter of the sensor sleeve. As also shown in FIG. 41B, the body lock ring 525 at the lower end of the collet finger comprises internal threads 537 thereabout which engage with radial clearance external threads 538 about the adjacent outer side of the tubular body. More particularly, the lower sides of the threads are essentially horizontal, while the upper sides thereof are tapered and spaced from one another to permit the ring to move radially inwardly and outwardly with respect to the body.

Relatively fine threads 540 are formed about the outer diameter of the collet fingers of the body lock ring generally opposite the larger threads 541, and matching threads 541 are formed about the inner diameter of the sensor sleeve for engaging with those of the body lock ring when the ring and housing are moved longitudinally with respect to one another so as to prevent upward movement of the housing with respect to the lock ring and, thus, the tubular body. However, for reasons to be described, the radial play between the larger threads enables the finer threads 540 and 541 to be moved past one another so as to permit such movement when the lower end of the body lock ring is moved radially inwardly with respect to the tubular body.

Figure 46A:
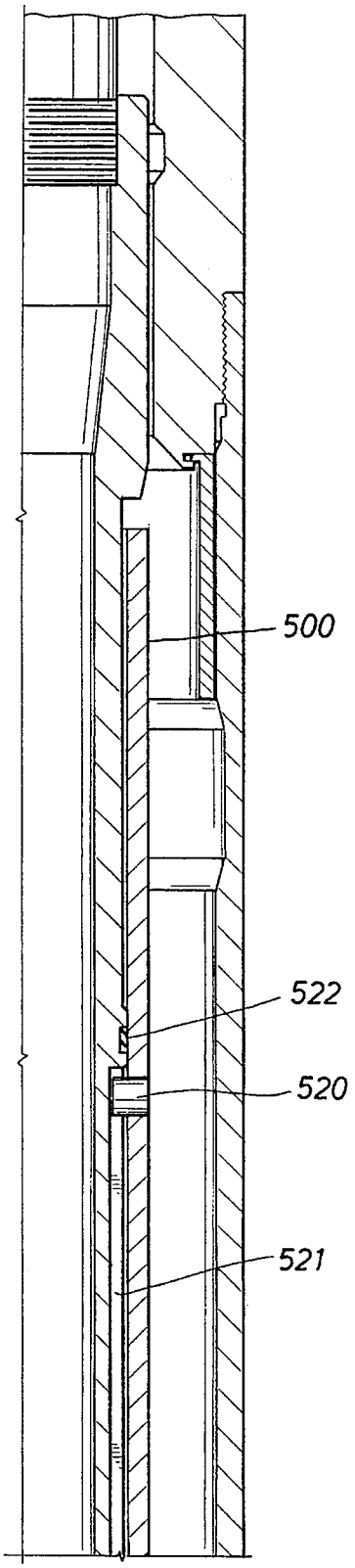
Figure 46B:
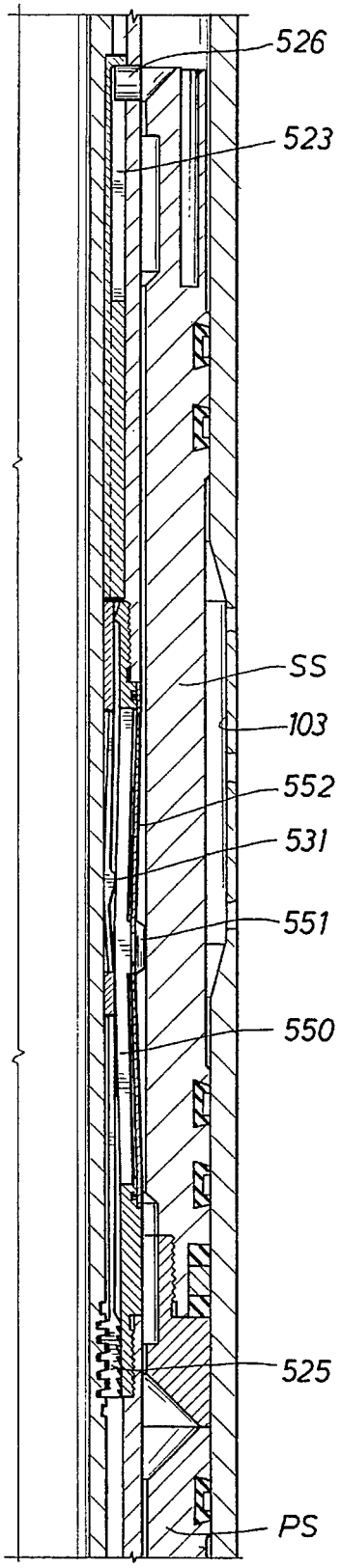
Figure 46C:
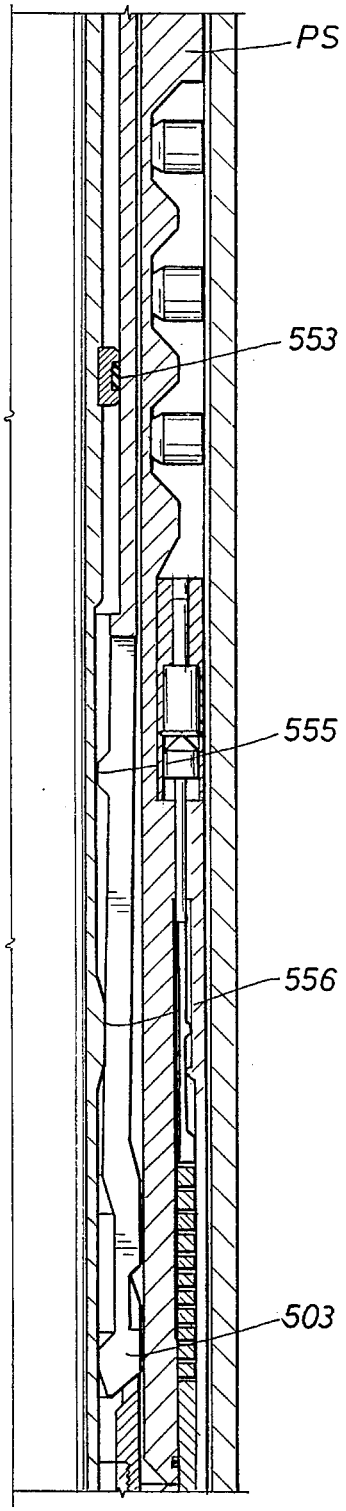
Figure 46D:
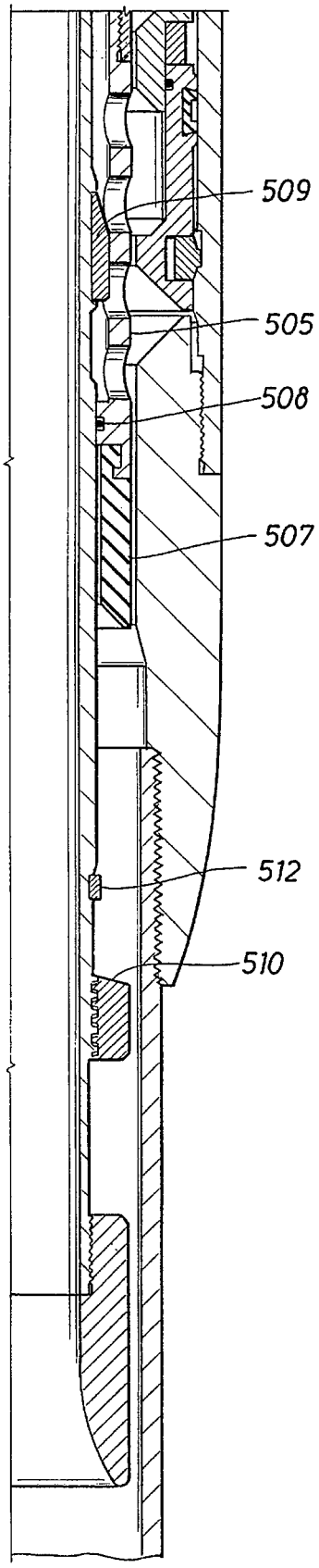

The sensor sleeve has longitudinal slots 550 which form beam springs, and the threads 541 are formed on the inside diameters of only alternate beams. Sensor buttons 551 are, in turn, connected to the other unthreaded beam springs so that when radially deflected inwardly, in response to engagement of the sensor buttons 551 with a restricted bore, as shown in FIGS. 46B and 49, they disengage the threaded beam springs from the external threads 538, and thus release the housing for relative longitudinal movement with respect to the tubular body.

A diaphragm 552 is carried by the housing about the beam springs and sealably engaged at its ends with the housing above and below the beam springs. The sensor buttons 551 extend through the diaphragm and are threadedly secured to the sensor sleeve to mount them thereon as well as to clamp the diaphram in position. The diaphragm is thus held in sealing engagement with respect to the sensor body to prevent well debris from entering the space within the tool between the seal ring 522 and a lower seal ring 553 carried about the body beneath the sensor sleeve.

The lower seal ring is carried in a ring 553 which is split to permit it to be mounted in a groove on the outer diameter of the body. The split in the ring allows a minor amount of well fluids to enter or exit the space defined between it and the upper seal ring 522 so as to compensate for changes in hydrostatic pressure and temperature on the fluids which would otherwise create pressure variations within the space. The sealing diameter of the seal rings is essentially the same, so that there is little or no displacement of fluid within the space upon relative vertical movement between the housing and tubular body.

As will be described to follow, the sensor buttons 551 extend radially outwardly to an extent in which they create frictional drag force when raised or lowered through a reduced diameter in the perforating assembly. As shown in FIGS. 42A through 42D, and as will also be understood from the description to follow, this provides a yieldable force which restrains the housing against vertical movement to permit the body to move to different vertical positions with respect thereto, as determined by rotation of the sleeve to alternately higher or lower limiting positions. In these cases, as well as in other cases in which the sensors pass through restrictions, they will, following passage, return to their outer positions shown in FIGS. 41A–41D. On the other hand, in another instance, as will also be described to follow, and as shown in FIGS. 45A–45D, depression of the sensor buttons as they pass through a restriction in the upper bore UB of the assembly housing releases the engagement of the threads 544 on the sensor body with threads 538 on the body lock ring to permit downward movement of the body with respect to the housing, as shown in FIGS. 46A–46D.

As previously noted, the latch dogs 503 on the lower ends of the collet fingers 502 are of such construction that they are normally urged inwardly against the outer diameter of the tubular body. Also, there are enlargements 554 in the form of shoulders on the outside of the collet fingers above the latch dogs which, as will be described to follow, prevent the latch dogs from engaging with any part in the assembly except the upper groove 128 of the seal sleeve SS, so that the sleeve may be raised to an upper position, as shown in FIGS. 44A-44D, determined by the spacer sleeve, which has been released upon prior lowering of the seal sleeve, to create a vertical space to receive the shoulder 554. In this way, the shoulders are kept from engaging the lower end of the upper bore UB which would otherwise release the latch dogs as the sleeve is so raised, against as shown in FIGS. 44A–44D.

On the other hand, the inner diameter of the collet fingers are recessed above the latch dogs in order to facilitate release of the latch dogs from the seal sleeve in response to movement of the exapnder rings 509 from the inner diameters thereof (see FIG. 47D). As will also be described to follow, in connection with emergency release of the pack-off, the pick-up ring 512 carried on the outer diameter of the tubular body serves to lift the body 505 and thus cause the upper tapered end thereof to force the latch dogs to move out of engagement with the groove in the seal sleeve when the tubular body is elevated with respect to the housing.

Figure 43A:
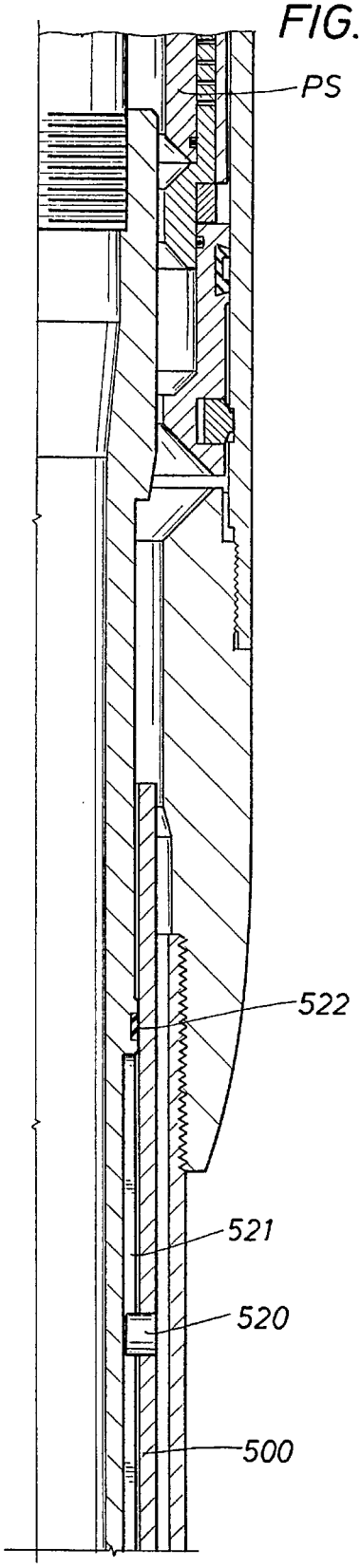
Figure 43B:
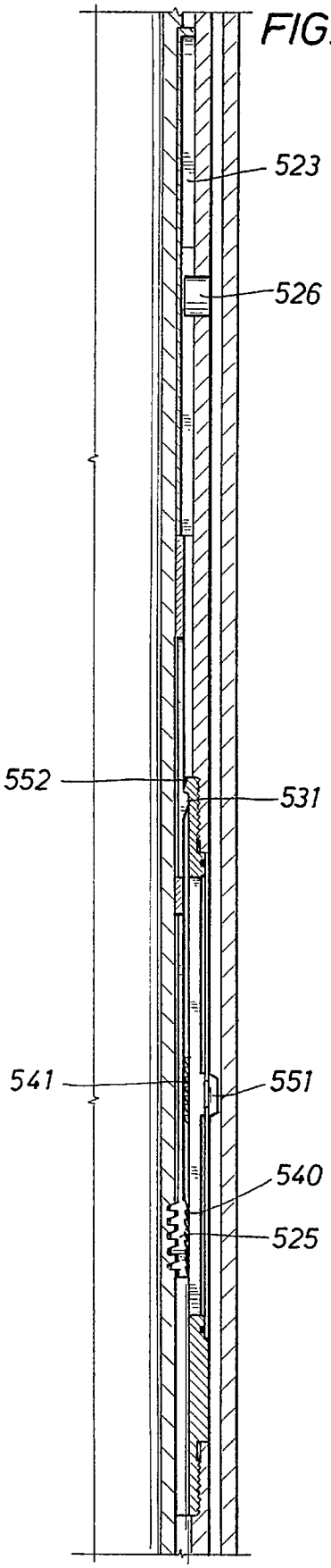
Figure 43C:
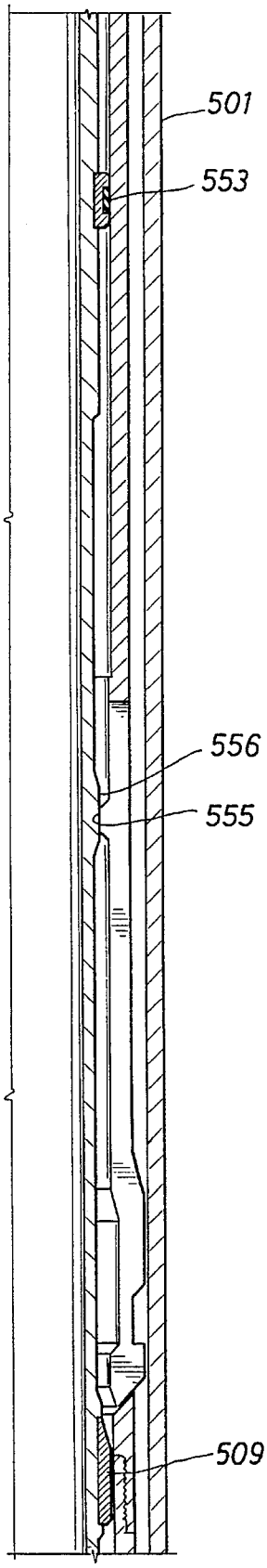
Figure 43D:
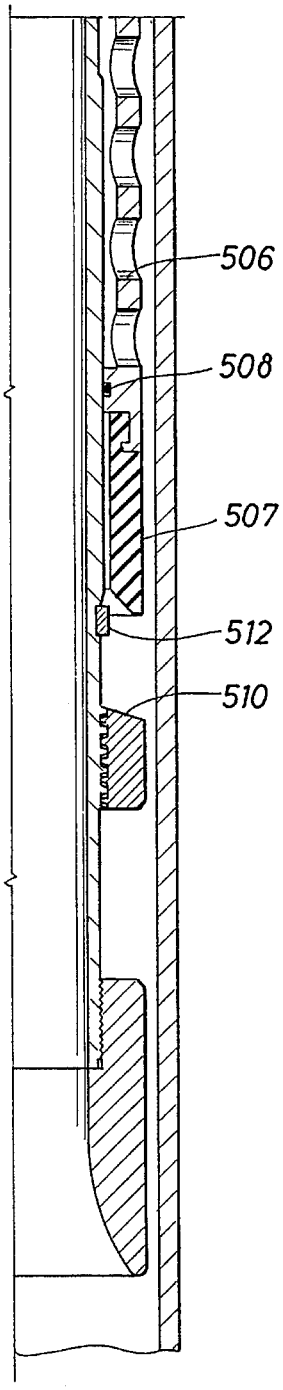

There is an internal protrusion 555 of the inner diameters of the collet fingers near their upper ends so as to enable the collet fingers to be radially expanded as the protrusion is moved longitudinally over the enlarged diameter portion 556 on the outer diameter of the tubular body, as will be understood from a comparison of FIGS. 41C and 43C.

In the position shown in FIGS. 41A to 41D, the tool is in its bypass mode wherein the tubular body has been raised with respect to the housing so that the pin 526 carried by the housing is engaged with a shoulder at the lower end of the vertical slot 560 in the pathway formed in the "J" sleeve, as shown at A in FIG. 50, so as to support the housing from the tubular body. In this mode, the tool may be elevated through a previously downshifted seal sleeve without engaging in the upper groove 128 thereof, because the collet fingers and thus the latch dogs are retracted and the packing element is contracted to its normally unexpanded position. Thus, the tool may be elevated through any number of restrictions within the perforating assembly without changing the relative positions of the tubular body and housing.

As shown in FIGS. 42A and 42B, the upshifting tool UST has been lowered on the stimulation work string through any number of restrictions, during which the friction resistance of the sensor buttons in the restrictions in the assembly permits the body of the tool to move downwardly with respect to the housing, whereby pin 526 slides over slanted surface 560A above slot 560 in the pathway as the "J" sleeve moves downwardly with the body until the shoulder at the upper end thereof engages with the upper end of the pin 526, as shown at B in FIG. 50. In this relative position of the tubular body and housing, the latch dogs and packing element are still contacted, and lowering through restrictions in the perforating assembly will only cause the sensor buttons to create minor frictional resistance.

Figure 42C:
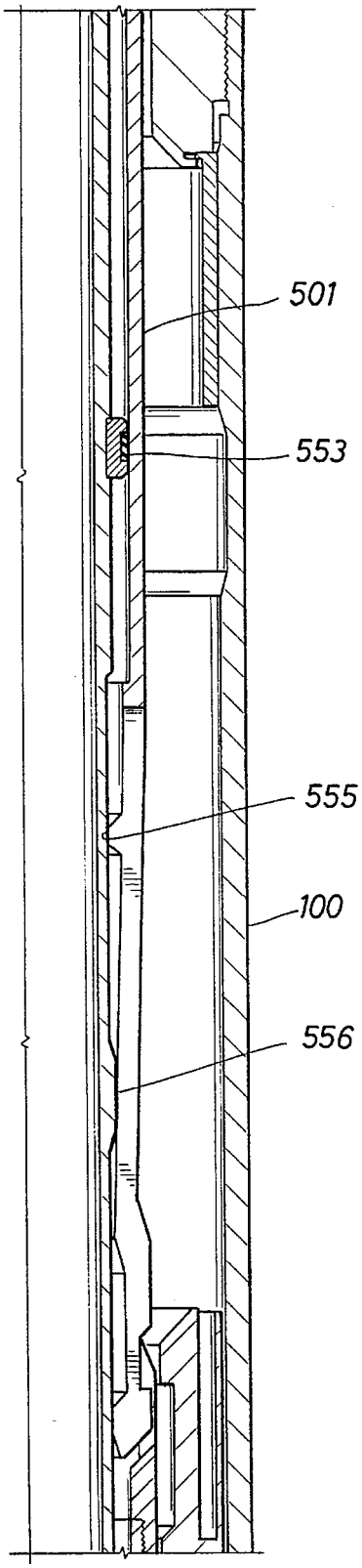
Figure 42D:
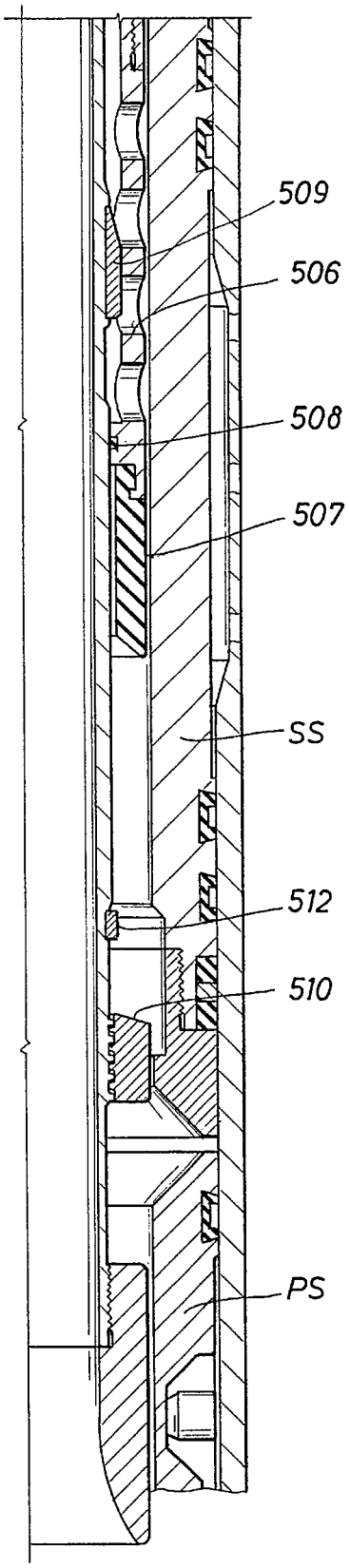

However, as the tool is raised to the position shown in FIGS. 42A to 42C, following lowering through the lowermost assembly, the tubular body has moved upwardly relative to the housing so that the pin 526 moves downwardly onto slanted surface 565A for sliding therealong into slot 565 and into the position shown at C in FIG. 50 until the protrusion 531 moves into engagement with the detent shoulder 552 on the inner diameter of the lock collet thereby releasably holding the body against further upward movement with respect to the housing. In this position, the enlarged diameter portion 556 on the tubular body will move beneath the inward protrusion 555 on the upper ends of the collet fingers to force the latch dogs 503 on the lower end of the collet fingers outwardly, whereby the outer surfaces of the latch dogs are positioned to drag through the restrictions of the perforating assembly. The packing element, however, is still in its contracted position.

Continued lifting of the tool will cause the latch dogs to snap into the upper groove 128 of the seal sleeve SS, as shown in FIG. 44D, following which further elevation of the stimulation work string, with the latch dogs engaged with the upper groove of the seal sleeve, will first release the detent formed by parts 531 and 532 and then raise the seal sleeve to its upper limited position, as shown in FIGS. 44A to 44C, wherein it engages the spacer sleeve and opens the perforations.

Continued upward movement of the body with the work string causes teeth 540 on the inner side of the lock ring to engage the teeth 541 formed on alternate spring beams of the sensor sleeve, thus preventing retrograde or downward movement of the body with respect to the housing, as shown in FIG. 44B. At the same time, the enlargement 556 has moved out from under the enlargement 555 on the collet fingers (FIG. 44C).

Continued upward force on the work string will raise the nut 510 into engagement with the lower end of the packing element 507 so as to compress it into its expanded position for sealing within the bore of the seal sleeve intermediate the upper and lower grooves therein, as shown in FIG. 44D. At this stage, all hydraulic forces associated with pressurizing internal to the work string are transferred directly to the seal sleeve and not to the threads on the inner diameter of the shear nut. This, of course, stems from the fact that the sealing surface of seal ring 508 is of essentially the same size as the internal surface of the work string.

As will also be noted from FIG. 44D, raising of the tubular body to this position will also move the expander sleeve 509 into a position inside of the latch dogs so as to lock them within the upper groove of the seal sleeve. Due to the engagement of the ratchet teeth on the sensor body and the lower end of the collet lock, the expander sleeve is unable to move further in an upward direction and thus past its position holding the latch dogs in locking position. At this stage, the pin 526 has moved further downwardly within slot 565 to the position at D in FIG. 50. Due to the expansion of the packer, the tubular body cannot be moved further upwardly, so that the latch dogs remain locked in latching position.

At this time, the treatment fluid may be circulated downwardly through the work string and into the opened perforated zone. Following the stimulation procedure, the work string is lowered to move the seal sleeve back to its lower position just above the lowered perforating sleeve, as shown in FIGS. 45A–45D. Preferably, however, downward movement is assisted by a force due to fluid pressure applied to the annular space between the tubular body and inner diameter of the seal sleeve above the packer and thus the cross-sectional area of the seal sleeve.

Near the end of the downward movement of the seal sleeve, the sensor buttons will move into a restricted portion of the upper bore UB of the housing of the perforating assembly above the groove profiles therein, as shown in FIG. 45B. This radial depression of the buttons will disengage the lower end of the lock collet from the threaded beam springs of the sensor body, such that continued downward movement of the work string will cause the enlarged diameter of the upper end of the lock collet to move past the inward restriction about the sensor body. Thus, the bevels of the detent are designed such that their yieldable holding force is overcome by the frictional force of the outwardly urged sensor buttons.

Upon this further downward movement of the tubular body, the pin 526 will move upwardly within the slot 565 of the pathway along a slanted surface 570 of the pathway to guide it into engagement with another shoulder at the upper end thereof, as indicated at B' in FIG. 50. Thus, subsequent raising of the body with the stimulation string will cause the pin to move downardly along slanted surface 571 into engagement with the shoulder at the lower end of slot 571A, as indicated at A' in FIG. 50, whereby the tubular body and housing are returned to their relative longitudinal positions previously described in connection with FIGS. 41A–41D.

If, for any reason, the upshifting tool cannot be lowered to disengage from within the upper groove of the seal sleeve, the operator may follow the emergency release procedure by pulling an upward strain on the work string in excess of the shear value of the shear nut 510. As shown in FIGS. 47A to 47D, this allows the tubular body to be moved upwardly relative to the housing, and thus the latch dogs, so that the expander sleeve is raised from within the latch dogs. At the same time, the shear nut falls onto the shoulder on the upper end of the collar at the lower end of the tubular body, and the pickup ring 512 is raised into engagement with the upper end of the packer assembly body to raise it to a position in which the tapered surface on its inner end will positively cam the similarly tapered surfaces on the lower ends of the latching dogs 503 inwardly and out of the groove 128 in the seal sleeve, thus overcoming any friction that might exist between the latch dogs and the groove.

In this position, the latch dogs are free to contract inwardly so as to permit retrieval of the upshifting tool from within the well. Obviously, before reusing, it will be necessary to redress the upshifting tool.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for use in perforating one or more zones of a well bore, comprising a tubular housing having a bore therethrough connectable as part of a casing string to be lowered into and anchored within the well bore by a column of cement between it and the well bore, a perforating sleeve mounted in a first position within the housing bore and carrying shaped charges within a sealed chamber on its outer side facing the inside of the housing bore, means by which the charges may be detonated to perforate the housing and the cement column thereabout, and means by which the perforating sleeve may be shifted from its first position to a second position in the housing bore to uncover the perforations therein.

2. As in claim 1, including means on the sleeve and housing releasably holding said sleeve in its first position, and means on the sleeve and housing locking the sleeve in its second position automatically in response to movement into its second position.

3. As in claim 1, wherein the means by which the charges may be detonated includes a trigger extending from the chamber into the housing bore in position to cause the charges to be detonated when shifted with respect to the sleeve.

4. As in claim 3, wherein the means by which the charges may be detonated also includes a work string lowerable through the casing string and into the housing bore and having a tool thereon engagable with the trigger to shift it to detonating position in response to vertical movement of the work string.

5. As in claim 4, wherein the work string has means including another tool for sealably engaging the bore of the housing above the sleeve, so that, following activation of the charges, the work string may be raised to a position in which the sealing integrity of the perforating sleeve may be tested by pressure fluid in the work string.

6. As in claim 1, including a work string lowerable through the casing string and into the housing bore and having a tool thereon for sealably engaging the bore of the housing above the sleeve, so that, following activation of the charges, the tool may be raised with the work string to a position in which the sealing integrity of the perforating sleeve may be tested by pressure fluid in the work string.

7. Apparatus for use in perforating one or more zones of a well bore, comprising a tubular housing connectable as part of a casing string to be lowered into and anchored within the well bore by a column of cement between it and the well bore, a perforating sleeve mounted for shifting between first and second positions within the housing bore and carrying shaped charges on its outer side facing the bore of the housing, means sealing between the sleeve and housing bore to enclose the shaped charges within a sealed chamber when the sleeve is in its first position, means by which the charges may be detonated to perforate the housing and the cement column thereabout, means by which the perforating sleeve may be shifted, following detonation, to its second position in the housing bore to uncover the perforations therein, a seal sleeve mounted in a first position within the housing bore adjacent the perforating sleeve and being shiftable into a second position covering the perforations in the housing bore following shifting of the perforating sleeve to its second position, the seal sleeve then being shiftable back to the first position, means sealing between the seal sleeve and housing bore to close off the perforations in said second position.

8. As in claim 7, wherein the means by which the charges may be detonated includes a trigger extending from the chamber to dispose its outer end in position to be moved to a position to activate the charges.

9. As in claim 7, wherein the means by which the shaped charges may be detonated also includes a work string lowerable through the casing string and into the housing and having means thereon engagable with the outer end of the trigger to shift it to activating position.

10. As in claim 9, wherein the work string also has a tool thereon for sealably engaging the bore of the housing above the seal sleeve, so that, following activation of the charges, the tool may be raised to a position in which the sealing integrity of the perforating sleeve may be tested by pressure fluid in the work string.

11. As in claim 10, wherein the work string also has a tool thereon engagable with the perforating sleeve, following detonation of the charges and testing of its sealing integrity to shift the perforating sleeve to its second position, and, following shifting of the perforating sleeve to said second position, to shift the seal sleeve to its second position, following which the work string may again be raised to a position for again testing the perforating assembly.

12. As in claim 10, including a second work string lowerable through the casing string and into the housing bore, following retrieval of the first work string, and having a tool thereon engagable with the perforating sleeve, following testing of the sealing integrity of the perforating sleeve, to shift the perforating sleeve to its second position, and a tool sealably engagable with the seal sleeve, following shifting of the perforating sleeve to its second position, to permit treatment fluid to be circulated downwardly through the second work string and into the perforated zone, and then shift the seal sleeve back to its first position.

13. As in claim 12, wherein the second work string also has a tool thereon engagable with the seal sleeve to shift it to its second position, following shifting of the perforating sleeve to its second position, and reengagable with the seal sleeve to shift the seal sleeve from its first position to another position uncovering the perforations prior to circulation of treatment fluid.

14. As in claim 13, wherein the tool also shifts the seal sleeve back to its first position following treatment.

15. Apparatus for use in perforating one or more zones of a well bore, comprising a perforating assembly including a tubular housing connectible as part of a casing string to be lowered into and anchored within the well bore by a column of cement between the casing string and well bore and having an enclosed chamber in which shaped charges are mounted in position to perforate the housing and cement column opposite a selected zone, and means for detonating the charges, including a detonator wired to the shaped charges, a firing pin positioned to strike the detonator in order to detonate the charges, a trigger extending into the chamber and having an inner end movable, in response to activation of its outer end, from a first inactive position to a second position striking the firing pin, and detent means releasably holding said trigger in its first inactive position, said trigger having means intermediate the detent means and its outer end which is responsive to activation of its outer end to accumulate energy which, at a predetermined level, causes the detent means to be released.

16. As in claim 15, wherein the energy is accumulated in a spring compressible between the detent means and the outer end of the trigger.

17. As in claim 16, including a work string lowerable through the casing string and into the housing and having a tool disposable in a position opposite the outer end of the trigger in order to move it to its second position in response to lifting of the work string.

18. In a well having a casing string anchored within a well bore by a column of cement in the annulus between the casing string and well bore which penetrates a plurality of zones in the well, apparatus for perforating the zones comprising a plurality of perforating assemblies each having a housing with a bore therethrough installed in the string at a location opposite one of the zones, a perforating sleeve mounted within the housing bore and having shaped charges carried with an enclosed chamber in position to perforate the housing and string upon detonation, a trigger extending from the chamber into the bore of the housing, and a work string lowerable through the casing string and having means thereon sequentially engagable with the trigger of each assembly, as the string is moved vertically in the casing string, so as to successively detonate the charges of selected perforating sleeves.

19. As in claim 18, wherein the work string also has means thereon for sealably engaging within the bore of each assembly housing above the sleeve therein to permit fluid to be circulated downwardly through the work string to test the sealing integrity of each assembly.

20. As in claim 19, wherein each assembly further comprises a seal sleeve mounted in each housing at one end of the perforating sleeve, and the work string also has means thereon for shifting the perforating sleeve to a second position to uncover the perforations following detonation, and means for shifting the seal sleeve to a second position to cover and sealably enclose the perforations, following shifting of the perforating sleeve, whereby the work string may be returned to a position for sealably engaging the bore of the housing to permit testing of the sealing integrity of the perforating assembly.

21. As in claim 18, wherein each assembly also comprises a seal sleeve mounted in each housing at one end of the perforating sleeve, and including a second work string lowerable through the casing string and into each assembly, following retrieval of the first work string, and having means thereon for shifting the perforating sleeve thereof to a position to uncover the perforations and then sealably engaging the seal sleeve to permit fluid to be circulated downwardly into the casing string to treat each of the perforated zones from the lowermost zone upwardly.

22. As in claim 21, wherein the second work string also has means thereon for shifting each seal sleeve, following treatment, to a position enclosing the perforations opposite each zone.

23. Well apparatus, comprising a tubular housing connectable as part of a well pipe for lowering therewith into a well conduit disposed within a well bore, a perforating sleeve mounted in the housing and carrying perforating means within a sealed chamber between the sleeve and housing, means by which the perforating means may be activated in order to form perforations in one of the sleeve and housing, and means by which the sleeve may be shifted, following formation of the perforations, to open the interior of the well pipe to the annulus between it and the well conduit.

24. As in claim 23, wherein the perforating means is so arranged on the sleeve as to perforate the wall of the housing opposite thereto, so that, upon shifting the sleeve, the well pipe is opened to the annulus through the perforations.

25. As in claim 23, wherein the means by which the perforating means may be activated includes a trigger extending from the chamber.

26. As in claim 25, including a work string lowerable into the well pipe and housing and carrying a tool to engage the trigger and thereby activate the perforating means when so lowered.

27. As in claim 23, including a work string lowerable into the well pipe and housing and carrying a tool to activate the perforating means when so lowered.

28. As in claim 27, including another tool carried by the work string for sealing off in the housing to permit fluid to be circulated downwardly through the pipe to test the sealing integrity of the perforating sleeve following formation of the perforations.

29. As in claim 27, including another tool carried by the work string for shifting the perforating, sleeve to its open position.

30. As in claim 29, including a seal sleeve mounted in the housing adjacent the perforating sleeve and adapted to be shifted by the shifting tool, following shifting of the perforating sleeve, to a position closing the interior of the well pipe to the annulus, whereby the sealing integrity of the seal sleeve may be tested.

31. As in claim 29, including a seal sleeve mounted in the housing adjacent the perforating sleeve, and a second work string lowerable into the well pipe, upon removal of the first work string, and carrying means by which the seal sleeve may be shifted, following shifting of the perforating sleeve, between a position closing the interior of the well pipe to the annulus and then back to open position.

32. As in claim 31, including another work string lowerable into the well pipe, upon removal of the first string and having a tool thereon sealably engagable with the seal sleeve, in its open position, to permit treatment fluid to be circulated through the work string into the well bore.

33. As in claim 23, wherein the perforating means comprises shaped charges.

* * * * *